US011440314B2

(12) United States Patent
Matsumoto

(10) Patent No.: US 11,440,314 B2
(45) Date of Patent: Sep. 13, 2022

(54) PRINT HEAD CONTROL CIRCUIT, PRINT HEAD, AND LIQUID DISCHARGE APPARATUS

(71) Applicant: SEIKO EPSON CORPORATION, Tokyo (JP)

(72) Inventor: Yusuke Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 331 days.

(21) Appl. No.: 16/572,811

(22) Filed: Sep. 17, 2019

(65) Prior Publication Data

US 2020/0086641 A1 Mar. 19, 2020

(30) Foreign Application Priority Data

Sep. 19, 2018 (JP) ..... JP2018-174370
Feb. 28, 2019 (JP) ..... JP2019-036738

(51) Int. Cl.
*B41J 2/045* (2006.01)
*B41J 2/14* (2006.01)

(52) U.S. Cl.
CPC ..... *B41J 2/0451* (2013.01); *B41J 2/04541* (2013.01); *B41J 2/04548* (2013.01); *B41J 2/04563* (2013.01); *B41J 2/04581* (2013.01); *B41J 2/04591* (2013.01); *B41J 2002/14491* (2013.01)

(58) Field of Classification Search
CPC ..... B41J 2/0451
See application file for complete search history.

(56) References Cited

U.S. PATENT DOCUMENTS 5,699,090 A * 12/1997 Wade ..... B41J 2/04513 347/19
10,576,739 B2 3/2020 Yamada et al.
2008/0309425 A1* 12/2008 Sugita ..... B41J 2/04541 333/12
2014/0247299 A1* 9/2014 Kameyama ..... B41J 2/04541 347/14
2018/0272702 A1* 9/2018 Nitta ..... B41J 2/04581
2018/0345658 A1* 12/2018 Shimono ..... B41J 2/04588
(Continued)

FOREIGN PATENT DOCUMENTS

JP 2017-114020 A 6/2017
WO 2017/111065 A1 6/2017

*Primary Examiner* — Shelby L Fidler
(74) *Attorney, Agent, or Firm* — Global IP Counselors, LLP

(57) ABSTRACT

A print head control circuit includes a first diagnosis signal propagation wiring for propagating a first diagnosis signal, a fifth diagnosis signal propagation wiring for propagating a fifth diagnosis signal indicating a diagnosis result, and a second voltage signal propagation wiring for propagating a second voltage signal. The fifth diagnosis signal propagation wiring and the second voltage signal propagation wiring are electrically coupled to each other via a fifth terminal and a seventh terminal, and the first diagnosis signal propagation wiring and the second diagnosis signal propagation wiring are located to be aligned. The first diagnosis signal propagation wiring and the second voltage signal propagation wiring are located to be adjacent to each other in a direction in which the first diagnosis signal propagation wiring and the second diagnosis signal propagation wiring are aligned.

36 Claims, 31 Drawing Sheets

| CABLE 19 | | | CONTACT SECTION | CONNECTOR 350 | SIGNAL |
|---|---|---|---|---|---|
| TERMINAL NUMBER | WIRING NUMBER | TERMINAL NUMBER | | TERMINAL NUMBER | |
| 195-1 | 197-1 | 196-1 | 180-1 | 353-1 | COM4 |
| 195-2 | 197-2 | 196-2 | 180-2 | 353-2 | CGND4 |
| 195-3 | 197-3 | 196-3 | 180-3 | 353-3 | COM3 |
| 195-4 | 197-4 | 196-4 | 180-4 | 353-4 | CGND3 |
| 195-5 | 197-5 | 196-5 | 180-5 | 353-5 | COM2 |
| 195-6 | 197-6 | 196-6 | 180-6 | 353-6 | CGND2 |
| 195-7 | 197-7 | 196-7 | 180-7 | 353-7 | COM1 |
| 195-8 | 197-8 | 196-8 | 180-8 | 353-8 | CGND1 |
| 195-9 | 197-9 | 196-9 | 180-9 | 353-9 | VHV |
| 195-10 | 197-10 | 196-10 | 180-10 | 353-10 | GND |
| 195-11 | 197-11 | 196-11 | 180-11 | 353-11 | XHOT and DIG-E |
| 195-12 | 197-12 | 196-12 | 180-12 | 353-12 | GND |
| 195-13 | 197-13 | 196-13 | 180-13 | 353-13 | SI4 |
| 195-14 | 197-14 | 196-14 | 180-14 | 353-14 | GND |
| 195-15 | 197-15 | 196-15 | 180-15 | 353-15 | SI3 |
| 195-16 | 197-16 | 196-16 | 180-16 | 353-16 | GND |
| 195-17 | 197-17 | 196-17 | 180-17 | 353-17 | SI2 |
| 195-18 | 197-18 | 196-18 | 180-18 | 353-18 | GND |
| 195-19 | 197-19 | 196-19 | 180-19 | 353-19 | SI1 and DIG-D |
| 195-20 | 197-20 | 196-20 | 180-20 | 353-20 | GND |
| 195-21 | 197-21 | 196-21 | 180-21 | 353-21 | CH and DIG-C |
| 195-22 | 197-22 | 196-22 | 180-22 | 353-22 | GND |
| 195-23 | 197-23 | 196-23 | 180-23 | 353-23 | SCK and DIG-B |
| 195-24 | 197-24 | 196-24 | 180-24 | 353-24 | VDD2 |
| 195-25 | 197-25 | 196-25 | 180-25 | 353-25 | LAT and DIG-A |
| 195-26 | 197-26 | 196-26 | 180-26 | 353-26 | GND |
| 195-27 | 197-27 | 196-27 | 180-27 | 353-27 | TH |
| 195-28 | 197-28 | 196-28 | 180-28 | 353-28 | GND |
| 195-29 | 197-29 | 196-29 | 180-29 | 353-29 | VDD1 |

(56) References Cited

U.S. PATENT DOCUMENTS

| | | | | |
|---|---|---|---|---|
| 2018/0361739 | A1* | 12/2018 | Umeda | B41J 2/175 |
| 2019/0009527 | A1 | 1/2019 | Yamada et al. | |
| 2019/0009531 | A1 | 1/2019 | Furukawa | |
| 2019/0160811 | A1* | 5/2019 | Nakajima | B41J 2/1433 |

* cited by examiner

| [SIH, SIL] | | [1, 1] LARGE DOT | [1, 0] MEDIUM DOT | [0, 1] SMALL DOT | [0, 0] NON-RECORDING |
|---|---|---|---|---|---|
| S | T1 | H | H | L | L |
| | T2 | H | L | H | L |
| | T3 | L | L | L | H |

FIG. 20

| CABLE 19 | | | CONTACT SECTION | CONNECTOR 350 | SIGNAL |
|---|---|---|---|---|---|
| TERMINAL NUMBER | WIRING NUMBER | TERMINAL NUMBER | | TERMINAL NUMBER | |
| 195-1 | 197-1 | 196-1 | 180-1 | 353-1 | COM4 |
| 195-2 | 197-2 | 196-2 | 180-2 | 353-2 | CGND4 |
| 195-3 | 197-3 | 196-3 | 180-3 | 353-3 | COM3 |
| 195-4 | 197-4 | 196-4 | 180-4 | 353-4 | CGND3 |
| 195-5 | 197-5 | 196-5 | 180-5 | 353-5 | COM2 |
| 195-6 | 197-6 | 196-6 | 180-6 | 353-6 | CGND2 |
| 195-7 | 197-7 | 196-7 | 180-7 | 353-7 | COM1 |
| 195-8 | 197-8 | 196-8 | 180-8 | 353-8 | CGND1 |
| 195-9 | 197-9 | 196-9 | 180-9 | 353-9 | VHV |
| 195-10 | 197-10 | 196-10 | 180-10 | 353-10 | GND |
| 195-11 | 197-11 | 196-11 | 180-11 | 353-11 | XHOT and DIG-E |
| 195-12 | 197-12 | 196-12 | 180-12 | 353-12 | GND |
| 195-13 | 197-13 | 196-13 | 180-13 | 353-13 | SI4 |
| 195-14 | 197-14 | 196-14 | 180-14 | 353-14 | GND |
| 195-15 | 197-15 | 196-15 | 180-15 | 353-15 | SI3 |
| 195-16 | 197-16 | 196-16 | 180-16 | 353-16 | GND |
| 195-17 | 197-17 | 196-17 | 180-17 | 353-17 | SI2 |
| 195-18 | 197-18 | 196-18 | 180-18 | 353-18 | GND |
| 195-19 | 197-19 | 196-19 | 180-19 | 353-19 | SI1 and DIG-D |
| 195-20 | 197-20 | 196-20 | 180-20 | 353-20 | GND |
| 195-21 | 197-21 | 196-21 | 180-21 | 353-21 | CH and DIG-C |
| 195-22 | 197-22 | 196-22 | 180-22 | 353-22 | GND |
| 195-23 | 197-23 | 196-23 | 180-23 | 353-23 | SCK and DIG-B |
| 195-24 | 197-24 | 196-24 | 180-24 | 353-24 | VDD2 |
| 195-25 | 197-25 | 196-25 | 180-25 | 353-25 | LAT and DIG-A |
| 195-26 | 197-26 | 196-26 | 180-26 | 353-26 | GND |
| 195-27 | 197-27 | 196-27 | 180-27 | 353-27 | TH |
| 195-28 | 197-28 | 196-28 | 180-28 | 353-28 | GND |
| 195-29 | 197-29 | 196-29 | 180-29 | 353-29 | VDD1 |

FIG. 24

| CABLE 19a | | | CONTACT SECTION | CONNECTOR 350 | SIGNAL |
|---|---|---|---|---|---|
| TERMINAL NUMBER | WIRING NUMBER | TERMINAL NUMBER | | TERMINAL NUMBER | |
| 195a-1 | 197a-1 | 196a-1 | 180a-1 | 353-1 | COM6 |
| 195a-2 | 197a-2 | 196a-2 | 180a-2 | 353-2 | CGND6 |
| 195a-3 | 197a-3 | 196a-3 | 180a-3 | 353-3 | COM5 |
| 195a-4 | 197a-4 | 196a-4 | 180a-4 | 353-4 | CGND5 |
| 195a-5 | 197a-5 | 196a-5 | 180a-5 | 353-5 | COM4 |
| 195a-6 | 197a-6 | 196a-6 | 180a-6 | 353-6 | CGND4 |
| 195a-7 | 197a-7 | 196a-7 | 180a-7 | 353-7 | COM3 |
| 195a-8 | 197a-8 | 196a-8 | 180a-8 | 353-8 | CGND3 |
| 195a-9 | 197a-9 | 196a-9 | 180a-9 | 353-9 | COM2 |
| 195a-10 | 197a-10 | 196a-10 | 180a-10 | 353-10 | CGND2 |
| 195a-11 | 197a-11 | 196a-11 | 180a-11 | 353-11 | COM1 |
| 195a-12 | 197a-12 | 196a-12 | 180a-12 | 353-12 | CGND1 |
| 195a-13 | 197a-13 | 196a-13 | 180a-13 | 353-13 | VHV |
| 195a-14 | 197a-14 | 196a-14 | 180a-14 | 353-14 | GND |
| 195a-15 | 197a-15 | 196a-15 | 180a-15 | 353-15 | XHOT and DIG-E |
| 195a-16 | 197a-16 | 196a-16 | 180a-16 | 353-16 | GND |
| 195a-17 | 197a-17 | 196a-17 | 180a-17 | 353-17 | SI1 and DIG-D |
| 195a-18 | 197a-18 | 196a-18 | 180a-18 | 353-18 | GND |
| 195a-19 | 197a-19 | 196a-19 | 180a-19 | 353-19 | CH and DIG-C |
| 195a-20 | 197a-20 | 196a-20 | 180a-20 | 353-20 | GND |
| 195a-21 | 197a-21 | 196a-21 | 180a-21 | 353-21 | SCK and DIG-B |
| 195a-22 | 197a-22 | 196a-22 | 180a-22 | 353-22 | GND |
| 195a-23 | 197a-23 | 196a-23 | 180a-23 | 353-23 | LAT and DIG-A |
| 195a-24 | 197a-24 | 196a-24 | 180a-24 | 353-24 | GND |
| 195a-25 | 197a-25 | 196a-25 | 180a-25 | 353-25 | TH |
| 195a-26 | 197a-26 | 196a-26 | 180a-26 | 353-26 | GND |

FIG. 25

| CABLE 19b | | | CONTACT SECTION | CONNECTOR 360 | SIGNAL |
|---|---|---|---|---|---|
| TERMINAL NUMBER | WIRING NUMBER | TERMINAL NUMBER | | TERMINAL NUMBER | |
| 195b-1 | 197b-1 | 196b-1 | 180b-1 | 363-1 | CGND6 |
| 195b-2 | 197b-2 | 196b-2 | 180b-2 | 363-2 | COM6 |
| 195b-3 | 197b-3 | 196b-3 | 180b-3 | 363-3 | CGND5 |
| 195b-4 | 197b-4 | 196b-4 | 180b-4 | 363-4 | COM5 |
| 195b-5 | 197b-5 | 196b-5 | 180b-5 | 363-5 | CGND4 |
| 195b-6 | 197b-6 | 196b-6 | 180b-6 | 363-6 | COM4 |
| 195b-7 | 197b-7 | 196b-7 | 180b-7 | 363-7 | CGND3 |
| 195b-8 | 197b-8 | 196b-8 | 180b-8 | 363-8 | COM3 |
| 195b-9 | 197b-9 | 196b-9 | 180b-9 | 363-9 | CGND2 |
| 195b-10 | 197b-10 | 196b-10 | 180b-10 | 363-10 | COM2 |
| 195b-11 | 197b-11 | 196b-11 | 180b-11 | 363-11 | CGND1 |
| 195b-12 | 197b-12 | 196b-12 | 180b-12 | 363-12 | COM1 |
| 195b-13 | 197b-13 | 196b-13 | 180b-13 | 363-13 | GND |
| 195b-14 | 197b-14 | 196b-14 | 180b-14 | 363-14 | GND |
| 195b-15 | 197b-15 | 196b-15 | 180b-15 | 363-15 | GND |
| 195b-16 | 197b-16 | 196b-16 | 180b-16 | 363-16 | SI6 |
| 195b-17 | 197b-17 | 196b-17 | 180b-17 | 363-17 | GND |
| 195b-18 | 197b-18 | 196b-18 | 180b-18 | 363-18 | SI5 |
| 195b-19 | 197b-19 | 196b-19 | 180b-19 | 363-19 | GND |
| 195b-20 | 197b-20 | 196b-20 | 180b-20 | 363-20 | SI4 |
| 195b-21 | 197b-21 | 196b-21 | 180b-21 | 363-21 | VDD2 |
| 195b-22 | 197b-22 | 196b-22 | 180b-22 | 363-22 | SI3 |
| 195b-23 | 197b-23 | 196b-23 | 180b-23 | 363-23 | GND |
| 195b-24 | 197b-24 | 196b-24 | 180b-24 | 363-24 | SI2 |
| 195b-25 | 197b-25 | 196b-25 | 180b-25 | 363-25 | GND |
| 195b-26 | 197b-26 | 196b-26 | 180b-26 | 363-26 | VDD1 |

FIG. 30

| CABLE 19a | | | CONTACT SECTION | CONNECTOR 350 | SIGNAL |
|---|---|---|---|---|---|
| TERMINAL NUMBER | WIRING NUMBER | TERMINAL NUMBER | | TERMINAL NUMBER | |
| 195a-1 | 197a-1 | 196a-1 | 180a-1 | 353-1 | COM5 |
| 195a-2 | 197a-2 | 196a-2 | 180a-2 | 353-2 | CGND5 |
| 195a-3 | 197a-3 | 196a-3 | 180a-3 | 353-3 | COM4 |
| 195a-4 | 197a-4 | 196a-4 | 180a-4 | 353-4 | CGND4 |
| 195a-5 | 197a-5 | 196a-5 | 180a-5 | 353-5 | COM3 |
| 195a-6 | 197a-6 | 196a-6 | 180a-6 | 353-6 | CGND3 |
| 195a-7 | 197a-7 | 196a-7 | 180a-7 | 353-7 | COM2 |
| 195a-8 | 197a-8 | 196a-8 | 180a-8 | 353-8 | CGND2 |
| 195a-9 | 197a-9 | 196a-9 | 180a-9 | 353-9 | COM1 |
| 195a-10 | 197a-10 | 196a-10 | 180a-10 | 353-10 | CGND1 |
| 195a-11 | 197a-11 | 196a-11 | 180a-11 | 353-11 | SI1 and DIG-D |
| 195a-12 | 197a-12 | 196a-12 | 180a-12 | 353-12 | GND |
| 195a-13 | 197a-13 | 196a-13 | 180a-13 | 353-13 | CH1 and DIG-C |
| 195a-14 | 197a-14 | 196a-14 | 180a-14 | 353-14 | GND |
| 195a-15 | 197a-15 | 196a-15 | 180a-15 | 353-15 | SCK1 and DIG-B |
| 195a-16 | 197a-16 | 196a-16 | 180a-16 | 353-16 | GND |
| 195a-17 | 197a-17 | 196a-17 | 180a-17 | 353-17 | LAT1 and DIG-A |
| 195a-18 | 197a-18 | 196a-18 | 180a-18 | 353-18 | GND |
| 195a-19 | 197a-19 | 196a-19 | 180a-19 | 353-19 | TH |
| 195a-20 | 197a-20 | 196a-20 | 180a-20 | 353-20 | GND |

FIG. 31

| CABLE 19b | | | CONTACT SECTION | CONNECTOR 360 | SIGNAL |
|---|---|---|---|---|---|
| TERMINAL NUMBER | WIRING NUMBER | TERMINAL NUMBER | | TERMINAL NUMBER | |
| 195b-1 | 197b-1 | 196b-1 | 180b-1 | 363-1 | CGND5 |
| 195b-2 | 197b-2 | 196b-2 | 180b-2 | 363-2 | COM5 |
| 195b-3 | 197b-3 | 196b-3 | 180b-3 | 363-3 | CGND4 |
| 195b-4 | 197b-4 | 196b-4 | 180b-4 | 363-4 | COM4 |
| 195b-5 | 197b-5 | 196b-5 | 180b-5 | 363-5 | CGND3 |
| 195b-6 | 197b-6 | 196b-6 | 180b-6 | 363-6 | COM3 |
| 195b-7 | 197b-7 | 196b-7 | 180b-7 | 363-7 | CGND2 |
| 195b-8 | 197b-8 | 196b-8 | 180b-8 | 363-8 | COM2 |
| 195b-9 | 197b-9 | 196b-9 | 180b-9 | 363-9 | CGND1 |
| 195b-10 | 197b-10 | 196b-10 | 180b-10 | 363-10 | COM1 |
| 195b-11 | 197b-11 | 196b-11 | 180b-11 | 363-11 | GND |
| 195b-12 | 197b-12 | 196b-12 | 180b-12 | 363-12 | SI5 |
| 195b-13 | 197b-13 | 196b-13 | 180b-13 | 363-13 | GND |
| 195b-14 | 197b-14 | 196b-14 | 180b-14 | 363-14 | SI4 |
| 195b-15 | 197b-15 | 196b-15 | 180b-15 | 363-15 | GND |
| 195b-16 | 197b-16 | 196b-16 | 180b-16 | 363-16 | SI3 |
| 195b-17 | 197b-17 | 196b-17 | 180b-17 | 363-17 | GND |
| 195b-18 | 197b-18 | 196b-18 | 180b-18 | 363-18 | SI2 |
| 195b-19 | 197b-19 | 196b-19 | 180b-19 | 363-19 | GND |
| 195b-20 | 197b-20 | 196b-20 | 180b-20 | 363-20 | VDD1 |

FIG. 32

| CABLE 19c | | | CONTACT SECTION | CONNECTOR 370 | SIGNAL |
|---|---|---|---|---|---|
| TERMINAL NUMBER | WIRING NUMBER | TERMINAL NUMBER | | TERMINAL NUMBER | |
| 195c-1 | 197c-1 | 196c-1 | 180c-1 | 373-1 | CGND6 |
| 195c-2 | 197c-2 | 196c-2 | 180c-2 | 373-2 | COM6 |
| 195c-3 | 197c-3 | 196c-3 | 180c-3 | 373-3 | CGND7 |
| 195c-4 | 197c-4 | 196c-4 | 180c-4 | 373-4 | COM7 |
| 195c-5 | 197c-5 | 196c-5 | 180c-5 | 373-5 | CGND8 |
| 195c-6 | 197c-6 | 196c-6 | 180c-6 | 373-6 | COM8 |
| 195c-7 | 197c-7 | 196c-7 | 180c-7 | 373-7 | CGND9 |
| 195c-8 | 197c-8 | 196c-8 | 180c-8 | 373-8 | COM9 |
| 195c-9 | 197c-9 | 196c-9 | 180c-9 | 373-9 | CGND10 |
| 195c-10 | 197c-10 | 196c-10 | 180c-10 | 373-10 | COM10 |
| 195c-11 | 197c-11 | 196c-11 | 180c-11 | 373-11 | GND |
| 195c-12 | 197c-12 | 196c-12 | 180c-12 | 373-12 | XHOT and DIG-E |
| 195c-13 | 197c-13 | 196c-13 | 180c-13 | 373-13 | GND |
| 195c-14 | 197c-14 | 196c-14 | 180c-14 | 373-14 | LAT2 and DIG-F |
| 195c-15 | 197c-15 | 196c-15 | 180c-15 | 373-15 | GND |
| 195c-16 | 197c-16 | 196c-16 | 180c-16 | 373-16 | SCK2 and DIG-G |
| 195c-17 | 197c-17 | 196c-17 | 180c-17 | 373-17 | GND |
| 195c-18 | 197c-18 | 196c-18 | 180c-18 | 373-18 | CH2 and DIG-H |
| 195c-19 | 197c-19 | 196c-19 | 180c-19 | 373-19 | GND |
| 195c-20 | 197c-20 | 196c-20 | 180c-20 | 373-20 | SI10 and DIG-I |

FIG. 33

| CABLE 19d | | | CONTACT SECTION | CONNECTOR 380 | SIGNAL |
|---|---|---|---|---|---|
| TERMINAL NUMBER | WIRING NUMBER | TERMINAL NUMBER | | TERMINAL NUMBER | |
| 195d-1 | 197d-1 | 196d-1 | 180d-1 | 383-1 | COM6 |
| 195d-2 | 197d-2 | 196d-2 | 180d-2 | 383-2 | CGND6 |
| 195d-3 | 197d-3 | 196d-3 | 180d-3 | 383-3 | COM7 |
| 195d-4 | 197d-4 | 196d-4 | 180d-4 | 383-4 | CGND7 |
| 195d-5 | 197d-5 | 196d-5 | 180d-5 | 383-5 | COM8 |
| 195d-6 | 197d-6 | 196d-6 | 180d-6 | 383-6 | CGND8 |
| 195d-7 | 197d-7 | 196d-7 | 180d-7 | 383-7 | COM9 |
| 195d-8 | 197d-8 | 196d-8 | 180d-8 | 383-8 | CGND9 |
| 195d-9 | 197d-9 | 196d-9 | 180d-9 | 383-9 | COM10 |
| 195d-10 | 197d-10 | 196d-10 | 180d-10 | 383-10 | CGND10 |
| 195d-11 | 197d-11 | 196d-11 | 180d-11 | 383-11 | VHV |
| 195d-12 | 197d-12 | 196d-12 | 180d-12 | 383-12 | GND |
| 195d-13 | 197d-13 | 196d-13 | 180d-13 | 383-13 | SI6 |
| 195d-14 | 197d-14 | 196d-14 | 180d-14 | 383-14 | GND |
| 195d-15 | 197d-15 | 196d-15 | 180d-15 | 383-15 | SI7 |
| 195d-16 | 197d-16 | 196d-16 | 180d-16 | 383-16 | VDD2 |
| 195d-17 | 197d-17 | 196d-17 | 180d-17 | 383-17 | SI8 |
| 195d-18 | 197d-18 | 196d-18 | 180d-18 | 383-18 | GND |
| 195d-19 | 197d-19 | 196d-19 | 180d-19 | 383-19 | SI9 |
| 195d-20 | 197d-20 | 196d-20 | 180d-20 | 383-20 | GND |

PRINT HEAD CONTROL CIRCUIT, PRINT HEAD, AND LIQUID DISCHARGE APPARATUS

The present application is based on, and claims priority from JP Application Serial Number 2018-174370, filed Sep. 19, 2018 and JP Application Serial Number 2019-036738, filed Feb. 28, 2019, the disclosures of which are hereby incorporated by reference herein in their entirety.

BACKGROUND

1. Technical Field

The present disclosure relates to a print head control circuit, a print head, and a liquid discharge apparatus.

2. Related Art

A liquid discharge apparatus such as an ink jet printer forms characters or an image on a recording medium in a manner that the liquid discharge apparatus drives a piezoelectric element provided in a print head by a driving signal and thus discharges a liquid such as an ink with which a cavity is filled, from a nozzle. In such a liquid discharge apparatus, when a problem occurs in the print head, discharge abnormality in which it is not possible to normally discharge the liquid from the nozzle may occur. When such discharge abnormality occurs, discharge accuracy of the ink discharged from the nozzle may be decreased, and quality of an image formed on the recording medium may be decreased.

JP-A-2017-114020 discloses a print head having a self-diagnosis function of determining whether or not a dot satisfying normal print quality can be formed, in accordance with a plurality of signals input to a print head by a head unit (print head) itself.

In the liquid discharge apparatus disclosed in JP-A-2017-114020, when the waveform of a signal input to the print head for performing the self-diagnosis function is distorted, the self-diagnosis function of the print head may not be normally performed. A technology for reducing distortion of the waveform of a signal for performing the above-described self-diagnosis function is not disclosed in JP-A-2017-114020.

SUMMARY

According to an aspect of the present disclosure, a print head control circuit controls an operation of a print head including a driving element that drives based on a driving signal, so as to discharge a liquid from a nozzle, a driving signal selection circuit that controls a supply of the driving signal to the driving element, a first terminal, a second terminal, a third terminal, a fourth terminal, a fifth terminal, a sixth terminal, a seventh terminal, and a diagnosis circuit that diagnoses whether or not normal discharge of the liquid is possible, based on a first diagnosis signal input to the first terminal, a second diagnosis signal input to the second terminal, a third diagnosis signal input to the third terminal, a fourth diagnosis signal input to the fourth terminal. The print head control circuit includes a first diagnosis signal propagation wiring for propagating the first diagnosis signal, a second diagnosis signal propagation wiring for propagating the second diagnosis signal, a third diagnosis signal propagation wiring for propagating the third diagnosis signal, a fourth diagnosis signal propagation wiring for propagating the fourth diagnosis signal, a fifth diagnosis signal propagation wiring for propagating a fifth diagnosis signal which is input to the fifth terminal and indicates a diagnosis result of the diagnosis circuit, a first voltage signal propagation wiring for propagating a first voltage signal which is input to the sixth terminal and is supplied to the driving signal selection circuit, a second voltage signal propagation wiring for propagating a second voltage signal input to the seventh terminal, a diagnosis signal output circuit that outputs the first diagnosis signal, the second diagnosis signal, the third diagnosis signal, and the fourth diagnosis signal, and a driving signal output circuit that outputs the driving signal. When the fifth diagnosis signal propagation wiring and the second voltage signal propagation wiring are electrically coupled to the print head, the fifth diagnosis signal propagation wiring and the second voltage signal propagation wiring are electrically coupled to each other via the fifth terminal and the seventh terminal. The first diagnosis signal propagation wiring and the second diagnosis signal propagation wiring are located to be aligned. The first diagnosis signal propagation wiring and the second voltage signal propagation wiring are located to be adjacent to each other in a direction in which the first diagnosis signal propagation wiring and the second diagnosis signal propagation wiring are aligned.

According to another aspect of the present disclosure, a print head control circuit controls an operation of a print head including a driving element that drives based on a driving signal, so as to discharge a liquid from a nozzle, a driving signal selection circuit that controls a supply of the driving signal to the driving element, a first terminal, a second terminal, a third terminal, a fourth terminal, a fifth terminal, a sixth terminal, a seventh terminal, and a diagnosis circuit that diagnoses whether or not normal discharge of the liquid is possible, based on a first diagnosis signal input to the first terminal, a second diagnosis signal input to the second terminal, a third diagnosis signal input to the third terminal, a fourth diagnosis signal input to the fourth terminal. The print head control circuit includes a first diagnosis signal propagation wiring for propagating the first diagnosis signal, a second diagnosis signal propagation wiring for propagating the second diagnosis signal, a third diagnosis signal propagation wiring for propagating the third diagnosis signal, a fourth diagnosis signal propagation wiring for propagating the fourth diagnosis signal, a fifth diagnosis signal propagation wiring for propagating a fifth diagnosis signal which is input to the fifth terminal and indicates a diagnosis result of the diagnosis circuit, a first voltage signal propagation wiring for propagating a first voltage signal which is input to the sixth terminal and is supplied to the driving signal selection circuit, a second voltage signal propagation wiring for propagating a second voltage signal input to the seventh terminal, a diagnosis signal output circuit that outputs the first diagnosis signal, the second diagnosis signal, the third diagnosis signal, and the fourth diagnosis signal, and a driving signal output circuit that outputs the driving signal. When the fifth diagnosis signal propagation wiring and the second voltage signal propagation wiring are electrically coupled to the print head, the fifth diagnosis signal propagation wiring and the second voltage signal propagation wiring are electrically coupled to the each other via the fifth terminal and the seventh terminal. The first diagnosis signal propagation wiring and the second diagnosis signal propagation wiring are located to be aligned. The first diagnosis signal propagation wiring and the second voltage signal propagation wiring are located to overlap each other in a direction intersecting a direction in which the first diagnosis signal propagation wiring and the second diagnosis signal propagation wiring are aligned.

In the print head control circuit, the fifth diagnosis signal propagation wiring may also be used as a wiring for propagating a signal indicating whether or not temperature abnormality occurs in the print head.

The print head control circuit may further include a first ground signal propagation wiring for propagating a ground signal. The first diagnosis signal propagation wiring and the first ground signal propagation wiring may be located to be adjacent to each other in the direction in which the first diagnosis signal propagation wiring and the second diagnosis signal propagation wiring are aligned.

The print head control circuit may further include a third voltage signal propagation wiring for propagating a third voltage signal having a voltage value larger than a voltage value of the first voltage signal. The second voltage signal propagation wiring and the third voltage signal propagation wiring may not be located to be adjacent to each other in the direction in which the first diagnosis signal propagation wiring and the second diagnosis signal propagation wiring are aligned.

The print head control circuit may further include a third voltage signal propagation wiring for propagating a third voltage signal having a voltage value larger than a voltage value of the first voltage signal. The second voltage signal propagation wiring and the third voltage signal propagation wiring may not be located to overlap each other in a direction perpendicular to the direction in which the first diagnosis signal propagation wiring and the second diagnosis signal propagation wiring are aligned.

The print head control circuit may further include a second ground signal propagation wiring for propagating the ground signal. The third voltage signal propagation wiring and the second ground signal propagation wiring may be located to be adjacent to each other in the direction in which the first diagnosis signal propagation wiring and the second diagnosis signal propagation wiring are aligned.

The print head control circuit may further include a second ground signal propagation wiring for propagating the ground signal. The third voltage signal propagation wiring and the second ground signal propagation wiring may be located to overlap each other in a direction intersecting the direction in which the first diagnosis signal propagation wiring and the second diagnosis signal propagation wiring are aligned.

In the print head control circuit, the print head may include a first connector including the first terminal, the second terminal, the third terminal, the fourth terminal, and the fifth terminal and a substrate. The first connector and the diagnosis circuit may be provided on the same surface of the substrate. The first diagnosis signal propagation wiring, the second diagnosis signal propagation wiring, the third diagnosis signal propagation wiring, the fourth diagnosis signal propagation wiring, and the fifth diagnosis signal propagation wiring may be provided in the same cable. The cable may be electrically coupled to the first connector.

In the print head control circuit, the first diagnosis signal propagation wiring may also be used as a wiring for propagating a clock signal.

In the print head control circuit, the second diagnosis signal propagation wiring may also be used as a wiring for propagating a signal for defining a discharge timing of the liquid.

In the print head control circuit, the third diagnosis signal propagation wiring may also be used as a wiring for propagating a signal for defining a waveform switching timing of the driving signal.

In the print head control circuit, the fourth diagnosis signal propagation wiring may also be used as a wiring for propagating a signal for defining selection of a waveform of the driving signal.

According to an aspect of the present disclosure, a print head includes a driving element that drives based on a driving signal, so as to discharge a liquid from a nozzle, a driving signal selection circuit that controls a supply of the driving signal to the driving element, a diagnosis circuit that diagnoses whether or not normal discharge of the liquid is possible, based on a first diagnosis signal, a second diagnosis signal, a third diagnosis signal, and a fourth diagnosis signal, a first terminal to which the first diagnosis signal is input, a second terminal to which the second diagnosis signal is input, a third terminal to which the third diagnosis signal is input, a fourth terminal to which the fourth diagnosis signal is input, a fifth terminal to which a fifth diagnosis signal indicating a diagnosis result of the diagnosis circuit is input, a sixth terminal to which a first voltage signal to be supplied to the driving signal selection circuit is input, and a seventh terminal to which a second voltage signal is input. The fifth terminal and the seventh terminal are electrically coupled to each other. The first terminal and the second terminal are located to be aligned. The first terminal and the seventh terminal are located to be adjacent to each other in a direction in which the first terminal and the second terminal are aligned.

According to another aspect of the present disclosure, a print head includes a driving element that drives based on a driving signal, so as to discharge a liquid from a nozzle, a driving signal selection circuit that controls a supply of the driving signal to the driving element, a diagnosis circuit that diagnoses whether or not normal discharge of the liquid is possible, based on a first diagnosis signal, a second diagnosis signal, a third diagnosis signal, and a fourth diagnosis signal, a first terminal to which the first diagnosis signal is input, a second terminal to which the second diagnosis signal is input, a third terminal to which the third diagnosis signal is input, a fourth terminal to which the fourth diagnosis signal is input, a fifth terminal to which a fifth diagnosis signal indicating a diagnosis result of the diagnosis circuit is input, a sixth terminal to which a first voltage signal to be supplied to the driving signal selection circuit is input, and a seventh terminal to which a second voltage signal is input. The fifth terminal and the seventh terminal are electrically coupled to each other. The first terminal and the second terminal are located to be aligned. The first terminal and the seventh terminal are located to overlap each other in a direction intersecting a direction in which the first terminal and the second terminal are aligned.

The print head may further include a temperature abnormality detection circuit that diagnoses whether or not temperature abnormality occurs. The fifth terminal may also be used as a terminal to which a signal indicating whether or not temperature abnormality occurs is input.

The print head may further include a first ground terminal to which a ground signal is input. The first terminal and the first ground terminal may be located to be adjacent to each other in the direction in which the first terminal and the second terminal are aligned.

The print head may further include an eighth terminal to which a third voltage signal having a voltage value larger than a voltage value of the first voltage signal. The seventh terminal and the eighth terminal may not be located to be adjacent to each other in the direction in which the first terminal and the second terminal are aligned.

The print head may further include an eighth terminal to which a third voltage signal having a voltage value larger than a voltage value of the first voltage signal. The seventh terminal and the eighth terminal may not be located to overlap each other in a direction perpendicular to the direction in which the first terminal and the second terminal are aligned.

The print head may further include a second ground terminal to which the ground signal is input. The eighth terminal and the second ground terminal may be located to be adjacent to each other in the direction in which the first terminal and the second terminal are aligned.

The print head may further include a second ground terminal to which the ground signal is input. The eighth terminal and the second ground terminal may be located to overlap each other in a direction intersecting the direction in which the first terminal and the second terminal are aligned.

The print head a first connector including the first terminal, the second terminal, the third terminal, the fourth terminal, and the fifth terminal, and a substrate. The first connector and the diagnosis circuit may be provided on the same surface of the substrate.

In the print head, the first terminal may also be used as a terminal to which a clock signal is input.

In the print head, the second terminal may also be used as a terminal to which a signal for defining a discharge timing of the liquid is input.

In the print head, the third terminal may also be used as a terminal to which a signal for defining a waveform switching timing of the driving signal is input.

In the print head, the fourth terminal may also be used as a terminal to which a signal for defining selection of a waveform of the driving signal is input.

According to an aspect of the present disclosure, a liquid discharge apparatus includes a print head, and a print head control circuit that controls an operation of the print head. The print head includes a driving element that drives based on a driving signal, so as to discharge a liquid from a nozzle, a driving signal selection circuit that controls a supply of the driving signal to the driving element, a diagnosis circuit that diagnoses whether or not normal discharge of the liquid is possible, based on a first diagnosis signal, a second diagnosis signal, a third diagnosis signal, and a fourth diagnosis signal, a first terminal to which the first diagnosis signal is input, a second terminal to which the second diagnosis signal is input, a third terminal to which the third diagnosis signal is input, a fourth terminal to which the fourth diagnosis signal is input, a fifth terminal to which a fifth diagnosis signal indicating a diagnosis result of the diagnosis circuit is input, a sixth terminal to which a first voltage signal to be supplied to the driving signal selection circuit is input, and a seventh terminal to which a second voltage signal is input. The print head control circuit includes a first diagnosis signal propagation wiring for propagating the first diagnosis signal, a second diagnosis signal propagation wiring for propagating the second diagnosis signal, a third diagnosis signal propagation wiring for propagating the third diagnosis signal, a fourth diagnosis signal propagation wiring for propagating the fourth diagnosis signal, a fifth diagnosis signal propagation wiring for propagating the fifth diagnosis signal, a first voltage signal propagation wiring for propagating the first voltage signal, a second voltage signal propagation wiring for propagating the second voltage signal, a diagnosis signal output circuit that outputs the first diagnosis signal, the second diagnosis signal, the third diagnosis signal, and the fourth diagnosis signal, and a driving signal output circuit that outputs the driving signal. The first diagnosis signal propagation wiring is electrically in contact with the first terminal at a first contact section. The second diagnosis signal propagation wiring is electrically in contact with the second terminal at a second contact section. The third diagnosis signal propagation wiring is electrically in contact with the third terminal at a third contact section. The fourth diagnosis signal propagation wiring is electrically in contact with the fourth terminal at a fourth contact section. The fifth diagnosis signal propagation wiring is electrically in contact with the fifth terminal at a fifth contact section. The first voltage signal propagation wiring is electrically in contact with the sixth terminal at a sixth contact section. The second voltage signal propagation wiring is electrically in contact with the seventh terminal at a seventh contact section. The fifth diagnosis signal propagation wiring and the second voltage signal propagation wiring are electrically coupled to each other via the fifth terminal, the fifth contact section, the seventh contact section, and the seventh terminal. The first contact section and the second contact section are located to be aligned. The first contact section and the seventh contact section are located to be adjacent to each other in a direction in which the first contact section and the second contact section are aligned.

According to an aspect of the present disclosure, a liquid discharge apparatus includes a print head, and a print head control circuit that controls an operation of the print head. The print head includes controls an operation of a print head including a driving element that drives based on a driving signal, so as to discharge a liquid from a nozzle, a driving signal selection circuit that controls a supply of the driving signal to the driving element, a diagnosis circuit that diagnoses whether or not normal discharge of the liquid is possible, based on a first diagnosis signal, a second diagnosis signal, a third diagnosis signal, and a fourth diagnosis signal, a first terminal to which the first diagnosis signal is input, a second terminal to which the second diagnosis signal is input, a third terminal to which the third diagnosis signal is input, a fourth terminal to which the fourth diagnosis signal is input, a fifth terminal to which a fifth diagnosis signal indicating a diagnosis result of the diagnosis circuit is input, a sixth terminal to which a first voltage signal to be supplied to the driving signal selection circuit, and a seventh terminal to which a second voltage signal is input. The print head control circuit includes a first diagnosis signal propagation wiring for propagating the first diagnosis signal, a second diagnosis signal propagation wiring for propagating the second diagnosis signal, a third diagnosis signal propagation wiring for propagating the third diagnosis signal, a fourth diagnosis signal propagation wiring for propagating the fourth diagnosis signal, a fifth diagnosis signal propagation wiring for propagating the fifth diagnosis signal, a first voltage signal propagation wiring for propagating the first voltage signal, a second voltage signal propagation wiring for propagating the second voltage signal, a diagnosis signal output circuit that outputs the first diagnosis signal, the second diagnosis signal, the third diagnosis signal, and the fourth diagnosis signal, and a driving signal output circuit that outputs the driving signal. The first diagnosis signal propagation wiring is electrically in contact with the first terminal at a first contact section. The second diagnosis signal propagation wiring is electrically in contact with the second terminal at a second contact section. The third diagnosis signal propagation wiring is electrically in contact with the third terminal at a third contact section.

The fourth diagnosis signal propagation wiring is electrically in contact with the fourth terminal at a fourth contact section. The fifth diagnosis signal propagation wiring is electrically in contact with the fifth terminal at a fifth contact section. The first voltage signal propagation wiring is electrically in contact with the sixth terminal at a sixth contact section. The second voltage signal propagation wiring is electrically in contact with the seventh terminal at a seventh contact section. The fifth diagnosis signal propagation wiring and the second voltage signal propagation wiring are electrically coupled to each other via the fifth terminal, the fifth contact section, the seventh contact section, and the seventh terminal. The first contact section and the seventh contact section are located to overlap each other in a direction intersecting a direction in which the first contact section and the second contact section are aligned.

In the liquid discharge apparatus, the print head may further include a temperature abnormality detection circuit that diagnoses whether or not temperature abnormality occurs. The fifth diagnosis signal propagation wiring may also be used as a wiring for propagating a signal indicating whether or not the temperature abnormality occurs.

In the liquid discharge apparatus, the print head may further include a first ground terminal to which a ground signal is input. The print head control circuit may further include a first ground signal propagation wiring for propagating the ground signal. The first ground signal propagation wiring may be electrically in contact with the first ground terminal at a first ground contact section. The first contact section and the first ground contact section may be located to be adjacent to each other in the direction in which the first contact section and the second contact section are aligned.

In the liquid discharge apparatus, the print head may further include an eighth terminal to which a third voltage signal having a voltage value larger than a voltage value of the first voltage signal is input. The print head control circuit may further include a third voltage signal propagation wiring for propagating the third voltage signal. The third voltage signal propagation wiring may be electrically in contact with the eighth terminal at an eighth contact section. The seventh contact section and the eighth contact section may not be located to be adjacent to each other in the direction in which the first contact section and the second contact section are aligned.

In the liquid discharge apparatus, the print head may further include an eighth terminal to which a third voltage signal having a voltage value larger than a voltage value of the first voltage signal is input. The print head control circuit may further include a third voltage signal propagation wiring for propagating the third voltage signal. The third voltage signal propagation wiring may be electrically in contact with the eighth terminal at an eighth contact section. The seventh contact section and the eighth contact section may not be located to overlap each other in a direction perpendicular to the direction in which the first contact section and the second contact section are aligned.

In the liquid discharge apparatus, the print head may further include a second ground terminal to which the ground signal is input. The print head control circuit may further include a second ground signal propagation wiring for propagating the ground signal. The second ground signal propagation wiring may be electrically in contact with the second ground terminal at a second ground contact section. The eighth contact section and the second ground contact section may be located to be adjacent to each other in the direction in which the first contact section and the second contact section are aligned.

In the liquid discharge apparatus, the print head may further include a second ground terminal to which the ground signal is input. The print head control circuit may further include a second ground signal propagation wiring for propagating the ground signal. The second ground signal propagation wiring may be electrically in contact with the second ground terminal at a second ground contact section. The eighth contact section and the second ground contact section may be located to overlap each other in a direction intersecting the direction in which the first contact section and the second contact section are aligned.

In the liquid discharge apparatus, the print head may further include a first connector including the first terminal, the second terminal, the third terminal, the fourth terminal, and the fifth terminal and a substrate. The first connector and the diagnosis circuit may be provided on the same surface of the substrate. The first diagnosis signal propagation wiring, the second diagnosis signal propagation wiring, the third diagnosis signal propagation wiring, the fourth diagnosis signal propagation wiring, and the fifth diagnosis signal propagation wiring may be provided in the same cable. The cable may be electrically coupled to the first connector.

In the liquid discharge apparatus, the first diagnosis signal propagation wiring may also be used as a wiring for propagating a clock signal.

In the liquid discharge apparatus, the second diagnosis signal propagation wiring may also be used as a wiring for propagating a signal for defining a discharge timing of the liquid.

In the liquid discharge apparatus, the third diagnosis signal propagation wiring may also be used as a wiring for propagating a signal for defining a waveform switching timing of the driving signal.

In the liquid discharge apparatus, the fourth diagnosis signal propagation wiring may also be used as a wiring for propagating a signal for defining selection of a waveform of the driving signal.

BRIEF DESCRIPTION OF THE DRAWINGS

FIG. 20 is a diagram illustrating details of a signal propagated in the cable.

FIG. 24 is a diagram illustrating details of a signal propagated in a cable 19*a* in the second embodiment.

FIG. 25 is a diagram illustrating details of a signal propagated in a cable 19*b* in the second embodiment.

FIG. 30 is a diagram illustrating details of a signal propagated in a cable 19*a* in the third embodiment.

FIG. 31 is a diagram illustrating details of a signal propagated in a cable 19*b* in the third embodiment.

FIG. 32 is a diagram illustrating details of a signal propagated in a cable 19*c* in the third embodiment.

FIG. 33 is a diagram illustrating details of a signal propagated in a cable 19*d* in the third embodiment.

DESCRIPTION OF EXEMPLARY EMBODIMENTS

Hereinafter, preferred embodiments of the present disclosure will be described with reference to the drawings. The drawings are used for easy descriptions. The embodiments described below do not limit the scope of the present disclosure described in the claims. All components described later are not necessarily essential constituent elements of the present disclosure.

1. First Embodiment

1.1. Outline of Liquid Discharge Apparatus

Figure 1:
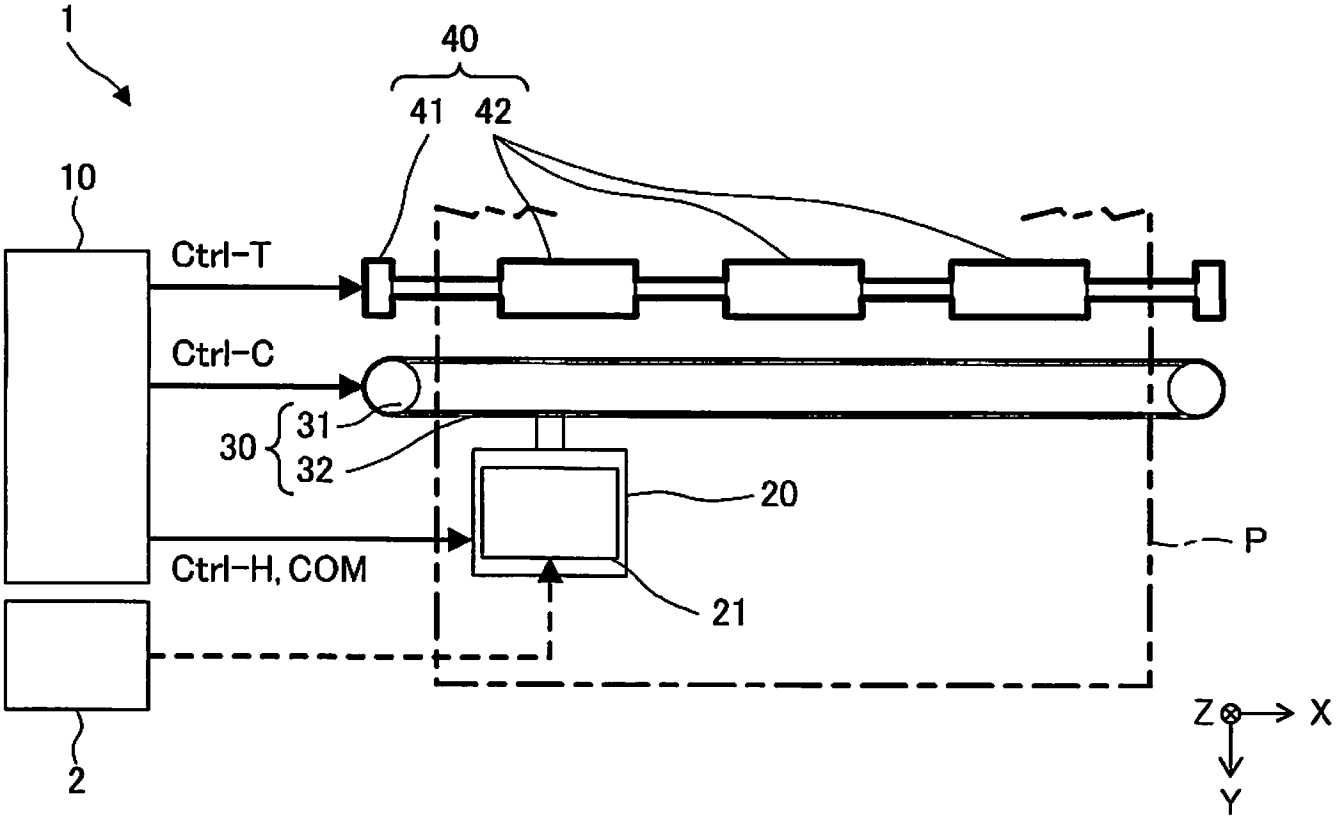
FIG. 1 is a diagram illustrating an overall configuration of a liquid discharge apparatus.

FIG. 1 is a diagram illustrating an overall configuration of a liquid discharge apparatus 1. The liquid discharge apparatus 1 is a serial printing type ink jet printer that forms an image on a medium P in a manner that a carriage 20 discharges an ink to the transported medium P with reciprocating. In the carriage 20, a print head 21 that discharges the ink as an example of a liquid is mounted. In the following descriptions, descriptions will be made on the assumption that a direction in which the carriage 20 moves is an X-direction, a direction in which the medium P is transported is a Y-direction, and a direction in which the ink is discharged is a Z-direction. Descriptions will be made on the assumption that the X-direction, the Y-direction, and the Z-direction are perpendicular to each other. As the medium P, any printing target such as print paper, a resin film, and a cloth can be used.

The liquid discharge apparatus 1 includes a liquid container 2, a control mechanism 10, the carriage 20, a movement mechanism 30, and a transport mechanism 40.

Plural kinds of inks to be discharged onto a medium P are stored in the liquid container 2. As the color of the ink stored in the liquid container 2, black, cyan, magenta, yellow, red, and gray are exemplified. As the liquid container 2 in which such an ink is stored, an ink cartridge, a bag-like ink pack formed of a flexible film, an ink tank capable of replenishing ink, or the like is used.

The control mechanism 10 includes, for example, a processing circuit such as a central processing unit (CPU) or a field programmable gate array (FPGA) and a storage circuit such as a semiconductor memory. The control mechanism 10 controls elements of the liquid discharge apparatus 1.

The print head 21 is mounted in the carriage 20. The carriage 20 is fixed to an endless belt 32 of the movement mechanism 30. The liquid container 2 may also be mounted in the carriage 20.

A control signal Ctrl-H and one or a plurality of driving signals COM are input to the print head 21. The control signal Ctrl-H is output by the control mechanism 10 and is used for controlling the print head 21. The driving signal COM is output by the control mechanism 10 and is used for driving the print head 21. The print head 21 discharges an ink supplied from the liquid container 2 based on the control signal Ctrl-H and the driving signal COM.

The movement mechanism 30 includes a carriage motor 31 and the endless belt 32. The carriage motor 31 operates based on a control signal Ctrl-C input from the control mechanism 10. The endless belt 32 rotates by the operation of the carriage motor 31. Thus, the carriage 20 fixed to the endless belt 32 reciprocates in the X-direction.

The transport mechanism 40 includes a transport motor 41 and a transport roller 42. The transport motor 41 operates based on a control signal Ctrl-T input from the control mechanism 10. The transport roller 42 rotates by the operation of the transport motor 41. A medium P is transported in the Y-direction with the rotation of the transport roller 42.

As described above, the liquid discharge apparatus 1 forms a desired image on a medium P by landing an ink at any position on the surface of the medium P in a manner that the liquid discharge apparatus discharges the ink from the print head 21 mounted in the carriage 20 with transport of the medium P by the transport mechanism 40 and reciprocation of the carriage 20 by the movement mechanism 30.

1.2. Electrical Configuration of Liquid Discharge Apparatus

Figure 2:
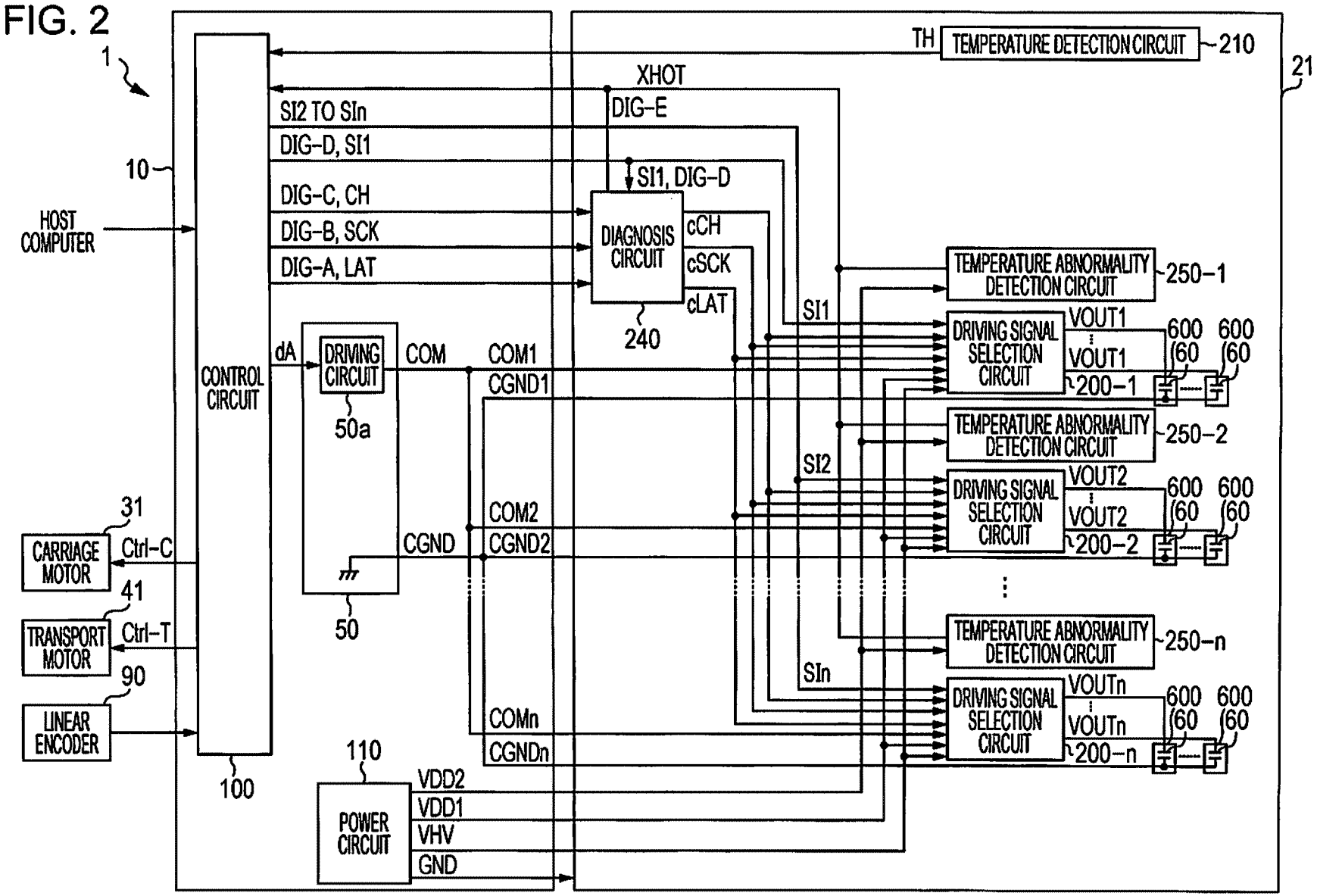
FIG. 2 is a block diagram illustrating an electrical configuration of the liquid discharge apparatus.

FIG. 2 is a block diagram illustrating an electrical configuration of the liquid discharge apparatus 1. The liquid discharge apparatus 1 includes the control mechanism 10, the print head 21, the carriage motor 31, the transport motor 41, and a linear encoder 90.

The control mechanism 10 includes a driving signal output circuit 50, a control circuit 100, and a power circuit 110. The control circuit 100 includes a processor such as a microcontroller, for example. The control circuit 100 generates and outputs data or various signals for controlling the liquid discharge apparatus 1, based on various signals such as image data, which are input from a host computer.

Specifically, the control circuit 100 recognizes a scanning position of the print head 21 based on a detection signal input from the linear encoder 90. The control circuit 100 generates and outputs various signals corresponding to the scanning position of the print head 21. Specifically, the control circuit 100 generates the control signal Ctrl-C for controlling reciprocation of the print head 21 and outputs the control signal Ctrl-C to the carriage motor 31. The control circuit 100 generates the control signal Ctrl-T for controlling transport of the medium P and outputs the control signal Ctrl-T to the transport motor 41. The control signal Ctrl-C may be signal-converted via a carriage motor driver (not illustrated) and then be input to the carriage motor 31. Similarly, the control signal Ctrl-T may be signal-converted via a transport motor driver (not illustrated) and then be input to the transport motor 41.

The control circuit 100 generates print data signals SI1 to SIn, a change signal CH, a latch signal LAT, and a clock signal SCK as the control signal Ctrl-H for controlling the print head 21, based on the various signals such as image data, which are input from the host computer and the scanning position of the print head 21. Then, the control circuit 100 outputs the generated signals to the print head 21.

The control circuit 100 generates diagnosis signals DIG-A to DIG-D used when the print head 21 diagnoses whether or not normal discharge of a liquid is possible. Then, the control circuit 100 outputs the generated signals to the print head 21. Here, although details will be described later, in the liquid discharge apparatus 1 in the first embodiment, each of the diagnosis signals DIG-A to DIG-D and each of the latch signal LAT, the clock signal SCK, the change signal CH, and the print data signal SI1 are propagated to the print head 21 by common wirings. Specifically, the diagnosis signal DIG-A and the latch signal LAT are propagated in a common wiring. The diagnosis signal DIG-B and the clock signal SCK are propagated in a common wiring. The diagnosis signal DIG-C and the change signal CH are propagated in a common wiring. The diagnosis signal DIG-D and the print data signal SI1 are propagated in a common wiring. Here, the control circuit 100 is an example of a diagnosis signal output circuit that generates the diagnosis signals DIG-A to DIG-D and outputs the signals DIG-A to DIG-D to the print head 21.

The control circuit 100 outputs a driving control signal dA as a digital signal to the driving signal output circuit 50.

The driving signal output circuit 50 includes a driving circuit 50*a*. The driving control signal dA is input to the driving circuit 50*a*. The driving circuit 50*a* generates the driving signal COM by performing D-class amplification on an analog signal obtained by performing digital-to-analog signal conversion on the driving control signal dA. That is, the driving control signal dA is a digital signal for defining a waveform of the driving signal COM. The driving circuit 50*a* generates the driving signal COM by performing D-class amplification on a waveform defined by the driving control signal dA. The driving signal output circuit 50 outputs the driving signal COM generated by the driving circuit 50*a*. Thus, the driving control signal dA may be a signal capable of defining the waveform of the driving signal COM. For example, the driving control signal dA may be an analog signal. The driving circuit 50*a* may be capable of amplifying the waveform defined by the driving control signal dA. For example, the driving circuit 50*a* may be configured by an A-class amplifier circuit, a B-class amplifier circuit, or an AB-class amplifier circuit.

The driving signal output circuit 50 outputs a reference voltage signal CGND indicating a reference potential of the driving signal COM. The reference voltage signal CGND may be, for example, a signal which has a voltage value of 0 V and has a ground potential. The reference voltage signal CGND may be a signal having a DC voltage having a voltage value of 6 V, for example.

The driving signal COM and the reference voltage signal CGND are divided in the control mechanism 10 and then are output to the print head 21. Specifically, the driving signal COM is divided into n pieces of driving signals COM1 to COMn respectively corresponding to n pieces of driving signal selection circuits 200 described later in the control mechanism 10. Then, the driving signals COM1 to COMn are output to the print head 21. Similarly, the reference voltage signal CGND is divided into n pieces of reference voltage signals CGND1 to CGNDn in the control mechanism 10, and then is output to the print head 21. The driving signal COM including the driving signals COM1 to COMn is an example of the driving signal.

The power circuit 110 generates and outputs voltages VHV, VDD1, and VDD2 and a ground signal GND. The voltage VHV is a signal having a DC voltage having a voltage value of 42 V, for example. The voltages VDD1 and VDD2 are signals having a DC voltage having a voltage value of 3.3 V, for example. The ground signal GND is a signal indicating the reference potential of the voltages VHV, VDD1, and VDD2. For example, the ground signal GND is a signal having a voltage value of 0 V and having a ground potential. The voltage VHV is used, for example, as a voltage for amplification in the driving signal output circuit 50. Each of the voltages VDD1 and VDD2 is used, for example, as a power source voltage or a control voltage of various components in the control mechanism 10. The voltages VHV, VDD1, and VDD2 and the ground signal GND are also output to the print head 21. The voltage values of the voltages VHV, VDD1, and VDD2 and the ground signal GND are not limited to 42 V, 3.3 V, and 0 V as described above. The power circuit 110 may generate signals having a plurality of voltage values in addition to the voltages VHV, VDD1, and VDD2 and the ground signal GND.

The print head 21 includes driving signal selection circuits 200-1 to 200-*n*, a temperature detection circuit 210, a diagnosis circuit 240, temperature abnormality detection circuits 250-1 to 250-*n*, and a plurality of discharge sections 600.

The diagnosis signal DIG-A and the latch signal LAT propagated in the common wiring, the diagnosis signal DIG-B and the clock signal SCK propagated in the common wiring, the diagnosis signal DIG-C and the change signal CH propagated in the common wiring, and the diagnosis signal DIG-D and the print data signal SI1 propagated in the common wiring are input to the diagnosis circuit 240. The diagnosis circuit 240 diagnoses whether or not normal discharge of the ink is possible, based on the diagnosis signals DIG-A to DIG-D.

For example, the diagnosis circuit 240 may detect whether or not the voltage value of the any or all of the input diagnosis signals DIG-A to DIG-D is normal. The diagnosis circuit 240 may diagnose whether or not the print head 21 and the control mechanism 10 are normally coupled to each other, based on the detection result. The diagnosis circuit 240 may operate any component, for example, the driving signal selection circuits 200-1 to 200-*n* and the piezoelectric element 60 in the print head 21, in accordance with a logical level of any signal or a combination of the logical levels of all the signals of the input diagnosis signals DIG-A to DIG-D. The diagnosis circuit 240 may detect whether or not the voltage value obtained by the operation is normal. Then, the diagnosis circuit 240 may diagnose whether or not a normal operation of the print head 21 is possible, based on the detection result. That is, the print head 21 performs self-diagnosis of diagnosing whether or not normal discharge of the ink is possible, based on the diagnosis result of the diagnosis circuit 240.

When the diagnosis circuit 240 diagnoses that normal discharge of the ink is possible in the print head 21, the diagnosis circuit 240 outputs the latch signal LAT, the clock signal SCK, and the change signal CH as a latch signal cLAT, a clock signal cSCK, and a change signal cCH. Here, the diagnosis signal DIG-D and the print data signal SI1 are branched in the print head 21. One branched signal is input to the diagnosis circuit 240, and the other is input to the driving signal selection circuit 200-1. The print data signal SI' is a signal having a high transfer rate. When the waveform of the print data signal SI1 is distorted, the print head 21 may erroneously operate. If the print data signal SI1 is branched in the print head 21, and then only one branched signal is input to the diagnosis circuit 240, it is possible to reduce a possibility of distorting the waveform of the print data signal SI1 input to the driving signal selection circuit 200-1.

The change signal cCH, the latch signal cLAT, and the clock signal cSCK output by the diagnosis circuit 240 may be signals having the same waveforms as the change signal CH, the latch signal LAT, and the clock signal SCK input to the diagnosis circuit 240. The change signal cCH, the latch signal cLAT, and the clock signal cSCK may be signals having waveforms obtained by correcting the change signal CH, the latch signal LAT, and the clock signal SCK. In the embodiment, descriptions will be made on the assumption that the change signal cCH, the latch signal cLAT, and the clock signal cSCK have the same waveforms as the change signal CH, the latch signal LAT, and the clock signal SCK.

The diagnosis circuit 240 generates a diagnosis signal DIG-E indicating a diagnosis result in the diagnosis circuit 240 and outputs the diagnosis signal DIG-E to the control circuit 100. Here, in the first embodiment, the diagnosis circuit 240 is configured, for example, by one or a plurality of integrated circuit (IC) apparatuses.

The voltages VHV and VDD1, the clock signal cSCK, the latch signal cLAT, and the change signal cCH are input to each of the driving signal selection circuits 200-1 to **200-*n*. The driving signals COM1 to COMn and the print data signals SI1 to SIn are input to the driving signal selection circuits 200-1 to 200-*n*, respectively. The voltages VHV and VDD1 are used as a power source voltage or a control voltage of each of the driving signal selection circuits 200-1 to 200-*n*. The driving signal selection circuits 200-1 to 200-*n* select or do not select the driving signals COM1 to COMn based on the print data signals SI1 to SIn, the clock signal cSCK, the latch signal cLAT, and the change signal cCH so as to generate driving signals VOUT1** to VOUTn, respectively.

Each of the driving signals VOUT1 to VOUTn respectively generated by the driving signal selection circuits 200-1 to **200-*n* is supplied to the piezoelectric element 60 which is provided in the corresponding discharge section 600 and is an example of a driving element. If each of the driving signals VOUT1 to VOUTn is supplied, the piezoelectric element 60 performs displacement. The ink of an amount depending on the displacement is discharged from the discharge section 600**.

Specifically, the driving signal COM1, the print data signal SI1, the latch signal cLAT, the change signal cCH, and the clock signal cSCK are input to the driving signal selection circuit 200-1. The driving signal selection circuit 200-1 selects or does not select the waveform of the driving signal COM1 based on the print data signal SI1, the latch signal cLAT, the change signal cCH, and the clock signal cSCK, so as to generate the driving signal VOUT1. The driving signal VOUT1 is supplied to one end of the piezoelectric element 60 in the discharge section 600 provided to correspond to the driving signal VOUT1. The reference voltage signal CGND1 is supplied to the other end of the piezoelectric element 60. The piezoelectric element 60 performs displacement by a potential difference between the driving signal VOUT1 and the reference voltage signal CGND1.

Similarly, the driving signal COMi, the print data signal SIi (i is any of 1 to n), the latch signal cLAT, the change signal cCH, and the clock signal cSCK are input to the driving signal selection circuit **200-*i*. The driving signal selection circuit 200-*i* selects or does not select the waveform of the driving signal COMi based on the print data signal SIi, the latch signal cLAT, the change signal cCH, and the clock signal cSCK, so as to generate the driving signal VOUTi. The driving signal VOUTi is supplied to one end of the piezoelectric element 60 in the discharge section 600 provided to correspond to the driving signal VOUTi. The reference voltage signal CGNDi is supplied to the other end of the piezoelectric element 60. The piezoelectric element 60** performs displacement by a potential difference between the driving signal VOUTi and the reference voltage signal CGNDi.

Here, the driving signal selection circuits 200-1 to **200-*n* have the similar circuit configuration. Therefore, when it is not necessary to distinguish the driving signal selection circuits 200-1 to 200-*n* from each other in the following descriptions, the driving signal selection circuits 200-1 to 200-*n* are referred to as a driving signal selection circuit 200. In this case, the driving signals COM1 to COMn input to the driving signal selection circuit 200 are referred to as a driving signal COM. The print data signals SU to SIn are referred to as a print data signal SI, and the driving signals VOUT1 to VOUTn output from the driving signal selection circuit 200 are referred to as a driving signal VOUT. Details of the operation of the driving signal selection circuit 200 will be described later. Here, each of the driving signal selection circuits 200-1 to 200-*i*** is configured by an integrated circuit apparatus, for example.

The temperature abnormality detection circuits 250-1 to **250-*n* are provided to correspond to the driving signal selection circuits 200-1 to 200-*n*, respectively. Each of the temperature abnormality detection circuits 250-1 to 250-*n* diagnoses whether or not temperature abnormality occurs in the corresponding circuit of the driving signal selection circuits 200-1 to 200-*n*. Specifically, the temperature abnormality detection circuits 250-1 to 250-*n* operate using the voltage VDD2 as the power source voltage. Each of the temperature abnormality detection circuits 250-1 to 250-*n* detects the temperature of the corresponding circuit of the driving signal selection circuits 200-1 to 200-*n*. When the temperature abnormality detection circuit diagnoses that the temperature is normal, the temperature abnormality detection circuit generates an abnormality signal XHOT having a high level (H level) and outputs the abnormality signal XHOT to the control circuit 100. When the temperature abnormality detection circuit diagnoses that the temperature of the corresponding circuit of the driving signal selection circuits 200-1 to 200-*n* is abnormal, each of the temperature abnormality detection circuits 250-1 to 250-*n* generates the abnormality signal XHOT having a low level (L level) and outputs the abnormality signal XHOT to the control circuit 100**.

Here, the temperature abnormality detection circuits 250-1 to **250-*n* have the similar circuit configuration. Therefore, when it is not necessary to distinguish the temperature abnormality detection circuits 250-1 to 250-*n* from each other in the following descriptions, the temperature abnormality detection circuits 250-1 to 250-*n* are referred to as a temperature abnormality detection circuit 250. Here, although details will be described later, the diagnosis signal DIG-E and the abnormality signal XHOT are propagated in a common wiring. Details of the temperature abnormality detection circuit 250 will be described later. Each of the temperature abnormality detection circuits 250-1 to 250-*i* is configured by an integrated circuit apparatus, for example. The temperature abnormality detection circuit 250-*i* and the driving signal selection circuit 200-*i*** may be configured by one integrated circuit apparatus.

The temperature detection circuit 210 includes a temperature detection element such as a thermistor. The temperature detection circuit 210 generates a temperature signal TH which is an analog signal and includes temperature information of the print head 21, based on a detection signal obtained by detection of the temperature detection element. The temperature detection circuit outputs the temperature signal TH to the control circuit 100.

1.3. Example of Waveform of Driving Signal

Here, an example of the waveform of the driving signal COM generated by the driving signal output circuit 50 and an example of the waveform of the driving signal VOUT supplied to the piezoelectric element 60 will be described with reference to FIGS. 3 and 4.

Figure 3:
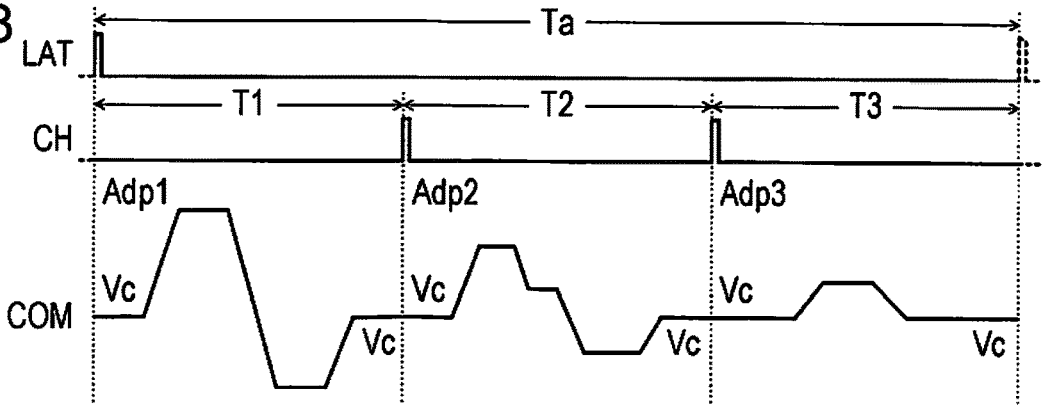
FIG. 3 is a diagram illustrating an example of a waveform of a driving signal COM.

FIG. 3 is a diagram illustrating an example of the waveform of the driving signal COM. As illustrated in FIG. 3, the driving signal COM is a waveform in which a trapezoid waveform Adp1, a trapezoid waveform Adp2, and a trapezoid waveform Adp3. The trapezoid waveform Adp1 is disposed in a period T1 from when the latch signal LAT rises until the change signal CH rises. The trapezoid waveform Adp2 is disposed in a period T2 until the change signal CH rises the next time after the period T1. The trapezoid waveform Adp3 is disposed in a period T3 until the latch signal LAT rises the next time after the period T2. When the trapezoid waveform Adp1 is supplied to the one end of the piezoelectric element 60, the medium amount of the ink is discharged from the discharge section 600 corresponding to this piezoelectric element 60. When the trapezoid waveform Adp2 is supplied to the one end of the piezoelectric element 60, the ink having an amount smaller than the medium amount is discharged from the discharge section 600 corresponding to this piezoelectric element 60. When the trapezoid waveform Adp3 is supplied to the one end of the piezoelectric element 60, the ink is not discharged from the discharge section 600 corresponding to this piezoelectric element 60. The trapezoid waveform Adp3 is a waveform for finely vibrating the ink in the vicinity of a nozzle opening portion of the discharge section 600 to prevent an increase of ink viscosity.

Here, a period Ta (illustrated in FIG. 3) from the latch signal LAT rises until the latch signal LAT rises the next time corresponds to a printing period in which a new dot is formed on the medium P. That is, the latch signal LAT and the latch signal cLAT are signals for defining a discharge timing of the ink from the print head 21. The change signal CH and the change signal cCH are signals for defining a waveform switching timing between the trapezoid waveforms Adp1, Adp2, and Adp3 in the driving signal COM.

All voltages at a start timing and an end timing of each of the trapezoid waveforms Adp1, Adp2, and Adp3 are common and a voltage Vc. That is, each of the trapezoid waveforms Adp1, Adp2, and Adp3 is a waveform which starts at the voltage Vc and ends at the voltage Vc. The driving signal COM may be a signal having a waveform in which one or two trapezoid waveforms are continuous in the period Ta, or may be a signal having a waveform in which four trapezoid waveforms or more are continuous in the period Ta.

Figure 4:
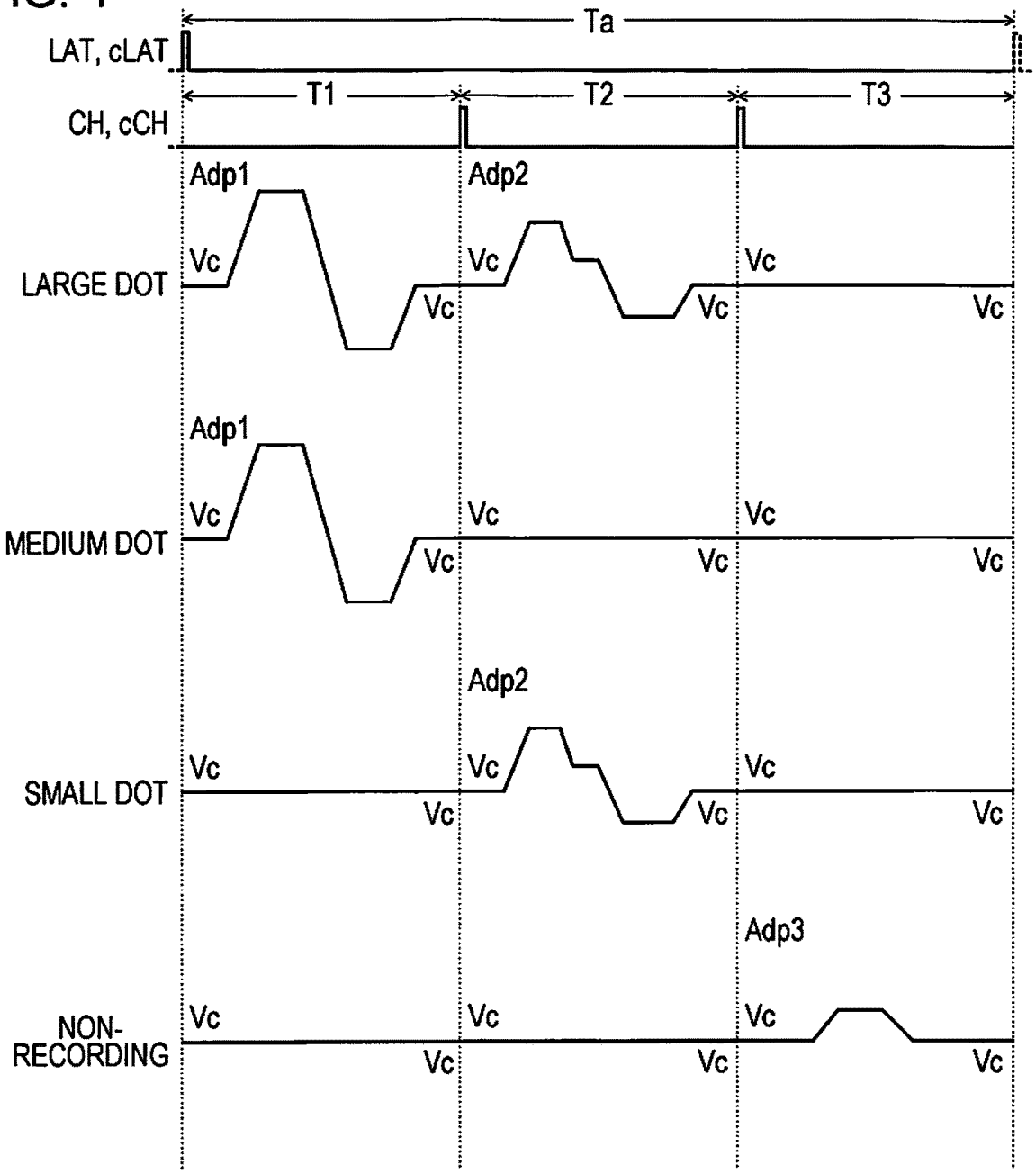
FIG. 4 is a diagram illustrating an example of a waveform of a driving signal VOUT.

FIG. 4 is a diagram illustrating an example of the waveform of the driving signal VOUT corresponding to each of "a large dot", "a medium dot", "a small dot", and "non-recording".

As illustrated in FIG. 4, the driving signal VOUT corresponding to "the large dot" has a waveform in which the trapezoid waveform Adp1 disposed in the period T1, the trapezoid waveform Adp2 disposed in the period T2, and a waveform which is disposed in the period T3 and is constant at the voltage Vc are continuous in the period Ta. When the driving signal VOUT is supplied to the one end of the piezoelectric element 60, the medium amount of the ink and the small amount of the ink are discharged from the discharge section 600 corresponding to this piezoelectric element 60, in the period Ta. Thus, the inks are landed on the medium P and are coalesced, and thereby a large dot is formed on the medium P.

The driving signal VOUT corresponding to "the medium dot" has a waveform in which the trapezoid waveform Adp1 disposed in the period T1 and a waveform which is disposed in the periods T2 and T3 and is constant at the voltage Vc are continuous in the period Ta. When the driving signal VOUT is supplied to the one end of the piezoelectric element 60, the medium amount of the ink is discharged from the discharge section 600 corresponding to this piezoelectric element 60, in the period Ta. Thus, the ink is landed on the medium P, and thereby a medium dot is formed on the medium P.

The driving signal VOUT corresponding to "the small dot" has a waveform in which a waveform which is disposed in the periods T1 and T3 and is constant at the voltage Vc and the trapezoid waveform Adp2 disposed in the period T2 are continuous in the period Ta. When the driving signal VOUT is supplied to the one end of the piezoelectric element 60, the small amount of the ink is discharged from the discharge section 600 corresponding to this piezoelectric element 60, in the period Ta. Thus, the ink is landed on the medium P, and thereby a small dot is formed on the medium P.

The driving signal VOUT corresponding to "non-recording" has a waveform in which a waveform which is disposed in the periods T1 and T2 and is constant at the voltage Vc and the trapezoid waveform Adp3 disposed in the period T3 are continuous in the period Ta. When the driving signal VOUT is supplied to the one end of the piezoelectric element 60, in the period Ta, only the ink in the vicinity of the nozzle opening portion of the discharge section 600 corresponding to this piezoelectric element 60 finely vibrates, and the ink is not discharged. Thus, the ink is not landed on the medium P and a dot is not formed on the medium P.

Here, the waveform constant at the voltage Vc means a waveform in which the previous voltage Vc is configured by a voltage held by a capacitive component of the piezoelectric element 60 when any of the trapezoid waveforms Adp1, Adp2, and Adp3 is not selected as the driving signal VOUT. Therefore, when any of the trapezoid waveforms Adp1, Adp2, and Adp3 is not selected as the driving signal VOUT, the voltage Vc is supplied to the piezoelectric element 60 as the driving signal VOUT.

The driving signal COM and the driving signal VOUT illustrated in FIGS. 3 and 4 are just examples. Signals having various combinations of waveforms may be used in accordance with a moving speed of the carriage 20 in which the print head 21 is mounted, the physical properties of the ink to be supplied to the print head 21, the material of the medium P, and the like.

1.4. Configuration of Driving Signal Selection Circuit

Figure 5:
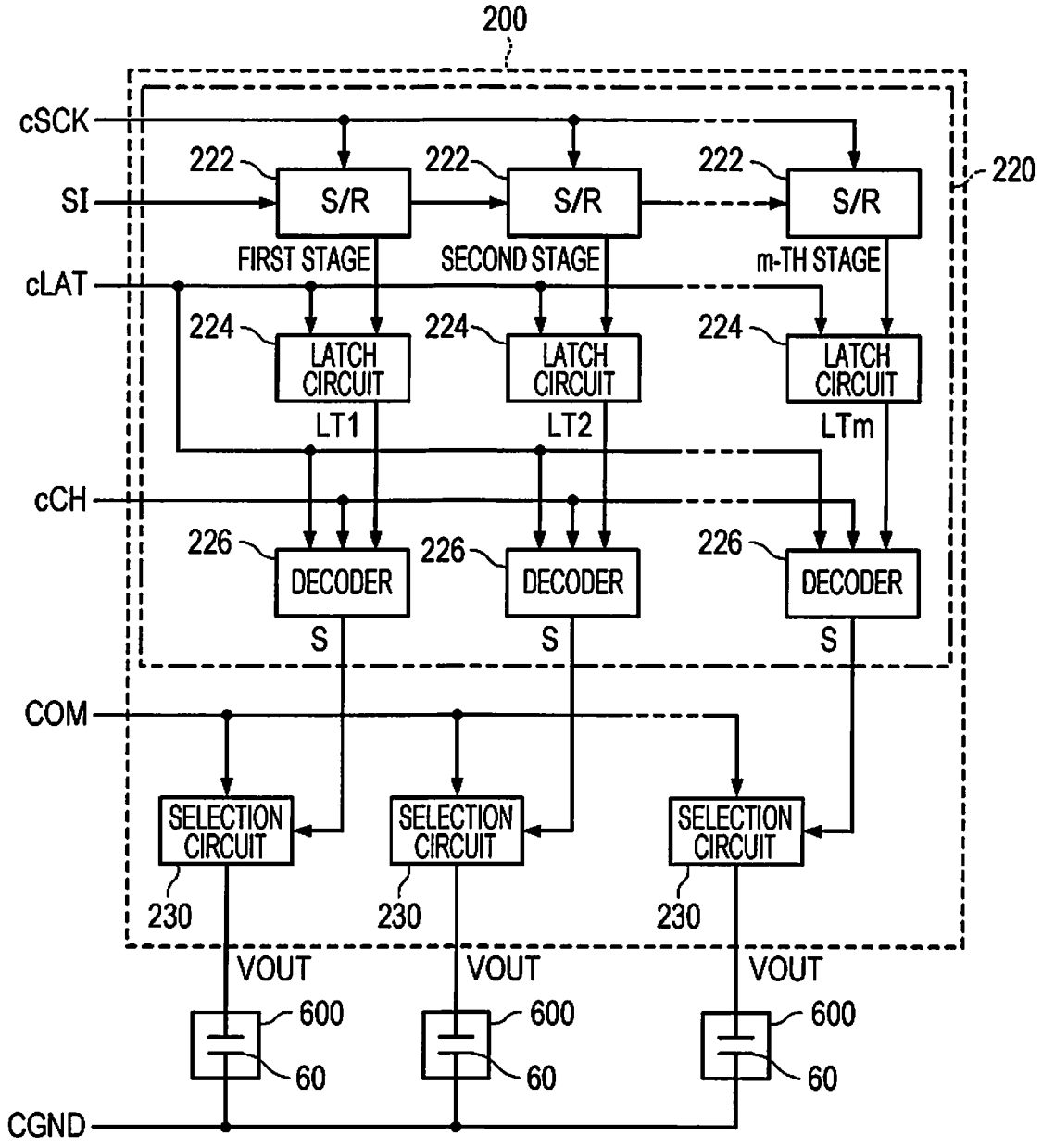
FIG. 5 is a diagram illustrating a configuration of a driving signal selection circuit.

Next, a configuration and an operation of the driving signal selection circuit 200 will be described. FIG. 5 is a diagram illustrating a configuration of the driving signal selection circuit 200. As illustrated in FIG. 5, the driving signal selection circuit 200 includes a selection control circuit 220 and a plurality of selection circuits 230.

The print data signal SI, the latch signal cLAT, the change signal cCH, and the clock signal cSCK are input to the selection control circuit 220. A set of a shift register (S/R) 222, a latch circuit 224, and a decoder 226 is provided in the selection control circuit 220 to correspond to each of the plurality of discharge sections 600. That is, the driving signal selection circuit 200 includes sets of shift registers 222, latch circuits 224, and decoders 226. The number of sets is equal to the total number m of discharge sections 600. Here, the print data signal SI is a signal for defining selection of a waveform of the driving signal COM. The clock signal SCK and the clock signal cSCK are clock signals for defining a timing at which the print data signal SI is input.

Specifically, the print data signal SI is a signal synchronized with the clock signal cSCK. The print data signal SI is a signal which has 2 m bits in total and includes 2-bit print data [SIH, SIL] for selecting any of "the large dot", "the medium dot", "the small dot", and "non-recording" for each of m pieces of discharge sections 600. Regarding the print data signal SI, each 2-bit print data [SIH, SIL] which corresponds to the discharge section 600 and is included in the print data signal SI is held in the shift register 222. Specifically, the shift registers 222 from the first stage to the m-th stage, which correspond to the discharge sections 600 are cascade-coupled to each other, and the print data signal SI input in a serial manner is sequentially transferred to the subsequent stage in accordance with the clock signal cSCK. In FIG. 5, in order to distinguish the shift registers 222 from each other, the shift registers 222 are described as being the first stage, the second stage, . . . , and the m-th stage in order from the upstream on which the print data signal SI is input.

Each of the m pieces of latch circuits 224 latches the 2-bit print data [SIH, SIL] held in each of the m pieces of shift registers 222, at a rising edge of the latch signal cLAT.

Each of the m pieces of decoders 226 decodes the 2-bit print data [SIH, SIL] latched by each of the m pieces of latch circuits 224. The decoder 226 outputs a selection signal S for each of the periods T1, T2, T3 defined by the latch signal cLAT and the change signal cCH.

Figures 6, 7:
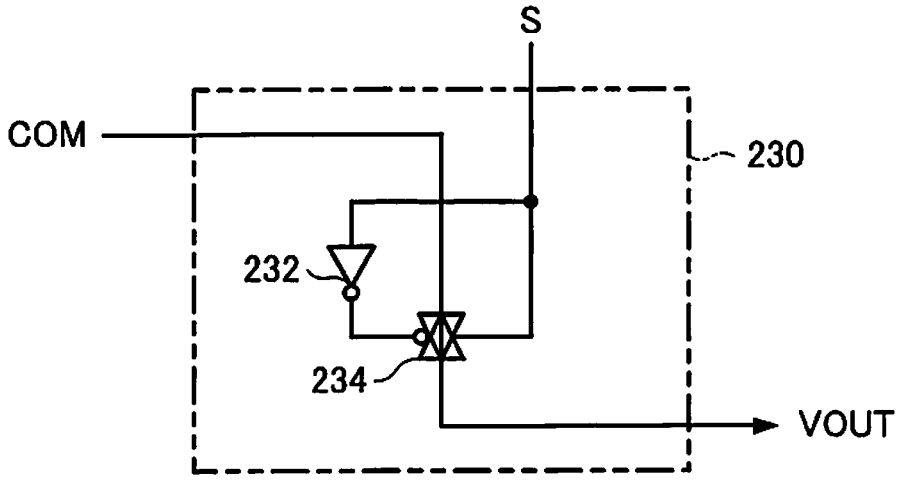
FIG. 6 is a diagram illustrating decoding contents in a decoder.
FIG. 7 is a diagram illustrating a configuration of a selection circuit corresponding to one discharge section.

FIG. 6 is a diagram illustrating decoding contents in the decoder 226. The decoder 226 outputs the selection signal S in accordance with the latched 2-bit print data [SIH, SIL]. For example, when the 2-bit print data [SIH, SIL] is [1, 1], the decoder 226 outputs the selection signal S having a logical level which is respectively set to an H level, an H level, and an L level in the periods T1, T2, and T3.

The selection circuits 230 are provided to correspond to the discharge sections 600, respectively. That is, the number of selection circuits 230 of the driving signal selection circuit 200 is equal to the total number m of the discharge sections 600. FIG. 7 is a diagram illustrating a configuration of the selection circuit 230 corresponding to one discharge section 600. As illustrated in FIG. 7, the selection circuit 230 includes an inverter 232 being a NOT circuit, and a transfer gate 234.

The selection signal S is logically inverted by the inverter 232 and is input to a negative control end of the transfer gate 234, which is marked with a circle, while the selection signal S is input to a positive control end of the transfer gate 234, which is not marked with a circle. The driving signal COM is supplied to an input end of the transfer gate 234. Specifically, the transfer gate 234 electrically connects (turns on between) the input end and an output end when the selection signal S has an H level, and does not electrically connect (turns off between) the input end and the output end when the selection signal S has an L level. In this manner, the driving signal VOUT is output from the output end of the transfer gate 234.

Figure 8:
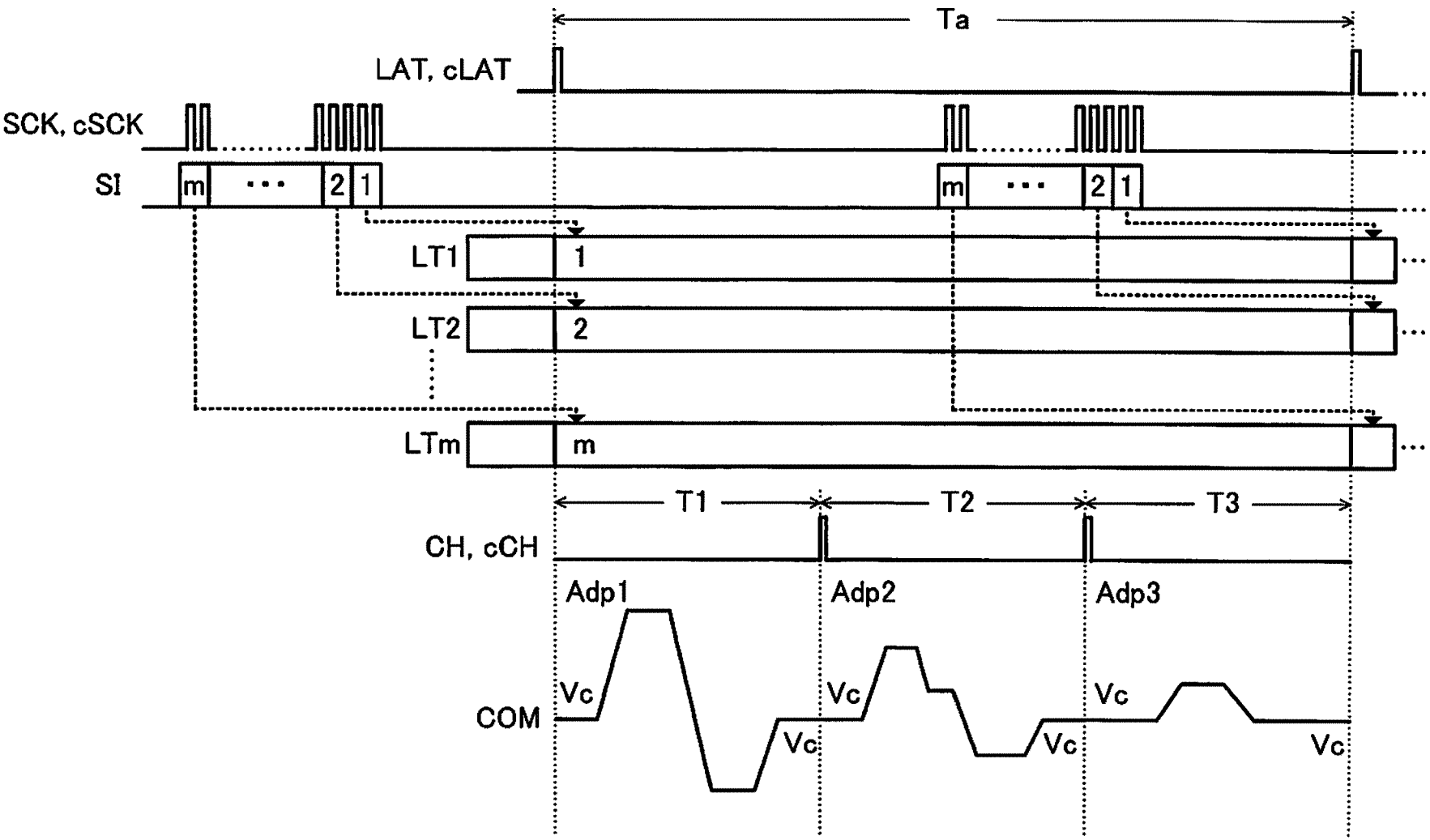
FIG. 8 is a diagram illustrating an operation of the driving signal selection circuit.

Here, the operation of the driving signal selection circuit 200 will be described with reference to FIG. 8. FIG. 8 is a diagram illustrating the operation of the driving signal selection circuit 200. The print data signal SI is serially input in synchronization with the clock signal cSCK and is sequentially transferred into the shift registers 222 corresponding to the discharge sections 600. If the input of the clock signal cSCK stops, the 2-bit print data [SIH, SIL] corresponding to each of the discharge sections 600 is held in each of the shift registers 222. The print data signal SI is input in order of the discharge sections 600 corresponding to the m-th stage, . . . , the second stage, and the first stage of shift registers 222.

If the latch signal cLAT rises, the latch circuits 224 simultaneously latch the 2-bit print data [SIH, SIL] held by the shift registers 222. In FIG. 8, LT1, LT2, . . . , and LTm indicate the 2-bit print data [SIH, SIL] latched by the latch circuits 224 respectively corresponding to the first stage, the second stage, . . . , and the m-th stage of shift registers 222.

The decoder 226 outputs the logical level of the selection signal S in each of the periods T1, T2, and T3, based on the contents in FIG. 6, in accordance with the size of a dot defined by the latched 2-bit print data [SIH, SIL].

Specifically, when the print data [SIH, SIL] is [1, 1], the decoder 226 sets the selection signal S to have an H level, an H level, and an L level in the periods T1, T2, and T3. In this case, the selection circuit 230 selects the trapezoid waveform Adp1 in the period T1, selects the trapezoid waveform Adp2 in the period T2, and does not select the trapezoid waveform Adp3 in the period T3. As a result, the driving signal VOUT corresponding to "the large dot" illustrated in FIG. 4 is generated.

When the print data [SIH, SIL] is [1, 0], the decoder 226 sets the selection signal S to have an H level, an L level, and an L level in the periods T1, T2, and T3. In this case, the selection circuit 230 selects the trapezoid waveform Adp1 in the period T1, does not select the trapezoid waveform Adp2 in the period T2, and does not select the trapezoid waveform Adp3 in the period T3. As a result, the driving signal VOUT corresponding to "the medium dot" illustrated in FIG. 4 is generated.

When the print data [SIH, SIL] is [0, 1], the decoder 226 sets the selection signal S to have an L level, an H level, and an L level in the periods T1, T2, and T3. In this case, the selection circuit 230 does not select the trapezoid waveform Adp1 in the period T1, selects the trapezoid waveform Adp2 in the period T2, and does not select the trapezoid waveform Adp3 in the period T3. As a result, the driving signal VOUT corresponding to "the small dot" illustrated in FIG. 4 is generated.

When the print data [SIH, SIL] is [0, 0], the decoder 226 sets the selection signal S to have an L level, an L level, and an H level in the periods T1, T2, and T3. In this case, the selection circuit 230 does not select the trapezoid waveform Adp1 in the period T1, does not select the trapezoid waveform Adp2 in the period T2, and selects the trapezoid waveform Adp3 in the period T3. As a result, the driving signal VOUT corresponding to "non-recording" illustrated in FIG. 4 is generated.

As described above, the driving signal selection circuit 200 selects the waveform of the driving signal COM based on the print data signal SI, the latch signal cLAT, the change signal cCH, and the clock signal cSCK, and outputs the driving signal VOUT. In other words, the driving signal selection circuit 200 controls a supply of the driving signal COM to the piezoelectric element 60.

1.5. Configuration of Temperature Abnormality Detection Circuit

Figure 9:
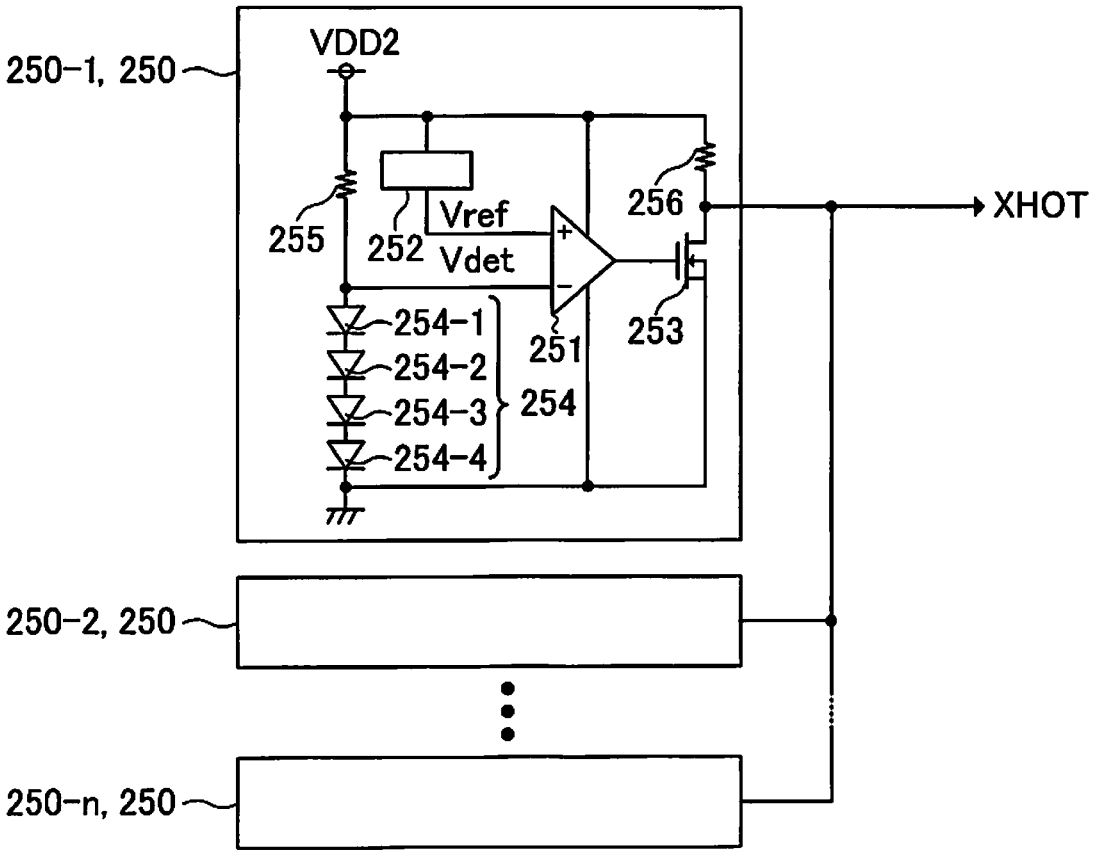
FIG. 9 is a diagram illustrating a configuration of a temperature abnormality detection circuit.

Next, the temperature abnormality detection circuit 250 will be described with reference to FIG. 9. FIG. 9 is a diagram illustrating a configuration of the temperature abnormality detection circuit 250. As illustrated in FIG. 9, the temperature abnormality detection circuit 250 includes a comparator 251, a reference voltage generation circuit 252, a transistor 253, a plurality of diodes 254, and resistors 255 and 256. As described above, all the temperature abnormality detection circuits 250-1 to 250-*n* have the same configuration. Therefore, in FIG. 9, detailed illustrations of the configuration of the temperature abnormality detection circuit 250-2 to 250-*n* are omitted.

The voltage VDD2 is input to the reference voltage generation circuit 252. The reference voltage generation circuit 252 generates a voltage Vref by transforming the voltage VDD2 and supplies the voltage Vref to a positive-side input terminal of the comparator 251. The reference voltage generation circuit 252 is configured by a voltage regulator circuit, for example.

The plurality of diodes 254 is coupled in series. Among the plurality of diodes 254 coupled in series, the voltage VDD2 is supplied to an anode terminal of the diode 254 located on the highest potential side via the resistor 255, and the ground signal GND is supplied to a cathode terminal of the diode 254 located on the lowest potential side. Specifically, the temperature abnormality detection circuit 250 has diodes 254-1, 254-2, 254-3, and 254-4 as the plurality of diodes 254. The voltage VDD2 is supplied to the anode terminal of the diode 254-1 via the resistor 255, and the anode terminal of the diode 254-1 is coupled to a negative-side input terminal of the comparator 251. A cathode terminal of the diode 254-1 is coupled to an anode terminal of the diode 254-2. A cathode terminal of the diode 254-2 is coupled to an anode terminal of the diode 254-3. A cathode terminal of the diode 254-3 is coupled to an anode terminal of the diode 254-4. The ground signal GND is supplied to the cathode terminal of the diode 254-4. With the resistor 255 and the plurality of diodes 254 configured in a manner as described above, a voltage Vdet is supplied to a negative-side input terminal of the comparator 251. The voltage Vdet is the sum of forward voltages of the plurality of diodes 254. The number of the plurality of diodes 254 in the temperature abnormality detection circuit 250 is not limited to four.

The comparator 251 operates by a potential difference between the voltage VDD2 and the ground signal GND. The comparator 251 compares the voltage Vref supplied to the positive-side input terminal and the voltage Vdet supplied to the negative-side input terminal to each other, and outputs a signal based on the comparison result from an output terminal.

The voltage VDD2 is supplied to the drain terminal of the transistor 253 via the resistor 256. The gate terminal of the transistor 253 is coupled to the output terminal of the comparator 251. The ground signal GND is supplied to the source terminal of the transistor 253. The voltage supplied to the drain terminal of the transistor 253 coupled in a manner as described above is output from the temperature abnormality detection circuit 250 as the abnormality signal XHOT.

The voltage value of the voltage Vref generated by the reference voltage generation circuit 252 is less than the voltage Vdet when the temperature of the plurality of diodes 254 is within a predetermined range. In this case, the comparator 251 outputs a signal having an L level. Thus, the transistor 253 is controlled to turn off. As a result, the temperature abnormality detection circuit 250 outputs the abnormality signal XHOT having an H level.

The forward voltage of the diode 254 has characteristics in which the forward voltage decreases as the temperatures increases. Thus, when temperature abnormality occurs in the print head 21, the temperature of the diode 254 increases, and thereby the voltage Vdet decreases. When the voltage Vdet becomes less than the voltage Vref by the temperature increase, the output signal of the comparator 251 changes from an L level to an H level. Accordingly, the transistor 253 is controlled to turn on. As a result, the temperature abnormality detection circuit 250 outputs the abnormality signal XHOT having an L level. That is, if the transistor 253 is controlled to turn on or off based on the temperature of the driving signal selection circuit 200, the temperature abnormality detection circuit 250 outputs the voltage VDD2 supplied as the pull-up voltage of the transistor 253, as the abnormality signal XHOT having an H level and outputs the ground signal GND as the abnormality signal XHOT having an L level.

As illustrated in FIG. 9, outputs of the n pieces of temperature abnormality detection circuits 250-1 to 250-*n* are commonly coupled. Thus, when temperature abnormality occurs in any of the temperature abnormality detection circuits 250-1 to 250-*n*, the transistor 253 corresponding to the temperature abnormality detection circuit 250 in which the temperature abnormality occurs is controlled to turn on. As a result, the ground signal GND is supplied to a node to which the abnormality signal XHOT is output, via the transistor 253. Thus, the abnormality signals XHOT output by the temperature abnormality detection circuits 250-1 to 250-*n* are controlled to have an L level. That is, the temperature abnormality detection circuits 250-1 to 250-*n* are coupled in a wired-OR manner. Thus, even when the plurality of temperature abnormality detection circuits 250 is provided in the print head 21, it is possible to propagate the abnormality signal XHOT indicating whether or not temperature abnormality occurs in the print head 21, without increasing the number of wirings for propagating the abnormality signal XHOT.

1.6. Configurations of Print Head and Print Head Control Circuit

Next, details of an electrical coupling between the control mechanism 10 and the print head 21 will be described. In the following descriptions, descriptions will be made on the assumption that the print head 21 in the first embodiment includes four driving signal selection circuits 200-1 to 200-4. That is, four print data signals SI1 to SI4, four driving signals COM1 to COM4, and four reference voltage signals CGND1 to CGND4, which respectively correspond to the four driving signal selection circuits 200-1 to 200-4 are input to the print head 21 in the first embodiment.

Figure 10:
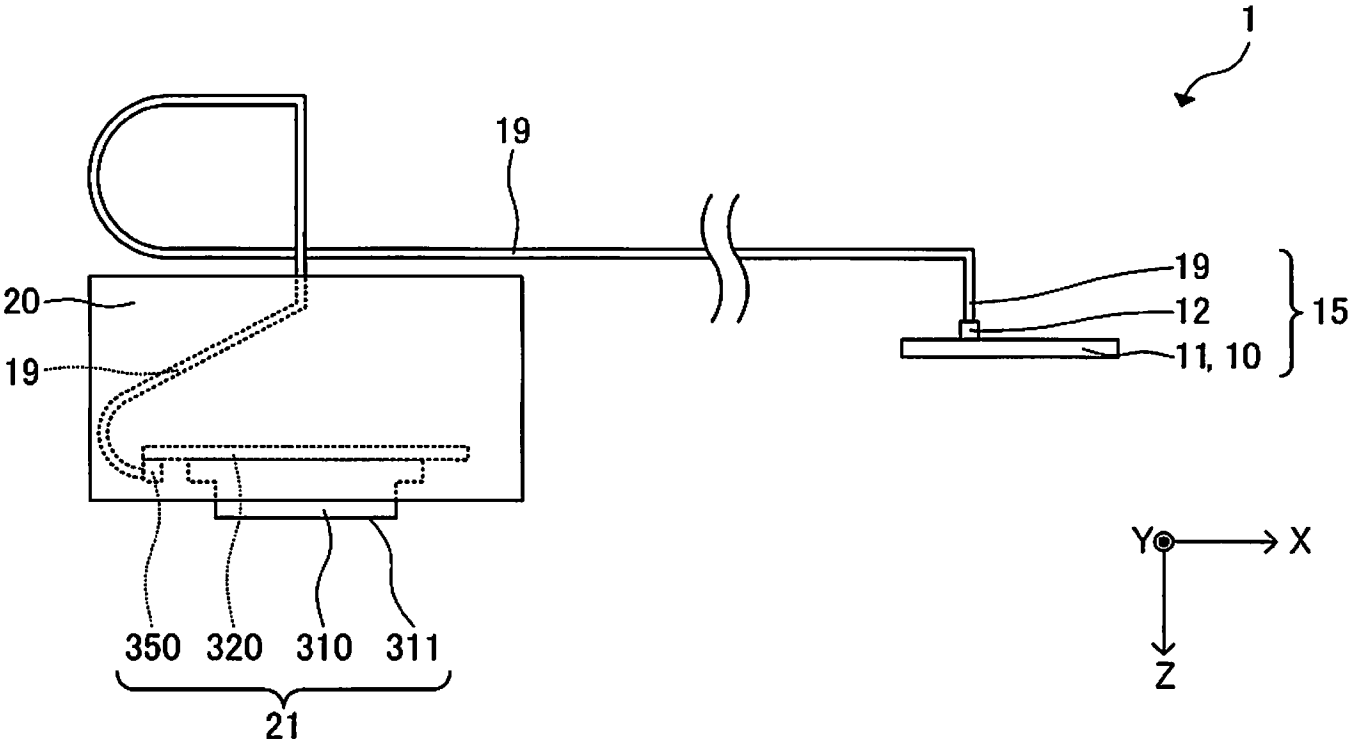
FIG. 10 is a schematic diagram illustrating an internal configuration of the liquid discharge apparatus when viewed from a Y-direction.

FIG. 10 is a schematic diagram illustrating an internal configuration of the liquid discharge apparatus 1 when viewed from the Y-direction. As illustrated in FIG. 10, the liquid discharge apparatus 1 includes a main substrate 11, a cable 19, and the print head 21.

Various circuits including the driving signal output circuit 50, the control circuit 100, and the power circuit 110 provided in the control mechanism 10 illustrated in FIGS. 1 and 2 are mounted on the main substrate 11. A connector 12 to which one end of the cable 19 is attached is mounted on the main substrate 11. FIG. 10 illustrates one circuit substrate as the main substrate 11. However, the main substrate 11 may be configured by two circuit substrates or more.

The print head 21 includes a head 310, a substrate 320, and a connector 350. The other end of the cable 19 is attached to the connector 350. Thus, various signals generated by the control mechanism 10 are input to the print head 21 via the cable 19. Details of the configuration of the print head 21 and details of the signal propagated in the cable 19 will be described later.

The liquid discharge apparatus 1 configured in a manner as described above controls the operation of the print head 21 based on various signals including the driving signals COM1 to COM4, the reference voltage signals CGND1 to CGND4, the print data signals SI1 to SI4, the latch signal LAT, the change signal CH, the clock signal SCK, and the diagnosis signals DIG-A to DIG-D, which are output from the control mechanism 10 mounted on the main substrate 11. That is, in the liquid discharge apparatus 1 illustrated in FIG. 10, a configuration including the control mechanism 10 that outputs various signals for controlling the operation of the print head 21 and the cable 19 for propagating the various signals for controlling the operation of the print head 21 is an example of the print head control circuit 15 that controls the operation of the print head 21 having a function of performing self-diagnosis.

Figure 11:
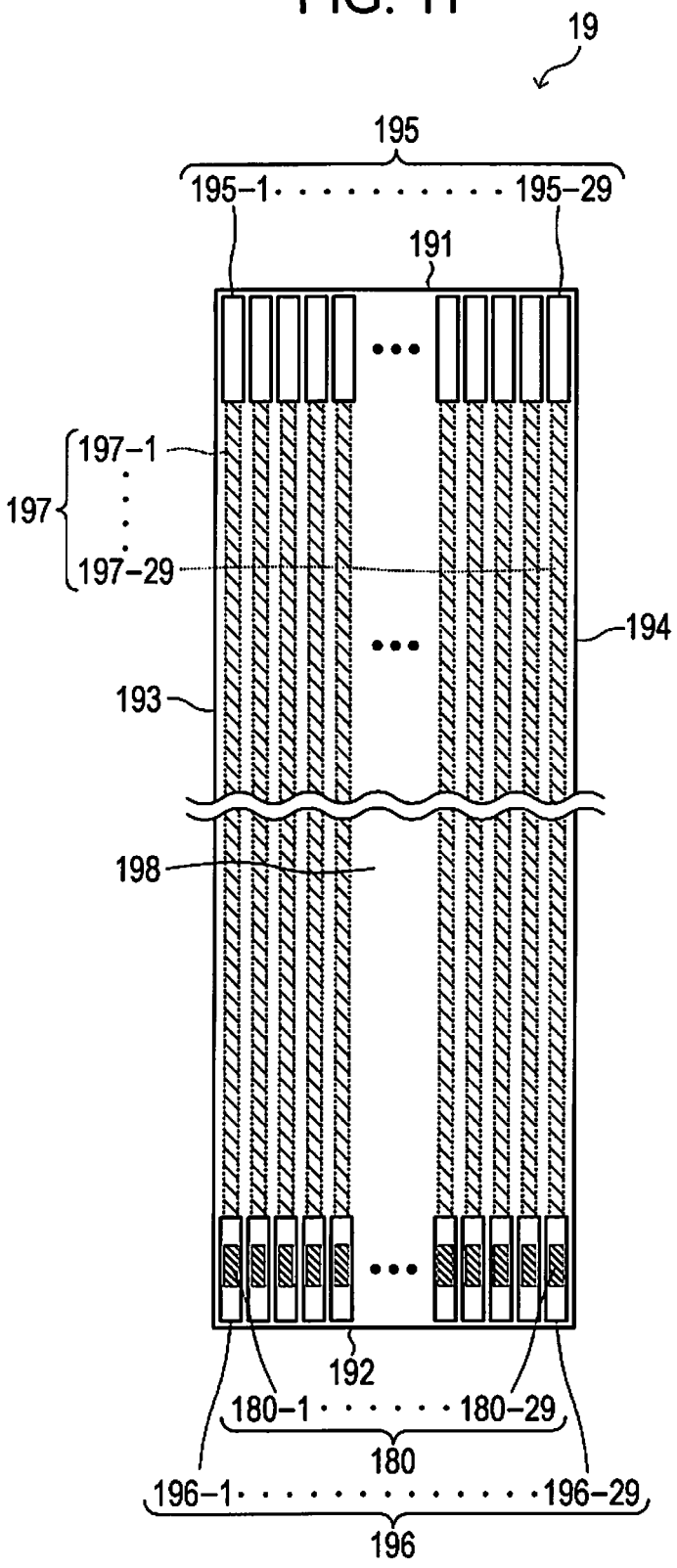
FIG. 11 is a diagram illustrating a configuration of a cable.

FIG. 11 is a diagram illustrating a configuration of the cable 19. The cable 19 has a substantially rectangular shape having short sides 191 and 192 facing each other and long sides 193 and 194 facing each other. For example, the cable 19 is a flexible flat cable (FFC). The cable 19 includes a plurality of terminals 195 aligned in parallel along the short side 191, a plurality of terminals 196 aligned in parallel along the short side 192, and a plurality of wirings 197 that electrically couples the plurality of terminals 195 and the plurality of terminals 196 to each other.

Specifically, 29 terminals 195 are aligned in parallel from the long side 193 toward the long side 194, on the short side 191 side of the cable 19 in order of the terminals 195-1 to 195-29. 29 terminals 196 are aligned in parallel from the long side 193 toward the long side 194, on the short side 192 side of the cable 19 in order of the terminals 196-1 to 196-29. In the cable 19, 29 wirings 197 that electrically couple the terminals 195 and the terminals 196 to each other are aligned in parallel from the long side 193 toward the long side 194 in order of the wirings 197-1 to 197-29. The wiring 197-1 electrically couples the terminal 195-1 and the terminal 196-1 to each other. Similarly, the wiring **197-*k* (k is any of 1 to 29) electrically couples the terminal 195-*k* and the terminal 196-*k*** to each other.

The wirings 197-1 to 197-29 are insulated between the wirings and between the wiring and the outside of the cable 19, by an insulator 198. The cable 19 causes a signal input from the terminal **195-*k* to propagate in the wiring 197-*k* and to be output from the terminal 196-*k*. The configuration of the cable 19 illustrated in FIG. 11 is an example, and the embodiment is not limited thereto. For example, the plurality of terminals 195 and the plurality of terminals 196 may be provided on the different surfaces of the cable 19. The number of terminals 195, the number of terminals 196, and the number of wirings 197, which are provided in the cable 19**, are not limited to 29.

Figure 12:
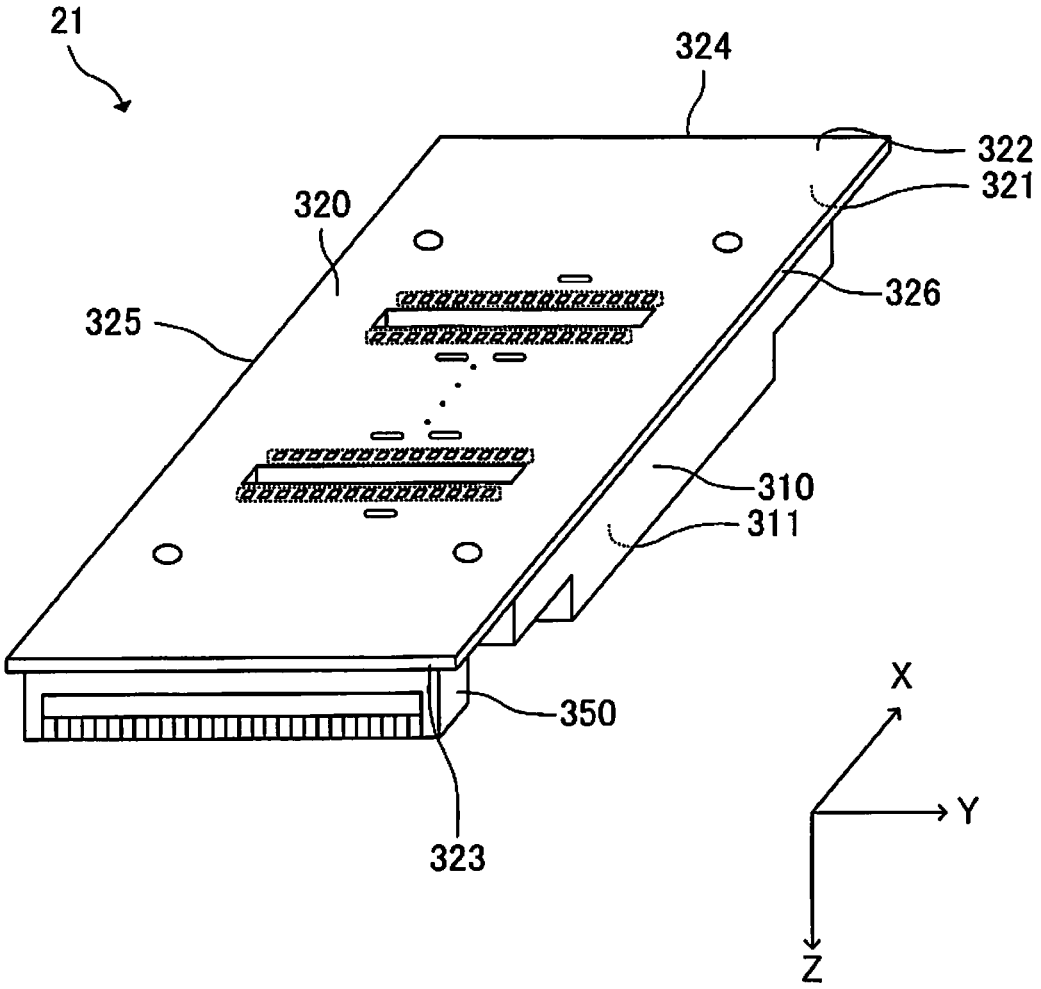
FIG. 12 is a perspective view illustrating a configuration of a print head.

Next, the configuration of the print head 21 will be described. FIG. 12 is a perspective view illustrating the configuration of the print head 21. As illustrated in FIG. 12, the print head 21 includes the head 310 and the substrate 320. An ink discharge surface 311 on which the plurality of discharge sections 600 are formed is located on a lower surface of the head 310 in the Z-direction.

Figure 13:
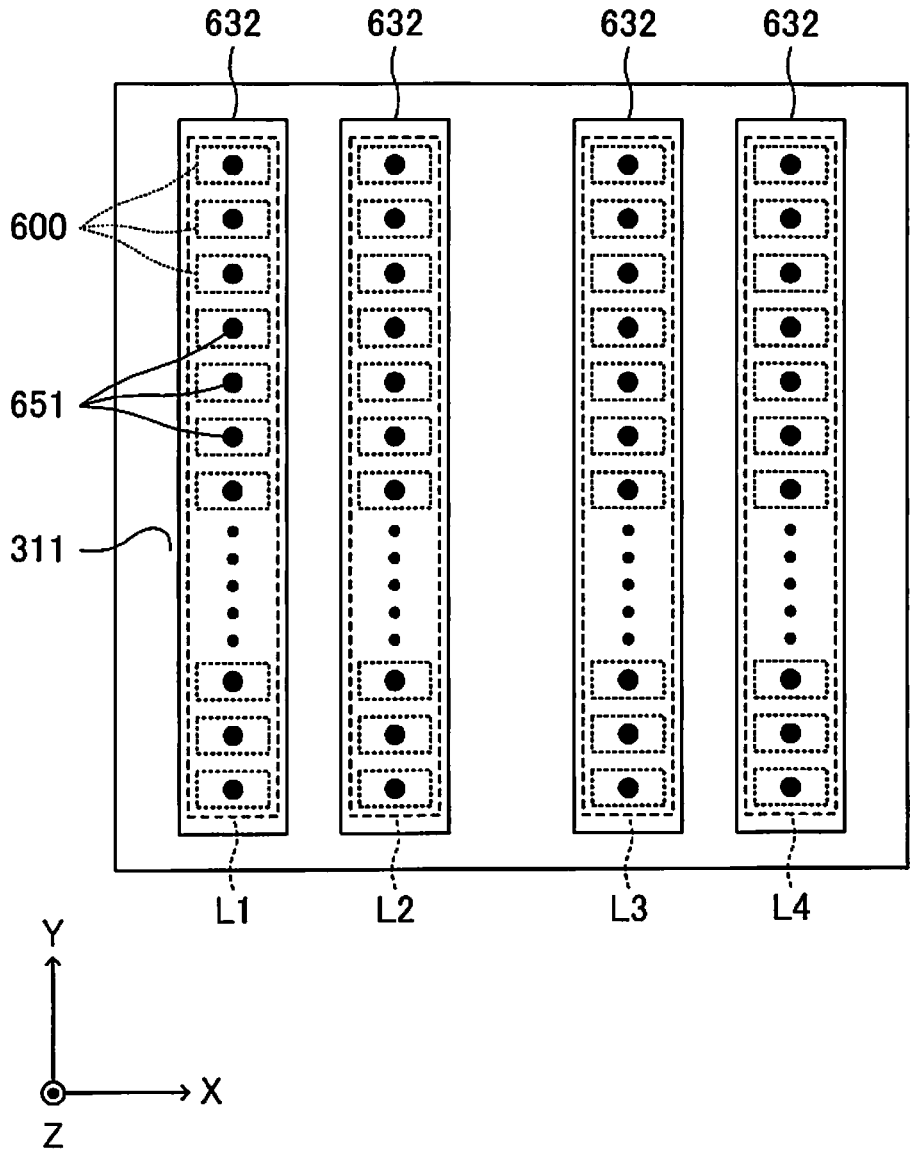
FIG. 13 is a plan view illustrating a configuration of an ink discharge surface.

FIG. 13 is a plan view illustrating a configuration of the ink discharge surface 311. As illustrated in FIG. 13, four nozzle plates 632 are provided on the ink discharge surface 311 to be aligned in the X-direction. The nozzle plate 632 has nozzles 651 provided in the plurality of discharge sections 600. In each of the nozzle plates 632, the nozzles 651 are provided to be aligned in the Y-direction. That is, four nozzle columns L1 to L4 are formed in the ink discharge surface 311. In FIG. 13, the nozzles 651 are provided to be aligned in one line in the Y-direction, in each of the nozzle columns L1 to L4 which are respectively formed in the nozzle plates 632. However, the nozzles 651 may be provided to be aligned in two or more lines in the Y-direction.

The nozzle columns L1 to L4 are provided to correspond to the driving signal selection circuits 200-1 to 200-4, respectively. Specifically, the driving signal VOUT1 output by the driving signal selection circuit 200-1 is supplied to the one end of the piezoelectric element 60 in a plurality of discharge sections 600 provided in the nozzle column L1. The reference voltage signal CGND1 is supplied to the other end of this piezoelectric element 60. Similarly, the driving signals VOUT2 to VOUT4 output by the driving signal selection circuits 200-2 to 200-4 are respectively supplied to one ends of the piezoelectric elements 60 in a plurality of discharge sections 600 provided in the nozzle columns L2 to L4. The reference voltage signals CGND2 to CGND4 are supplied to the other ends of the corresponding piezoelectric elements 60, respectively.

Figure 14:
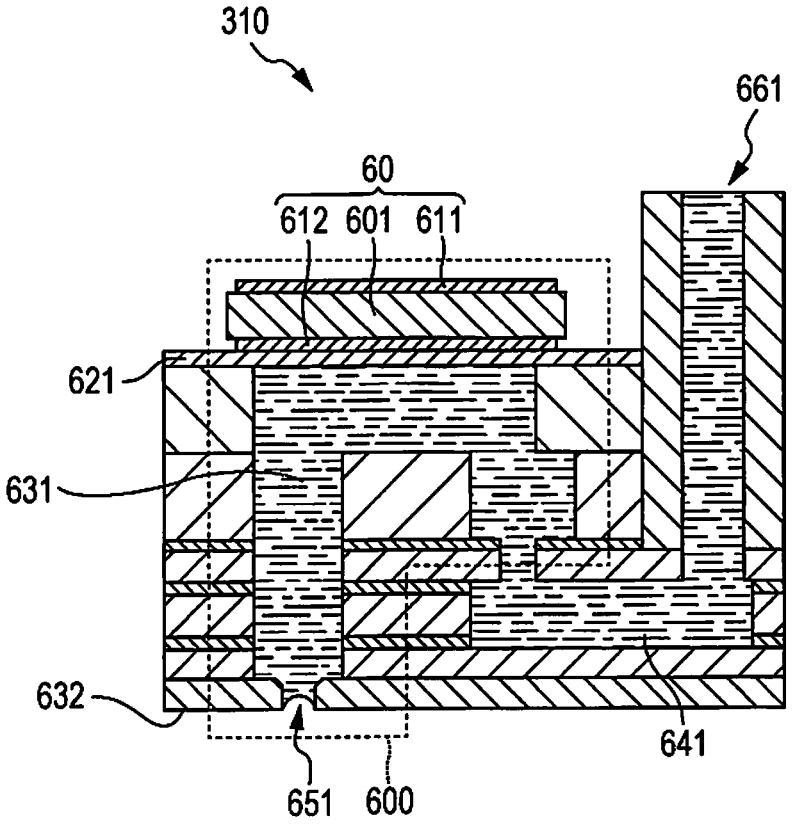
FIG. 14 is a diagram illustrating an overall configuration of one of a plurality of discharge sections in the head.

Next, the configuration of the discharge section 600 in the head 310 will be described with reference to FIG. 14. FIG. 14 is a diagram illustrating an overall configuration of one of the plurality of discharge sections 600 in the head 310. As illustrated in FIG. 14, the head 310 includes the discharge section 600 and a reservoir 641.

The reservoir 641 is provided to correspond to each of the nozzle columns L1 to L4. The ink is supplied from the ink supply port 661 into the reservoir 641.

The discharge section 600 includes the piezoelectric element 60, a vibration plate 621, a cavity 631, and the nozzle 651. The vibration plate 621 deforms by displacement of the piezoelectric element 60 provided on an upper surface in FIG. 14. The vibration plate 621 functions as a diaphragm of increasing and reducing the internal volume of the cavity 631. The cavity 631 is filled with the ink. The cavity 631 functions as a pressure chamber having an internal volume which changes by the displacement of the piezoelectric element 60. The nozzle 651 is an opening portion which is formed in the nozzle plate 632 and communicates with the cavity 631. The ink stored in the cavity 631 is discharged from the nozzle 651 by the change of the internal volume of the cavity 631.

The piezoelectric element 60 has a structure in which a piezoelectric substance 601 is interposed between a pair of electrodes 611 and 612. In the piezoelectric element 60 having such a structure, the central portions of the electrodes 611 and 612 and the vibration plate 621 bend with respect to both end portions thereof in an up-and-down direction in FIG. 14, in accordance with a voltage supplied to the electrodes 611 and 612. Specifically, the driving signal VOUT is supplied to the electrode 611, and the reference voltage signal CGND is supplied to the electrode 612. If the voltage of the driving signal VOUT is high, the central portion of the piezoelectric element 60 bends upward. If the voltage of the driving signal VOUT is low, the central portion of the piezoelectric element 60 bends downward. That is, if the piezoelectric element 60 bends upward, the internal volume of the cavity 631 increases. Thus, the ink is drawn from the reservoir 641. If the piezoelectric element 60 bends downward, the internal volume of the cavity 631 is reduced. Accordingly, the ink of the amount depending on the degree of the internal volume of the cavity 631 being reduced is discharged from the nozzle 651. As described above, the piezoelectric element 60 drives by the driving signal VOUT based on the driving signal COM, and the ink is discharged from the nozzle 651 by the piezoelectric element 60 driving. The piezoelectric element 60 is not limited to the structure illustrated in FIG. 14. Any type may be provided so long as the piezoelectric element is capable of discharging the ink with the displacement of the piezoelectric element 60. The piezoelectric element 60 is not limited to flexural vibration, and may be configured to use longitudinal vibration.

Returning to FIG. 12, the substrate 320 has a surface 321 and a surface 322 different from the surface 321. Here, the surface 321 and the surface 322 are surfaces located to face each other with a base material of the substrate 320 interposed between the surfaces 321 and 322. In other words, the surface 321 and the surface 322 are the front surface and the back surface of the substrate 320. The substrate 320 has a substantially rectangular shape formed by a side 323, a side 324 (facing the side 323 in the X-direction), a side 325, and a side 326 (facing the side 325 in the Y-direction). In other words, the substrate 320 has the side 323, the side 324 different from the side 323, the side 325 intersecting the sides 323 and 324, and the side 326 different from the side 325 intersecting the sides 323 and 324. Here, the sides 325 and 326 intersecting the sides 323 and 324 mean a case where a virtual extension line of the side 325 intersects a virtual extension line of the side 323 and a virtual extension line of the side 324, and a virtual extension line of the side 326 intersects a virtual extension line of the side 323 and a virtual extension line of the side 324. That is, the shape of the substrate 320 is not limited to a rectangle. For example, the shape of the substrate 320 may be a polygon such as a hexagon or an octagon, or may have a shape in which a notch or an arc is formed at a portion thereof.

Figure 15:
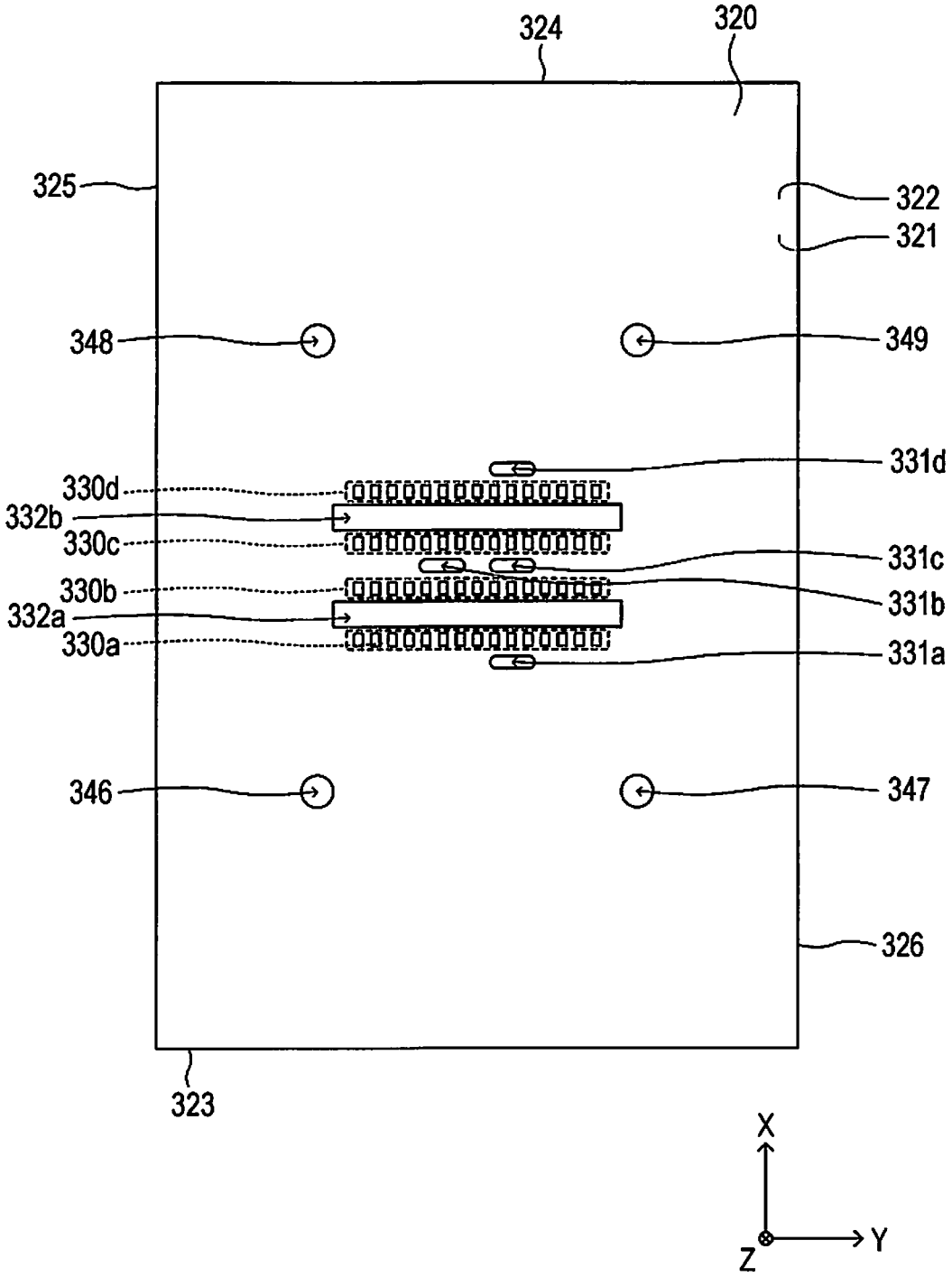
FIG. 15 is a plan view when a substrate is viewed from a surface 322.
Figure 16:
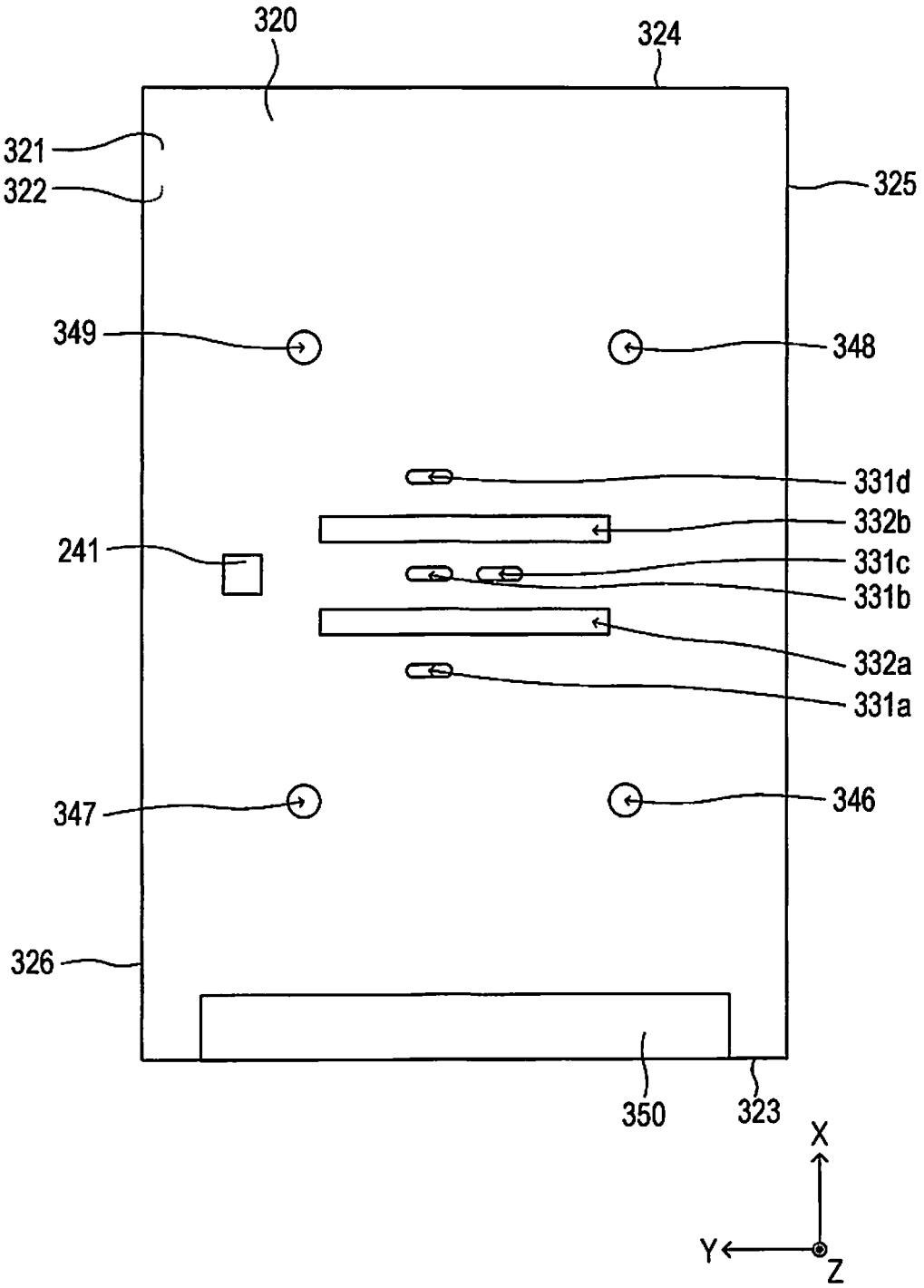
FIG. 16 is a plan view when the substrate is viewed from a surface 321.

Here, details of the substrate 320 will be described with reference to FIGS. 15 and 16. FIG. 15 is a plan view when the substrate 320 is viewed from the surface 322. FIG. 16 is a plan view when the substrate 320 is viewed from the surface 321. As illustrated in FIG. 15, electrode groups 330*a* to 330*d* are provided on the surface 322 of the substrate 320. Specifically, each of the electrode groups 330*a* to 330*d* includes a plurality of electrodes aligned in the Y-direction. The electrode groups 330*a* to 330*d* are provided to be aligned from the side 323 toward the side 324 in order of the electrode groups 330*a*, 330*b*, 330*c*, and 330*d*. A flexible printed circuit (FPC) (not illustrated) is electrically coupled to each of the electrode groups 330*a* to 330*d* provided in a manner as described above.

As illustrated in FIGS. 15 and 16, FPC insertion holes 332*a* and 332*b* and ink supply path insertion holes 331*a* to 331*d* being through-holes penetrating the surfaces 321 and 322 are formed in the substrate 320.

The FPC insertion hole 332*a* is located between the electrode group 330*a* and the electrode group 330*b* in the X-direction. An FPC electrically coupled to the electrode group 330*a* and an FPC electrically coupled to the electrode group 330*b* are inserted into the FPC insertion hole 332*a*. The FPC insertion hole 332*b* is located between the electrode group 330*c* and the electrode group 330*d* in the X-direction. An FPC electrically coupled to the electrode group 330*c* and an FPC electrically coupled to the electrode group 330*d* are inserted into the FPC insertion hole 332*b*.

The ink supply path insertion hole 331*a* is located on the side 323 side of the electrode group 330*a* in the X-direction. The ink supply path insertion holes 331*b* and 331*c* are located between the electrode group 330*b* and the electrode group 330*c* in the X-direction. The ink supply path insertion holes 331*b* and 331*c* are located to be aligned in the Y-direction such that the ink supply path insertion hole 331*b* is located on the side 325 side, and the ink supply path insertion hole 331*c* is located on the side 326 side. The ink supply path insertion hole 331*d* is located on the side 324 side of the electrode group 330*d* in the X-direction. A portion of an ink supply path (not illustrated) is inserted into each of the ink supply path insertion holes 331*a* to 331*d*. The ink supply path communicates with an ink supply port 661 for supplying the ink to the discharge section 600 corresponding to each of the nozzle columns L1 to L4.

As illustrated in FIGS. 15 and 16, the substrate 320 has fixation portions 346 to 349 for fixing the substrate 320 in the print head 21 to the carriage 20 illustrated in FIG. 1. Each of the fixation portions 346 to 349 is a through-hole penetrating the surfaces 321 and 322 of the substrate 320. The substrate 320 is fixed to the carriage 20 in a manner that screws (not illustrated) inserted into the fixation portion 346 to 349 are attached to the carriage 20. The fixation portions 346 to 349 are not limited to through-holes formed in the substrate 320. For example, the substrate 320 may be fixed to the carriage 20 by fitting the fixation portions 346 to 349.

The fixation portions 346 and 347 are located on the side 323 side of the ink supply path insertion hole 331*a* in the X-direction and are provided to be aligned such that the fixation portion 346 is located on the side 325 side, and the fixation portion 347 is located on the side 326 side. The fixation portions 348 and 349 are located on the side 324 side of the ink supply path insertion hole 331*d* in the X-direction and are provided to be aligned such that the fixation portion 348 is located on the side 325 side, and the fixation portion 349 is located on the side 326 side.

As illustrated in FIG. 16, an integrated circuit 241 constituting the diagnosis circuit 240 illustrated in FIG. 2 is provided on the surface 321 of the substrate 320. Specifically, the integrated circuit 241 is provided between the fixation portion 347 and the fixation portion 349 and is provided on the side 326 side of the electrode groups 330*a* to 330*d*, on the surface 321 side of the substrate 320. The integrated circuit 241 constituting the diagnosis circuit 240 diagnoses whether or not normal discharge of the ink from the nozzle 651 is possible, based on the diagnosis signals DIG-A to DIG-D.

As illustrated in FIG. 16, the connector 350 is provided on the substrate 320. The connector 350 is provided along the side 323 on the surface 321 side of the substrate 320. That is, the connector 350 and the integrated circuit 241 constituting the diagnosis circuit 240 are provided on the same surface of the substrate 320.

Figure 17:
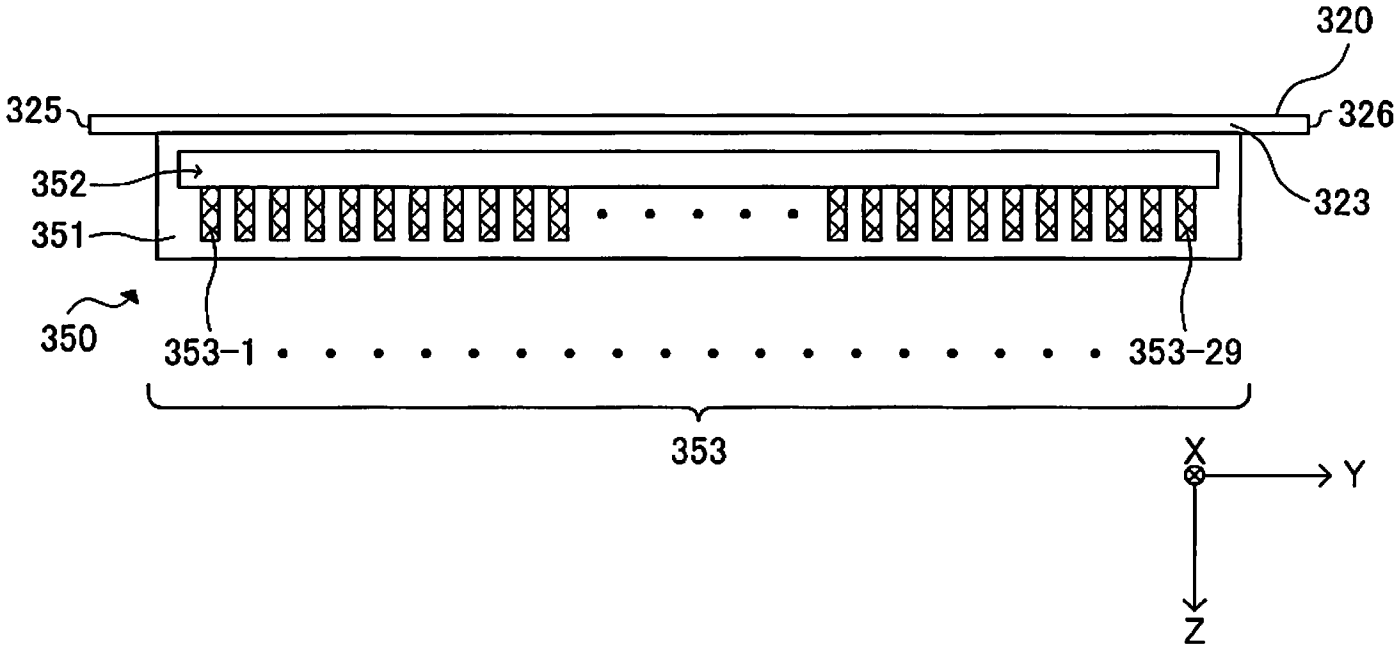
FIG. 17 is a diagram illustrating a configuration of a connector.

Here, a configuration of the connector 350 will be described with reference to FIG. 17. FIG. 17 is a diagram illustrating the configuration of the connector 350. As illustrated in FIG. 17, the connector 350 includes a housing 351, a cable attachment section 352 formed in the housing 351, and a plurality of terminals 353. The plurality of terminals 353 is aligned in parallel along the side 323. Specifically, 29 terminals 353 are aligned in parallel along the side 323 in the connector 350 in the first embodiment. Here, the 29 terminals 353 are referred to as terminals 353-1, 353-2, . . . , and 353-29 in order from the side 325 toward the side 326 in a direction along the side 323. The cable attachment section 352 is located on the substrate 320 side of the plurality of terminals 353 in the Z-direction. The cable 19 is attached to the cable attachment section 352. When the cable 19 is attached to the cable attachment section 352, the terminals 196-1 to 196-29 in the cable 19 electrically come into contact with the terminals 353-1 to 353-29 in the connector 350, respectively.

Here, in the connector 350 illustrated in FIG. 17, the cable attachment section 352 is located on the substrate 320 side in the Z-direction, and the plurality of terminals 353 is located on the ink discharge surface 311 side in the Z-direction. However, as in the connector 350 illustrated in FIG. 18, the plurality of terminals 353 is preferably located on the substrate 320 side in the Z-direction, and the cable attachment section 352 is preferably located on the ink discharge surface 311 side in the Z-direction.

Figure 18:
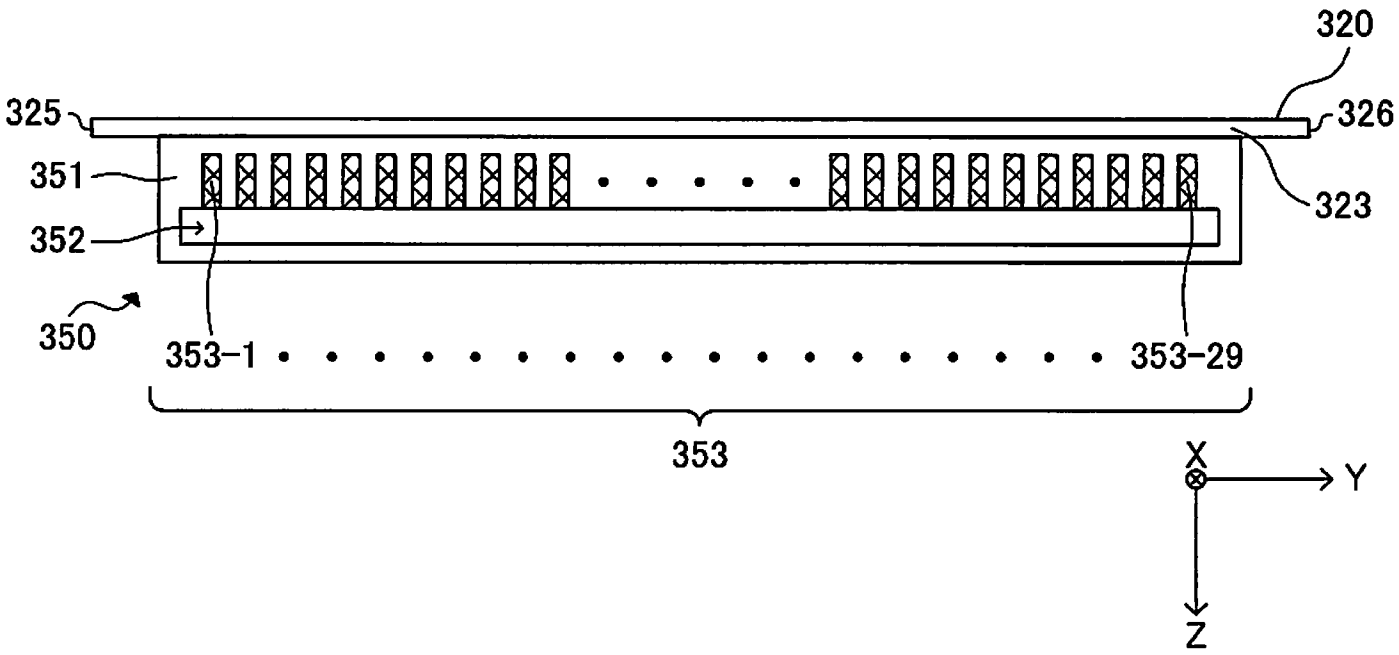
FIG. 18 is a diagram illustrating another configuration of the connector.

FIG. 18 is a diagram illustrating another configuration of the connector 350. In the liquid discharge apparatus 1, most of the ink discharged from the nozzle 651 are landed on a medium P and form an image. However, a portion of the ink discharged from the nozzle 651 may be misted before being landed on the medium P, and thus may float in the liquid discharge apparatus 1. Even after the ink discharged from the nozzle 651 is landed on the medium P, the ink landed on the medium P may float again in the liquid discharge apparatus 1 by an air flow generated with moving the carriage 20 in which the print head 21 is mounted or transporting the medium P. Thus, when the ink floating in the liquid discharge apparatus 1 adheres to the plurality of terminals 353 in the connector 350 or to the terminals 196 in the cable 19 for propagating a signal to the print head 21, the terminals may be short-circuited. As a result, the waveforms of the various signals input to the print head 21 may be distorted, and thus discharge accuracy of the ink discharged from the print head 21 may be deteriorated.

As in the connector 350 illustrated in FIG. 18, when the plurality of terminals 353 is located on the substrate 320 side in the Z-direction, the cable attachment section 352 is located on the ink discharge surface 311 side in the Z-direction, and the cable 19 is attached to the connector 350, a possibility that the terminal 353 and the terminal 196 are exposed to the ink discharge surface 311 side having a high possibility of the floating ink adhering is reduced. Therefore, it is possible to reduce the concern that the plurality of terminals 353 in the connector 350 or the terminals 196 in the cable 19 are short-circuited by the ink floating in the liquid discharge apparatus 1. Accordingly, it is possible to reduce the concern that the signal propagated in the cable 19 is distorted.

Figure 19:
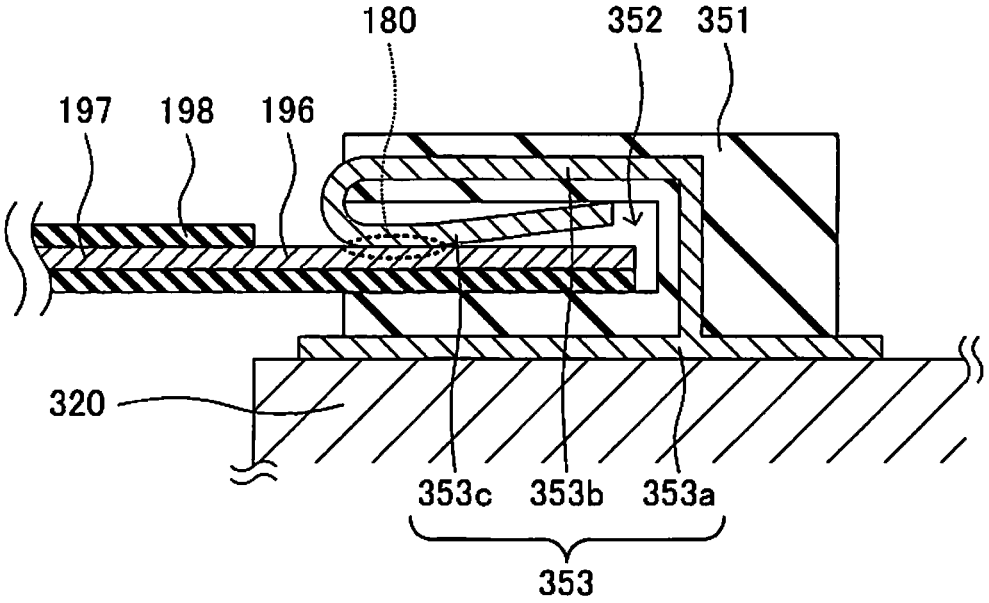
FIG. 19 is a diagram illustrating a specific example when the cable is attached to the connector.

Here, a specific example of electrical coupling between the cable 19 and the connector 350 will be described with reference to FIG. 19. FIG. 19 is a diagram illustrating a specific example when the cable 19 is attached to the connector 350. As illustrated in FIG. 19, the terminal 353 of the connector 350 has a substrate attachment section 353*a*, a housing insertion section 353*b*, and a cable maintaining section 353*c*. The substrate attachment section 353*a* is located at a lower portion of the connector 350 and is provided between the housing 351 and the substrate 320. The substrate attachment section 353*a* is electrically coupled to an electrode (not illustrated) provided on the substrate 320, by a solder, for example. The housing insertion section 353*b* is inserted into the housing 351. The housing insertion section 353*b* electrically couples the substrate attachment section 353*a* and the cable maintaining section 353*c* to each other. The cable maintaining section 353*c* has a curved shape that protrudes toward the inside of the cable attachment section 352. When the cable 19 is attached to the cable attachment section 352, the cable maintaining section 353*c* and the terminal 196 electrically come into contact with each other via a contact section 180. Thus, the cable 19 is electrically coupled to the connector 350 and the substrate 320. In this case, since the cable 19 is attached, stress is applied to the curved shape formed at the cable maintaining section 353*c*. With the stress, the cable 19 is held in the cable attachment section 352.

As described above, the cable 19 and the connector 350 are electrically coupled to each other by the terminal 196 and the terminal 353 coming into contact with each other via the contact section 180. FIG. 11 illustrates contact sections 180-1 to 180-29 at which each of the terminals 196-1 to 196-29 is electrically in contact with the terminal 353 of the connector 350. Thus, the terminal 195-*k* in the cable 19 is electrically coupled to the connector 12, and the terminal 196-*k* in the cable 19 is electrically coupled to the connector 350 via the contact section 180-*k*.

In the print head 21 configured in a manner as described above, a plurality of signals including the driving signals COM1 to COM4, the reference voltage signals CGND1 to CGND4, the print data signals SI1 to SI4, the latch signal LAT, the change signal CH, and the clock signal SCK, which are output from the control mechanism 10, is input to the print head 21 via the connector 350. The plurality of signals is propagated in a wiring pattern (not illustrated) provided on the substrate 320 and then is input to each of the electrode groups 330*a* to 330*d*.

The various signals input to each of the electrode groups 330*a* to 330*d* are input to the driving signal selection circuits 200-1 to 200-4 respectively corresponding to the nozzle columns L1 to L4, via an FPC electrically coupled to each of the electrode groups 330*a* to 330*d*. The driving signal selection circuits 200-1 to 200-4 generate the driving signals VOUT1 to VOUT4 based on the input signals and supply the driving signals VOUT1 to VOUT4 to the piezoelectric elements 60 in the nozzle columns L1 to L4, respectively. In this manner, the various signals input to the connector 350 are supplied to the piezoelectric elements 60 in the plurality of discharge sections 600. Each of the driving signal selection circuits 200-1 to 200-4 may be provided in the head 310 or may be mounted on an FPC in a manner of chip-on-film (COF).

1.7. Details of Signal Propagated in Cable

In the liquid discharge apparatus 1 configured in a manner as described above, details of the signal propagated between the print head control circuit 15 and the print head 21 will be described with reference to FIG. 20.

FIG. 20 is a diagram illustrating details of the signal propagated in the cable 19. As illustrated in FIG. 20, the cable 19 includes wirings for propagating the driving signals COM1 to COM4, wirings for propagating the reference voltage signals CGND1 to CGND4, wirings for propagating the temperature signal TH, the latch signal LAT, the clock signal SCK, the change signal CH, the print data signal SI1, and the abnormality signal XHOT, wirings for propagating the diagnosis signals DIG-A to DIG-E, wirings for propagating the voltages VHV, VDD1, and VDD2, and a plurality of wirings for propagating a plurality of ground signals GND.

Specifically, the driving signals COM1 to COM4 and the reference voltage signals CGND1 to CGND4 are input from the terminals 195-1 to 195-8 to the cable 19 and are propagated in the wiring 197-1 to 197-8, respectively. Then, the driving signals COM1 to COM4 and the reference voltage signals CGND1 to CGND4 are input to the terminals 353-1 to 353-8 of the connector 350 via the terminals 196-1 to 196-8 and the contact sections 180-1 to 180-8, respectively.

The diagnosis signal DIG-A is input from the terminal 195-25 to the cable 19 and is propagated in the wiring 197-25. Then, the diagnosis signal DIG-A is input to the terminal 353-25 of the connector 350 via the terminal 196-25 and the contact section 180-25. Similarly, the latch signal LAT is input from the terminal 195-25 to the cable 19 and is propagated in the wiring 197-25. Then, the latch signal LAT is input to the terminal 353-25 of the connector 350 via the terminal 196-25 and the contact section 180-25. That is, the wiring 197-25 functions as the wiring for propagating the diagnosis signal DIG-A and the wiring for propagating the latch signal LAT. The terminal 353-25 functions as the terminal to which the diagnosis signal DIG-A is input and the terminal to which the latch signal LAT is input. The contact section 180-25 is electrically in contact with the wiring for propagating the diagnosis signal DIG-A and is also electrically in contact with the wiring for propagating the latch signal LAT. The diagnosis signal DIG-A is an example of a second diagnosis signal in the first embodiment. The wiring 197-25 for propagating the diagnosis signal DIG-A is an example of a second diagnosis signal propagation wiring in the first embodiment. The terminal 353-25 to which the diagnosis signal DIG-A is input is an example of a second terminal in the first embodiment. The contact section 180-25 at which the wiring 197-25 and the terminal 353-25 are electrically in contact with each other is an example of a second contact section in the first embodiment.

The diagnosis signal DIG-B is input from the terminal 195-23 to the cable 19 and is propagated in the wiring 197-23. Then, the diagnosis signal DIG-B is input to the terminal 353-23 of the connector 350 via the terminal 196-23 and the contact section 180-23. Similarly, the clock signal SCK is input from the terminal 195-23 to the cable 19 and is propagated in the wiring 197-23. Then, the clock signal SCK is input to the terminal 353-23 of the connector 350 via the terminal 196-23 and the contact section 180-23. That is, the wiring 197-23 functions as the wiring for propagating the diagnosis signal DIG-B and the wiring for propagating the clock signal SCK. The terminal 353-23 functions as the terminal to which the diagnosis signal DIG-B is input and the terminal to which the clock signal SCK is input. The contact section 180-23 is electrically in contact with the wiring for propagating the diagnosis signal DIG-B and is also electrically in contact with the wiring for propagating the clock signal SCK. The diagnosis signal DIG-B is an example of a first diagnosis signal in the first embodiment. The wiring 197-23 for propagating the diagnosis signal DIG-B is an example of a first diagnosis signal propagation wiring in the first embodiment. The terminal 353-23 to which the diagnosis signal DIG-B is input is an example of a first terminal in the first embodiment. The contact section 180-23 at which the wiring 197-23 and the terminal 353-23 are electrically in contact with each other is an example of a first contact section in the first embodiment.

The diagnosis signal DIG-C is input from the terminal 195-21 to the cable 19 and is propagated in the wiring 197-21. Then, the diagnosis signal DIG-C is input to the terminal 353-21 of the connector 350 via the terminal 196-21 and the contact section 180-21. Similarly, the change signal CH is input from the terminal 195-21 to the cable 19 and is propagated in the wiring 197-21. Then, the change signal CH is input to the terminal 353-21 of the connector 350 via the terminal 196-21 and the contact section 180-21. That is, the wiring 197-21 functions as the wiring for propagating the diagnosis signal DIG-C and the wiring for propagating the change signal CH. The terminal 353-21 functions as the terminal to which the diagnosis signal DIG-C is input and the terminal to which the change signal CH is input. The contact section 180-21 is electrically in contact with the wiring for propagating the diagnosis signal DIG-C and is also electrically in contact with the wiring for propagating the change signal CH. The diagnosis signal DIG-C is an example of a third diagnosis signal in the first embodiment. The wiring 197-21 for propagating the diagnosis signal DIG-C is an example of a third diagnosis signal propagation wiring in the first embodiment. The terminal 353-21 to which the diagnosis signal DIG-C is input is an example of a third terminal in the first embodiment. The contact section 180-21 at which the wiring 197-21 and the terminal 353-21 are electrically in contact with each other is an example of a third contact section in the first embodiment.

The diagnosis signal DIG-D is input from the terminal 195-19 to the cable 19 and is propagated in the wiring 197-19. Then, the diagnosis signal DIG-D is input to the terminal 353-19 of the connector 350 via the terminal 196-19 and the contact section 180-19. Similarly, the print data signal SI1 is input from the terminal 195-19 to the cable 19 and is propagated in the wiring 197-19. Then, the print data signal SI1 is input to the terminal 353-19 of the connector 350 via the terminal 196-19 and the contact section 180-19. That is, the wiring 197-19 functions as the wiring for propagating the diagnosis signal DIG-D and the wiring for propagating the print data signal SI1. The terminal 353-19 functions as the terminal to which the diagnosis signal DIG-D is input and the terminal to which the print data signal SI1 is input. The contact section 180-19 is electrically in contact with the wiring for propagating the diagnosis signal DIG-D and is also electrically in contact with the wiring for propagating the print data signal SI1. The diagnosis signal DIG-D is an example of a fourth diagnosis signal in the first embodiment. The wiring 197-19 for propagating the diagnosis signal DIG-D is an example of a fourth diagnosis signal propagation wiring in the first embodiment. The terminal 353-19 to which the diagnosis signal DIG-D is input is an example of a fourth terminal in the first embodiment. The contact section 180-19 at which the wiring 197-19 and the terminal 353-19 are electrically in contact with each other is an example of a fourth contact section in the first embodiment.

The diagnosis signal DIG-E is input to the terminal 353-11 of the connector 350 and is input to the cable 19 via the contact section 180-11 and the terminal 196-11. The diagnosis signal DIG-E is propagated in the wiring 197-11, and then is input from the terminal 195-11 to the main substrate 11. Similarly, the abnormality signal XHOT is input to the terminal 353-11 of the connector 350 and is input to the cable 19 via the contact section 180-11 and the terminal 196-11. The abnormality signal XHOT is propagated in the wiring 197-11, and then is input from the terminal 195-11 to the main substrate 11. That is, the wiring 197-11 functions as the wiring for propagating the diagnosis signal DIG-E and the wiring for propagating the abnormality signal XHOT. The terminal 353-11 functions as the terminal to which the diagnosis signal DIG-E is input and the terminal to which the abnormality signal XHOT is input. The contact section 180-11 is electrically in contact with the wiring for propagating the diagnosis signal DIG-E and is also electrically in contact with the wiring for propagating the abnormality signal XHOT. The diagnosis signal DIG-E is an example of a fifth diagnosis signal in the first embodiment. The wiring 197-11 for propagating the diagnosis signal DIG-E is an example of a fifth diagnosis signal propagation wiring in the first embodiment. The terminal 353-11 to which the diagnosis signal DIG-E is input is an example of a fifth terminal in the first embodiment. The contact section 180-11 at which the wiring 197-11 and the terminal 353-11 are electrically in contact with each other is an example of a fifth contact section in the first embodiment.

As described above, in the first embodiment, each of the diagnosis signals DIG-A to DIG-E and each of the latch signal LAT, the clock signal SCK, the change signal CH, the print data signal SI1, and the abnormality signal XHOT are propagated in the common wiring. Here, an example of a method of propagating each of the diagnosis signals DIG-A to DIG-E and each of the latch signal LAT, the clock signal SCK, the change signal CH, the print data signal SI1, and the abnormality signal XHOT in the common wiring and of inputting the signals to the common terminal will be described.

For example, the control circuit 100 generates the diagnosis signal DIG-A, the latch signal LAT, the diagnosis signal DIG-B, the clock signal SCK, the diagnosis signal DIG-C, the change signal CH, the diagnosis signal DIG-D, and the print data signal SI1 in time division, in accordance with operation states of the liquid discharge apparatus 1 and the print head 21. Specifically, when the liquid discharge apparatus 1 is in a print state of discharging the ink, the control circuit 100 generates the latch signal LAT, the clock signal SCK, the change signal CH, and the print data signal SI1 and outputs the generated signals to the print head 21. When the liquid discharge apparatus 1 is not in the print state of discharging the ink, and the print head 21 performs self-diagnosis, the control circuit 100 generates the diagnosis signals DIG-A to DIG-D and outputs the generated signals to the print head 21. Thus, each of the latch signal LAT, the clock signal SCK, the change signal CH, and the print data signal SI1 and each of the diagnosis signals DIG-A to DIG-D can be propagated in the common wiring, and can be input to the common terminal via the common contact section.

As a method of propagating the diagnosis signal DIG-E and the abnormality signal XHOT in the common wiring and inputting the diagnosis signal DIG-E and the abnormality signal XHOT to the common terminal, for example, a wiring from which the diagnosis signal DIG-E indicating the diagnosis result in the diagnosis circuit 240 and a wiring from which the abnormality signal XHOT is output are coupled in a wired-OR manner in the print head 21. Then, a signal obtained by the coupling in the wired-OR manner is input to the common terminal, and then is propagated in the common wiring. Thus, when abnormality occurs in at least any of a diagnosis result of diagnosing whether or not the temperature of the temperature abnormality detection circuit 250 is abnormal and a diagnosis result in the diagnosis circuit 240, a signal which has an L level and indicates that normal discharge of the ink in the print head 21 is not possible is propagated. When both the diagnosis result of diagnosing whether or not the temperature of the temperature abnormality detection circuit 250 is abnormal and the diagnosis result in the diagnosis circuit 240 are normal, a signal which has an H level and indicates that normal discharge of the ink in the print head 21 is possible is propagated.

As described above, a method of propagating each of the diagnosis signals DIG-A to DIG-E and each of the latch signal LAT, the clock signal SCK, the change signal CH, the print data signal SI1, and the abnormality signal XHOT in the common wiring and inputting the signals to the common terminal is an example. The signal propagated in the wiring and the signal input to the terminal may be switched by a selector, for example.

The print data signal SI, the change signal CH, the latch signal LAT, the clock signal SCK, and the abnormality signal XHOT are signals important for controlling discharging of the print head 21. When a coupling problem occurs in the wiring in which the signals are propagated, the discharge accuracy of the ink may be deteriorated. The wiring in which such important signals are propagated and the wiring in which the signal when the print head 21 performs self-diagnosis are set to the common wiring, and the terminal to which the important signals are input and the terminal to which the signal when the print head 21 performs self-diagnosis is input are set to the common terminal coupled to the common contact section. Thus, it can be diagnosed whether or not the print data signal SI1, the change signal CH, the latch signal LAT, the clock signal SCK, and the abnormality signal XHOT are normally propagated, based on the result of the self-diagnosis of the print head 21. Further, since the plurality of signals is propagated in one wiring, and the plurality of signals is input to one terminal, it is possible to reduce the number of wirings to be provided in the cable 19 and the number of terminals provided in the connector 350.

The print data signal SI2 to SI4 are input to the cable 19 from the terminals 195-17, 195-15, and 195-13 and are propagated in the wirings 197-17, 197-15, and 197-13, respectively. Then, the print data signal S12 to S14 are input to the terminals 353-17, 353-15, and 353-13 of the connector 350 via the terminals 196-17, 196-15, and 196-13 and the contact sections 180-17, 180-15, and 180-13, respectively.

The voltage VHV is input from the terminal 195-9 to the cable 19 and is propagated in the wiring 197-9. Then, the voltage VHV is input to the terminal 353-9 of the connector 350 via the terminal 196-9 and the contact section 180-9. The voltage VHV is a signal having a voltage value larger than the voltage VDD1. The voltage VHV supplied to the terminal 353-9 is supplied to the driving signal selection circuit 200. The voltage VHV is used as a voltage for performing level shift of the logical level of the selection signal S to a high amplitude logic level in the driving signal selection circuit 200.

The voltage VDD1 is input from the terminal 195-29 to the cable 19 and is propagated in the wiring 197-29. Then, the voltage VDD1 is input to the terminal 353-29 of the connector 350 via the terminal 196-29 and the contact section 180-29. The voltage VDD1 supplied to the terminal 353-29 is supplied to the driving signal selection circuit 200. The voltage VDD1 is used as the power source voltage of the driving signal selection circuit 200 and is used as a voltage for generating various control signals for controlling the operation of the driving signal selection circuit 200.

The voltage VDD2 is input from the terminal 195-24 to the cable 19 and is propagated in the wiring 197-24. Then, the voltage VDD2 is input to the terminal 353-24 of the connector 350 via the terminal 196-24 and the contact section 180-24. The voltage VDD2 supplied to the terminal 353-24 is supplied to the temperature abnormality detection circuit 250. Thus, the voltage VDD2 is used as the power source voltage of the comparator 251 as illustrated in FIG. 9 and is used as a pull-up voltage for generating the abnormality signal XHOT and the diagnosis signal DIG-E. That is, when the wiring 197-11 for propagating the abnormality signal XHOT and the diagnosis signal DIG-E and the wiring 197-24 for propagating the voltage VDD2 are electrically coupled to the print head 21, the wiring 197-11 for propagating the abnormality signal XHOT and the diagnosis signal DIG-E and the wiring 197-24 for propagating the voltage VDD2 are electrically coupled via the terminals 353-11 and terminal 353-24 of the connector 350. In other words, in the print head 21, the terminal 353-11 of the connector 350 is electrically coupled to the terminal 353-24. Further, the contact section 180-11 and the contact section 180-24 are electrically coupled. The phrase of being electrically coupled is not limited to a case of being directly or indirectly via a wiring pattern provided on the substrate 320 and includes, for example, a case of being electrically coupled via a resistor element or a capacitor element.

Here, the voltage VDD1 is an example of a first voltage signal in the first embodiment. The wiring 197-29 for propagating the voltage VDD1 is an example of a first voltage signal propagation wiring in the first embodiment. The terminal 353-29 to which the voltage VDD1 is input is an example of a sixth terminal in the first embodiment. The contact section 180-29 at which the wiring 197-29 is electrically in contact with the terminal 353-29 is an example of a sixth contact section in the first embodiment. The voltage VDD2 is an example of a second voltage signal in the first embodiment. The wiring 197-24 for propagating the voltage VDD2 is an example of a second voltage signal propagation wiring in the first embodiment. The terminal 353-24 to which the voltage VDD2 is input is an example of a seventh terminal in the first embodiment. The contact section 180-24 at which the wiring 197-24 is electrically in contact with the terminal 353-24 is an example of a seventh contact section in the first embodiment. The voltage VHV is an example of a third voltage signal in the first embodiment. The wiring 197-9 for propagating the voltage VHV is an example of a third voltage signal propagation wiring in the first embodiment. The terminal 353-9 to which the voltage VHV is input is an example of an eighth terminal in the first embodiment. The contact section 180-9 at which the wiring 197-9 is electrically in contact with the terminal 353-9 is an example of an eighth contact section in the first embodiment.

The temperature signal TH is input to the terminal 353-27 of the connector 350 and is input to the cable 19 via the contact section 180-27 and the terminal 196-27. The temperature signal TH is propagated in the wiring 197-27, and then is input from the terminal 195-27 to the main substrate 11.

The ground signal GND is input to the cable 19 from each of the terminals 195-10, 195-12, 195-14, 195-16, 195-18, 195-20, 195-22, 195-26, and 195-28 and is propagated in each of the wirings 197-10, 197-12, 197-14, 197-16, 197-18, 197-20, 197-22, 197-26, and 197-28. Then, the ground signal GND is input to each of the terminals 353-10, 353-12, 353-14, 353-16, 353-18, 353-20, 353-22, 353-26, and 353-28 of the connector 350 via each of the terminals 196-10, 196-12, 196-14, 196-16, 196-18, 196-20, 196-22, 196-26, and 196-28 and each of the contact sections 180-10, 180-12, 180-14, 180-16, 180-18, 180-20, 180-22, 180-26, and 180-28.

The voltages VHV and VDD1 are supplied to the driving signal selection circuit 200. The voltages VHV and VDD1 are used as voltages for generating the various control signals for controlling the operation of the driving signal selection circuit 200. The driving signal selection circuit 200 selects or does not select the waveform of the driving signal COM so as to generate the driving signal VOUT. Thus, the driving signal selection circuit 200 operates at a high speed in accordance with a discharge rate of the ink. Therefore, noise depending on the operation of the driving signal selection circuit 200 may be superimposed on the voltages VHV and VDD1 used as the power source voltage and the various control voltages of the driving signal selection circuit 200.

On the contrary, the voltage VDD2 is supplied to the temperature abnormality detection circuit 250. The voltage VDD2 is used as a power source voltage of the temperature abnormality detection circuit 250 and as a pull-up voltage for generating the abnormality signal XHOT and the diagnosis signal DIG-E. The logical levels of the abnormality signal XHOT and the diagnosis signal DIG-E are L levels when at least any diagnosis result of the diagnosis result of diagnosing whether or not the temperature of the temperature abnormality detection circuit 250 is abnormal and the diagnosis result in the diagnosis circuit 240 indicates abnormality. In addition, the logical levels of the abnormality signal XHOT and the diagnosis signal DIG-E are H levels when both the diagnosis results of the diagnosis result of diagnosing whether or not the temperature of the temperature abnormality detection circuit 250 is abnormal and the diagnosis result in the diagnosis circuit 240 are normal. In other words, the logical levels of the abnormality signal XHOT and the diagnosis signal DIG-E do not change when abnormality does not occur in the print head 21. Thus, the voltage VDD2 used as the power source voltage of the temperature abnormality detection circuit 250 and the pull-up voltage has a low possibility of noise being superimposed thereon.

The ground signal GND is a signal of a reference potential for a plurality of signals including the voltages VHV, VDD1, and VDD2. Therefore, a current caused by the plurality of signals including the voltages VHV, VDD1, and VDD2 flows in the wiring in which the ground signal GND is propagated. That is, when noise caused by the operation of the driving signal selection circuit 200 is superimposed on the voltages VHV and VDD1, a current caused by the voltages VHV and VDD1 on which the noise is superimposed flows in the wiring in which the ground signal GND is propagated. As a result, noise may also be superimposed in the wiring in which the ground signal GND is propagated.

As described above, the voltage VDD2 is a signal having a more stable potential when compared to the voltages VDD1 and VHV and the ground signal GND. As illustrated in FIG. 20, in the print head control circuit 15 of the liquid discharge apparatus 1 in the first embodiment, the wiring 197-23 for propagating the diagnosis signal DIG-B and the wiring 197-25 for propagating the diagnosis signal DIG-A are provided to be aligned. The wiring 197-24 in which the voltage VDD2 being a stable potential is propagated and the wiring 197-23 in which the diagnosis signal DIG-B is propagated are located to be adjacent to each other in a direction in which the wiring 197-23 and the wiring 197-25 are aligned. In other words, the wiring 197-24 in which the voltage VDD2 being a stable potential is propagated and the wiring 197-23 in which the diagnosis signal DIG-B is propagated are provided in the same cable 19 and are located to be adjacent to each other. Here, the phrase of being located to be adjacent includes a case in which the wiring 197-23 and the wiring 197-24 in the cable 19 are located to be adjacent to each other through the insulator 198, a space, or the like.

In the print head 21 of the liquid discharge apparatus 1 in the first embodiment, the terminal 353-23 to which the diagnosis signal DIG-B is input and the terminal 353-25 to which the diagnosis signal DIG-A is input are provided to be aligned. Thus, the terminal 353-24 to which the voltage VDD2 being a signal having a stable potential is input and the terminal 353-23 to which the clock signal SCK is input are provided to be adjacent to each other in a direction in which the terminal 353-23 and the terminal 353-25 are aligned. In other words, the terminal 353-23 to which the diagnosis signal DIG-B is input and the terminal 353-24 to which the voltage VDD2 is input are provided in the same connector 350 and are located to be adjacent to each other. Here, the phrase of being located to be adjacent includes a case in which the terminal 353-23 and the terminal 353-24 in the connector 350 are located to be adjacent to each other through an insulating member such as the housing 351, an internal space of the cable attachment section 352, or the like.

That is, in the connector 350, the terminal 353-24 to which the voltage VDD2 is input is located in the vicinity of the terminal 353-23 to which the diagnosis signal DIG-B is input. In other words, in the connector 350, the shortest distance between the terminal 353-23 and the terminal 353-24 is shorter than the shortest distance between the terminal 353-23 and the terminal 353-29 to which the voltage VDD1 is input and is shorter than the shortest distance between the terminal 353-23 and the terminal 353-9 to which the voltage VHV is input, in the direction in which the terminal 353-23 and the terminal 353-25 are aligned.

In the liquid discharge apparatus 1 in the first embodiment, the contact section 180-23 to which the diagnosis signal DIG-B is input and the contact section 180-25 to which the diagnosis signal DIG-A is input are provided to be aligned. Thus, the contact section 180-24 to which the voltage VDD2 being a signal having a stable potential is input and the contact section 180-23 to which the diagnosis signal DIG-B is input are provided to be adjacent to each other in a direction in which the contact section 180-23 and the contact section 180-25 are aligned. In other words, the contact section 180-23 to which the diagnosis signal DIG-B is input and the contact section 180-24 to which the voltage VDD2 is input are included in the plurality of contact sections 180 at which the same cable 19 and the same connector 350 are electrically in contact with each other, and are located to be adjacent to each other. Here, the phrase of being located to be adjacent includes a case in which the contact section 180-23 and the contact section 180-24 in the plurality of contact sections 180 at which the cable 19 and the connector 350 are electrically in contact with each other are located to be adjacent to each other through an insulating member such as the housing 351, an internal space, the insulator 198 in the cable 19, and the like.

That is, in the plurality of contact sections 180, the terminal 353-24 to which the voltage VDD2 is input is located in the vicinity of the contact section 180-23 to which the diagnosis signal DIG-B is input. In other words, in the connector 350, the shortest distance between the terminal 353-23 and the terminal 353-24 is shorter than the shortest distance between the terminal 353-23 and the terminal 353-29 to which the voltage VDD1 is input and is shorter than the shortest distance between the terminal 353-23 and the terminal 353-9 to which the voltage VHV is input, in the direction in which the terminal 353-23 and the terminal 353-25 are aligned.

In the print head control circuit 15, the print head 21, and the liquid discharge apparatus 1 configured as described above, the wiring in which the voltage VDD2 having a stable potential, the terminal to which the voltage VDD2 is input, and the contact section at which the wiring and the terminal are in contact with each other are located to be adjacent to the wiring in which the diagnosis signal DIG-B being one of the signals for diagnosing whether or not normal discharge of the ink from the print head 21 is possible is propagated, the terminal to which the diagnosis signal DIG-B is input, and the contact section at which the wiring and the terminal are in contact with each other. Thus, a concern that the waveform of the diagnosis signal DIG-B is distorted is reduced. Accordingly, it is possible to reduce a concern that the self-diagnosis function of the print head 21 does not normally operate.

As illustrated in FIG. 20, preferably, the diagnosis signal DIG-B provided to be adjacent to the voltage VDD2 is propagated in the common wiring 197-23 along with the clock signal SCK, and then is input to the common terminal 353-23.

As described above, the clock signal SCK is a signal for defining a timing at which the print data signal SI is input. Therefore, if noise is superimposed on the clock signal SCK, and the waveform of the clock signal SCK is distorted, the timing of the print data signal SI in synchronization with the clock signal SCK varies. As a result, discharge accuracy of the ink discharged from the plurality of corresponding nozzles 651 is deteriorated. If the wiring 197-23 is provided to be adjacent to the wiring 197-24 in which the voltage VDD2 is propagated functions as the wiring for the diagnosis signal DIG-B and the clock signal SCK, the concern that the waveform of the clock signal SCK is distorted is reduced. Thus, it is possible to improve discharge accuracy of the ink discharged from the print head 21.

Similarly, if the terminal 353-23 provided to be adjacent to the terminal 353-24 to which the voltage VDD2 is input functions as the terminal for the diagnosis signal DIG-B and the clock signal SCK, the concern that the waveform of the clock signal SCK is distorted is reduced. Similarly, if the contact section 180-23 provided to be adjacent to the contact section 180-24 to which the voltage VDD2 is input functions as the contact section to which the diagnosis signal DIG-B is input and as the contact section to which the clock signal SCK is input, the concern that the waveform of the clock signal SCK is distorted is reduced. Thus, it is possible to improve discharge accuracy of the ink discharged from the print head 21.

As illustrated in FIG. 20, the followings are preferable. That is, the wiring 197-23 in which the diagnosis signal DIG-B is propagated and the wiring 197-22 in which the ground signal GND is propagated are located to be adjacent to each other in the direction in which the wiring 197-23 and the wiring 197-25 are aligned. The terminal 353-23 to which the diagnosis signal DIG-B is input and the terminal 353-22 to which the ground signal GND is input are located to be adjacent to each other in the direction in which the terminal 353-23 and the terminal 353-25 are aligned. The contact section 180-23 to which the diagnosis signal DIG-B is input and the contact section 180-22 to which the ground signal GND is input are located to be adjacent to each other in the direction in which the contact section 180-23 and the contact section 180-25 are aligned. In other words, the followings are preferable. That is, the wiring 197-23 in which the diagnosis signal DIG-B is propagated is located between the wiring 197-24 in which the voltage VDD2 is propagated and the wiring 197-22 in which the ground signal GND is propagated, in the cable 19. In the connector 350, the terminal 353-23 to which the diagnosis signal DIG-B is input is located between the terminal 353-24 to which the voltage VDD2 is input and the terminal 353-22 to which the ground signal GND is input. The contact section 180-23 to which the diagnosis signal DIG-B is input is located between the contact section 180-24 to which the voltage VDD2 is input and the contact section 180-22 to which the ground signal GND is input.

Thus, the wiring 197-22 in which the ground signal GND is propagated, the terminal 353-22 to which the ground signal GND is input, and the contact section 180-22 to which the ground signal GND is input function as a shield that reduces interference of other signals with the voltage VDD2. Accordingly, it is possible to more reduce the concern that the waveform of the diagnosis signal DIG-B is distorted, and thus to more reduce the concern that the self-diagnosis function of the print head 21 does not normally operate. Here, the wiring 197-22 in which the ground signal GND is propagated is an example of a first ground signal propagation wiring in the first embodiment. The terminal 353-22 which is electrically coupled to the wiring 197-22 and to which the ground signal GND is input is an example of a first ground terminal in the first embodiment. The contact section 180-22 at which the wiring 197-22 and the terminal 353-22 are electrically in contact with each other is an example of a first ground contact section in the first embodiment.

As illustrated in FIG. 20, the followings are preferable. That is, the wiring 197-24 in which the voltage VDD2 is propagated and the wiring 197-9 in which the voltage VHV is propagated are not located to be adjacent to each other in the direction in which the wiring 197-23 and the wiring 197-25 are aligned. The terminal 353-24 to which the voltage VDD2 is input and the terminal 353-9 to which the voltage VHV is input are not located to be adjacent to each other in the direction in which the terminal 353-23 and the terminal 353-25. The contact section 180-24 to which the voltage VDD2 is input and the contact section 180-9 to which the voltage VHV is input are not located to be adjacent to each other in the direction in which the contact section 180-23 and the contact section 180-25 are aligned. Further, in this case, the followings are preferable. That is, the wiring 197-9 in which the voltage VHV is propagated and the wiring 197-10 in which the ground signal GND is propagated are located to be adjacent to each other in the direction in which the wiring 197-23 and the wiring 197-25 are aligned. The terminal 353-9 to which the voltage VHV is input and the terminal 353-10 to which the ground signal GND is input are located to be adjacent to each other in the direction in which the terminal 353-23 and the terminal 353-25. The contact section 180-9 to which the voltage VHV is input and the contact section 180-10 to which the ground signal GND is input are located to be adjacent to each other in the direction in which the contact section 180-23 and the contact section 180-25 are aligned.

The voltage VHV has a voltage value larger than the voltages VDD1 and VDD2. Therefore, when a noise component is superimposed on the voltage VHV, the noise component included in the voltage VHV may interfere with the signal propagated in the wiring adjacent to the wiring in which the voltage VHV is propagated, the signal input to the terminal adjacent to the terminal to which the voltage VHV is input, and the signal input to the contact section adjacent to the contact section to which the voltage VHV is input. That is, when the wiring 197-24, the contact section 180-24, and the terminal 196-24 used for propagating and inputting the voltage VDD2 having a stable potential to the print head 21 are adjacent to the wiring 197-11, the contact section 180-11, and the terminal 196-11 used for propagating and inputting the voltage VHV to the print head 21, the noise component included in the voltage VHV may interfere with the voltage VDD2 having a stable potential. Thus, when the noise component interferes with the voltage VDD2, the waveform of the diagnosis signal DIG-B may be distorted.

As illustrated in FIG. 20, if the wiring 197-24 in which the voltage VDD2 is propagated is not provided to be adjacent to the wiring 197-9 in which the voltage VHV is propagated, the terminal 353-24 to which the voltage VDD2 is input is not provided to be adjacent to the terminal 353-9 to which the voltage VHV is input, and the contact section 180-24 to which the voltage VDD2 is input is not provided to be adjacent to the contact section 180-9 to which the voltage VHV is input, it is possible to more reduce a concern that the voltage VHV interferes with the voltage VDD2 being the signal having a stable potential. Further, if the wiring 197-10 in which the ground signal GND is propagated is provided to be adjacent to the wiring 197-9 in which the voltage VHV is propagated, the terminal 353-10 to which the ground signal GND is input is provided to be adjacent to the terminal 353-9 to which the voltage VHV is input, and the contact section 180-10 to which the ground signal GND is input is provided to be adjacent to the contact section 180-9 to which the voltage VHV is input, the wiring 197-10, the terminal 353-10, and the contact section 180-10 function as the shield. As a result, it is possible to reduce a concern that the voltage VHV interferes with other signals including the voltage VDD2. The wiring 197-10 in which the ground signal GND is propagated is an example of a second ground signal propagation wiring in the first embodiment. The terminal 353-10 to which the ground signal GND is input via the wiring 197-10 is an example of a second ground terminal in the first embodiment. The contact section 180-10 at which the wiring 197-10 and the terminal 353-10 are electrically in contact with each other is an example of a second ground contact section in the first embodiment.

Here, the connector 350 which is provided in the print head 21 and has the terminal 353-23, the terminal 353-25, the terminal 353-21, the terminal 353-19, and the terminal 353-11 is an example of a first connector in the first embodiment.

1.8. Advantageous Effects

As described above, in the print head control circuit 15 in the first embodiment, the diagnosis signal DIG-A and the voltage VDD2 propagated in the same cable 19 are provided to be adjacent to each other. Specifically, the wiring 197-23 for propagating the diagnosis signal DIG-A and the wiring 197-24 in which the voltage VDD2 is propagated are located to be adjacent to each other in the direction in which the wiring 197-23 and the wiring 197-25 are aligned.

The voltage VDD2 is a signal propagated in the wiring different from the wiring for the voltage VDD1 supplied to the driving signal selection circuit 200 and is supplied to the temperature abnormality detection circuit 250 that generates the abnormality signal XHOT. The driving signal selection circuit 200 controls the supply of the driving signal COM to the piezoelectric element 60. That is, the driving signal selection circuit 200 operates at a high speed in accordance with a discharge rate of the ink discharged from the nozzle. Thus, noise depending on the operation of the driving signal selection circuit 200 may be superimposed on the voltage VDD1 supplied to the driving signal selection circuit 200. The voltage VDD1 supplied to the driving signal selection circuit 200 is fed back via the wiring in which the ground signal GND is propagated. That is, when the noise caused by the operation of the driving signal selection circuit 200 is superimposed on the voltage VDD1, a current caused by the voltage VDD1 on which the noise is superimposed flows in the wiring in which the ground signal GND is propagated.

On the contrary, the temperature abnormality detection circuit 250 diagnoses whether or not temperature abnormality occurs in the print head 21 and outputs the abnormality signal XHOT. Therefore, when the temperature of the print head 21 is within a normal temperature range, the logical level does not change. Thus, the voltage VDD2 supplied to the temperature abnormality detection circuit 250 is a signal having a potential more stable than the voltage VDD1 and the ground signal GND.

Since the wiring 197-24 in which the voltage VDD2 having a stable potential as described above is propagated and the wiring 197-23 for propagating the diagnosis signal DIG-B are located to be adjacent to each other in the direction in which the wiring 197-23 and the wiring 197-25 are aligned, it is possible to reduce the concern that the waveform of the diagnosis signal DIG-B is distorted in the cable 19. Thus, the diagnosis signal DIG-B is input to the diagnosis circuit 240 with high accuracy. Accordingly, it is possible to reduce the concern that the self-diagnosis function of the print head 21 does not normally operate.

Similarly, in the print head 21 in the first embodiment, the terminal 353-23 to which the diagnosis signal DIG-B is input and the terminal 353-24 to which the voltage VDD2 is input are located to be adjacent to each other in the direction in which the terminal 353-23 and the terminal 353-25 are aligned. In addition, in the liquid discharge apparatus 1 in the first embodiment, the contact section 180-23 to which the diagnosis signal DIG-B is input and the contact section 180-24 to which the voltage VDD2 is input are located to be adjacent to each other in the direction in which the contact section 180-23 and the contact section 180-25 are aligned. With such a configuration, it is possible to reduce the concern that the waveform of the diagnosis signal DIG-B is distorted. Thus, the diagnosis signal DIG-B is input to the diagnosis circuit 240 with high accuracy. Accordingly, it is possible to reduce the concern that the self-diagnosis function of the print head 21 does not normally operate.

2. Second Embodiment

Next, a liquid discharge apparatus 1, a print head control circuit 15, and a print head 21 according to a second embodiment will be described. When the liquid discharge apparatus 1, the print head control circuit 15, and the print head 21 in the second embodiment are described, components similar to those in the first embodiment are denoted by the same reference signs, and descriptions thereof will not be repeated or will be briefly made.

Figure 21:
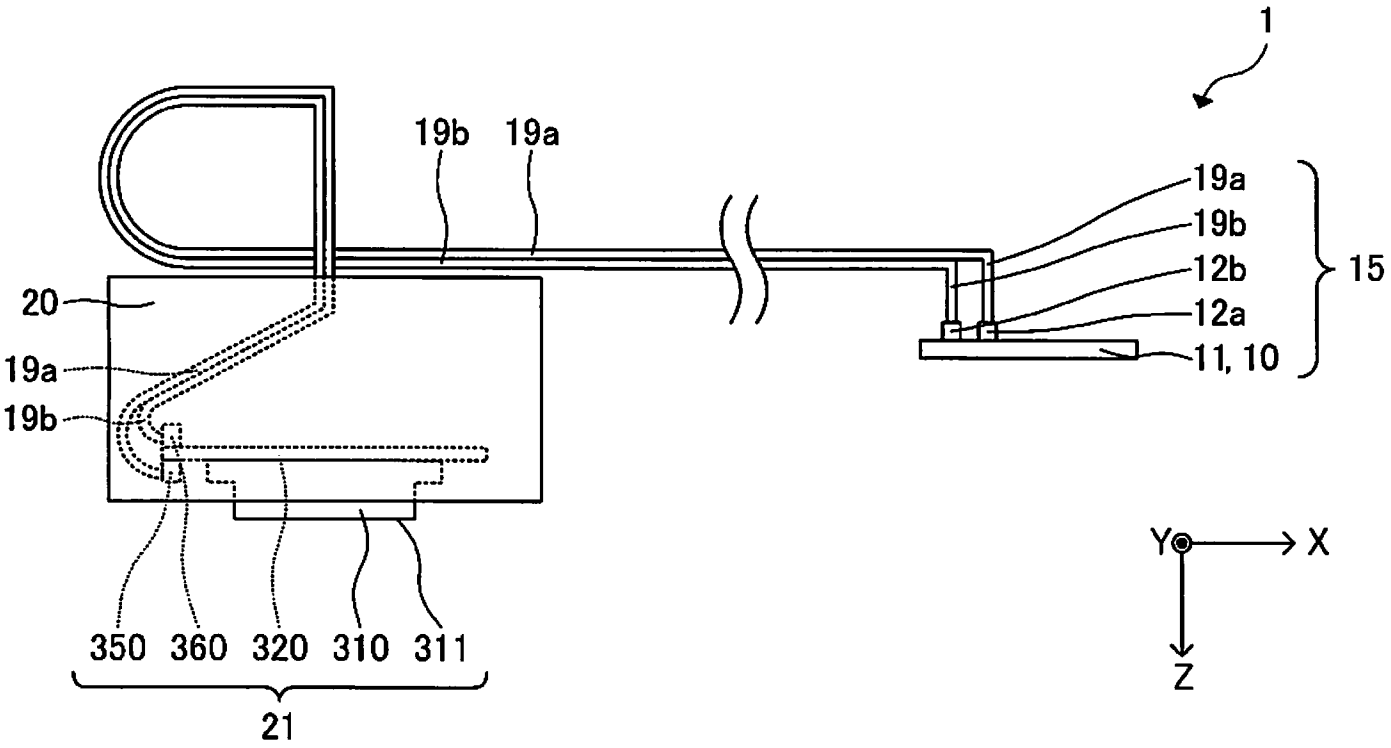
FIG. 21 is a schematic diagram illustrating an internal configuration of a liquid discharge apparatus according to a second embodiment when viewed from the Y-direction.

FIG. 21 is a schematic diagram illustrating an internal configuration of the liquid discharge apparatus 1 in the second embodiment when viewed from the Y-direction. As illustrated in FIG. 21, in the second embodiment, the liquid discharge apparatus 1 includes a main substrate 11, cables 19*a* and 19*b*, and a print head 21. That is, the liquid discharge apparatus 1 in the second embodiment is different from that in the first embodiment in that the main substrate 11 and the print head 21 are electrically coupled to each other by the two cables 19*a* and 19*b*, and thus various signals are propagated in the cables 19*a* and 19*b*. In addition, the liquid discharge apparatus 1 in the second embodiment is different from that in the first embodiment in that the main substrate 11 includes a connector 12*a* to which one end of the cable 19*a* is attached and a connector 12*b* to which one end of the cable 19*b* is attached, and the print head 21 includes a connector 350 to which the other end of the cable 19*a* is attached and a connector 360 to which the other end of the cable 19*b* is attached.

Here, in the liquid discharge apparatus 1 in the second embodiment, a configuration in which a control mechanism 10 that outputs various signals for controlling an operation of the print head 21 and the cables 19*a* and 19*b* for propagating the various signals for controlling the operation of the print head 21 are provided is an example of a print head control circuit 15 that controls the operation of the print head 21 having a function to perform self-diagnosis in the second embodiment.

The cables 19*a* and 19*b* have a configuration similar to that of the cable 19 in the first embodiment except that the numbers of terminals 195 and 196 and wirings 197 are different. Therefore, detailed descriptions of the configuration of the cables 19*a* and 19*b* will not be repeated. In the following descriptions, a terminal 195-*k* provided in the cables 19*a* and 19*b* is referred to as a terminal 195*a*-*k* and a terminal 195*b*-*k*. A terminal 196-*k* is referred to as a terminal 196*a*-*k* and a terminal 196*b*-*k*. A wiring 197-*k* is referred to as a wiring 197*a*-*k* and a wiring 197*b*-*k*. A contact section 180-*k* is referred to as a contact section 180*a*-*k* and a contact section 180*b*-*k*. The terminals 195*a*-*k* and 195*b*-*k* are electrically coupled to connectors 12*a* and 12*b*, respectively. The terminals 196*a*-*k* and 196*b*-*k* are electrically coupled to the connectors 350 and 360 via the contact sections 180*a*-*k* and 180*b*-*k*, respectively.

In the second embodiment, descriptions will be made on the assumption that the print head 21 includes six driving signal selection circuits 200-1 to 200-6. Thus, six print data signals SI1 to SI6 respectively corresponding to the six driving signal selection circuits 200-1 to 200-6, six driving signals COM1 to COM6, and six reference voltage signals CGND1 to CGND6 are input to the print head 21 in the second embodiment.

Figure 22:
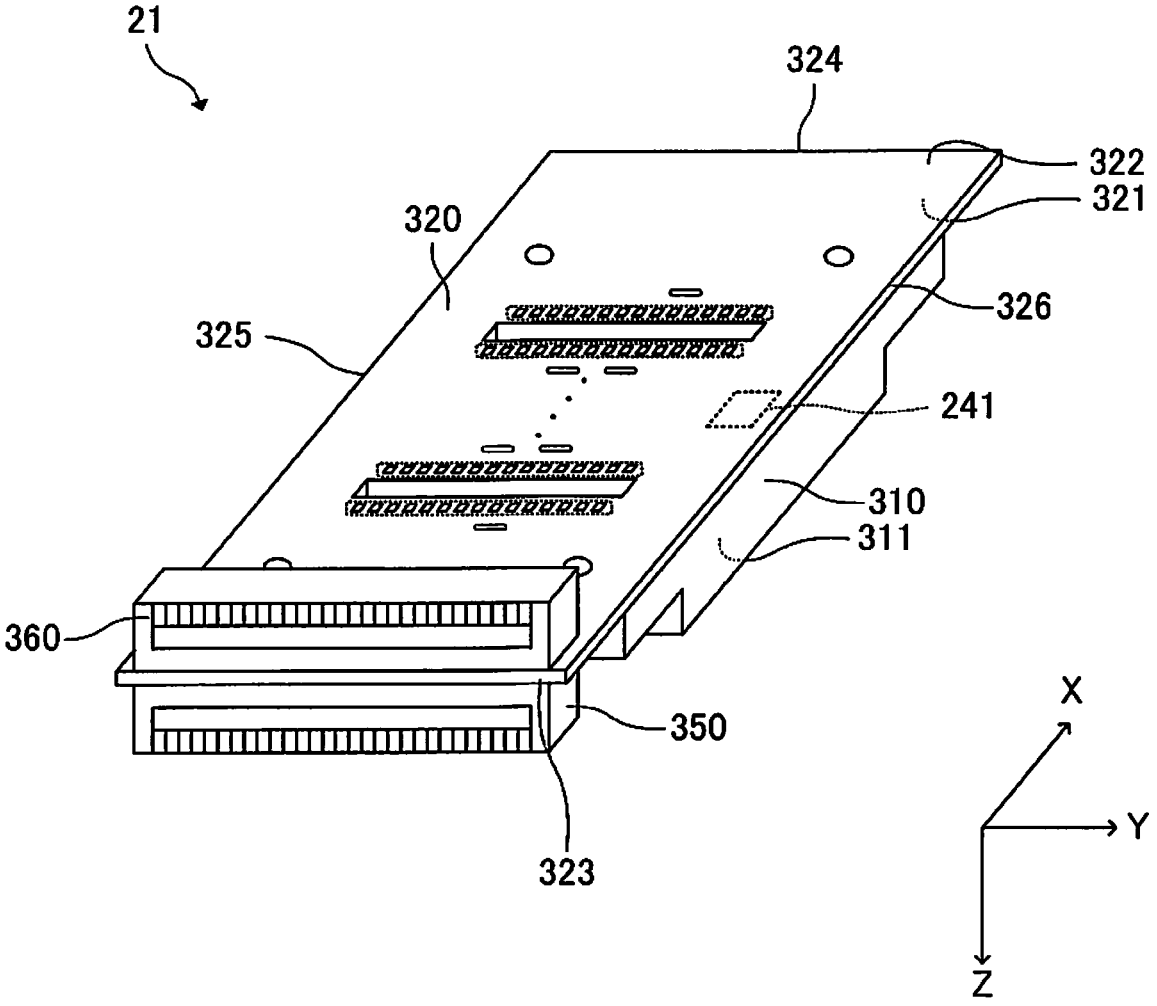
FIG. 22 is a perspective view illustrating a configuration of a print head in the second embodiment.

FIG. 22 is a perspective view illustrating a configuration of the print head 21 in the second embodiment. As illustrated in FIG. 22, the print head 21 includes a head 310 and a substrate 320. An ink discharge surface 311 on which the plurality of discharge sections 600 are formed is located on a lower surface of the head 310 in the Z-direction.

The substrate 320 has a surface 321 and a surface 322 facing the surface 321 and has a substantially rectangular shape formed by a side 323, a side 324 (facing the side 323 in the X-direction), a side 325, and a side 326 (facing the side 325 in the Y-direction). Similar to the first embodiment, an integrated circuit 241 constituting a diagnosis circuit 240 is provided on the side 326 side of the surface 321 of the substrate 320.

The connectors 350 and 360 are provided on the substrate 320. The connector 350 is provided along the side 323 on the surface 321 side of the substrate 320. The connector 360 is provided along the side 323 on the surface 322 side of the substrate 320.

Figure 23:
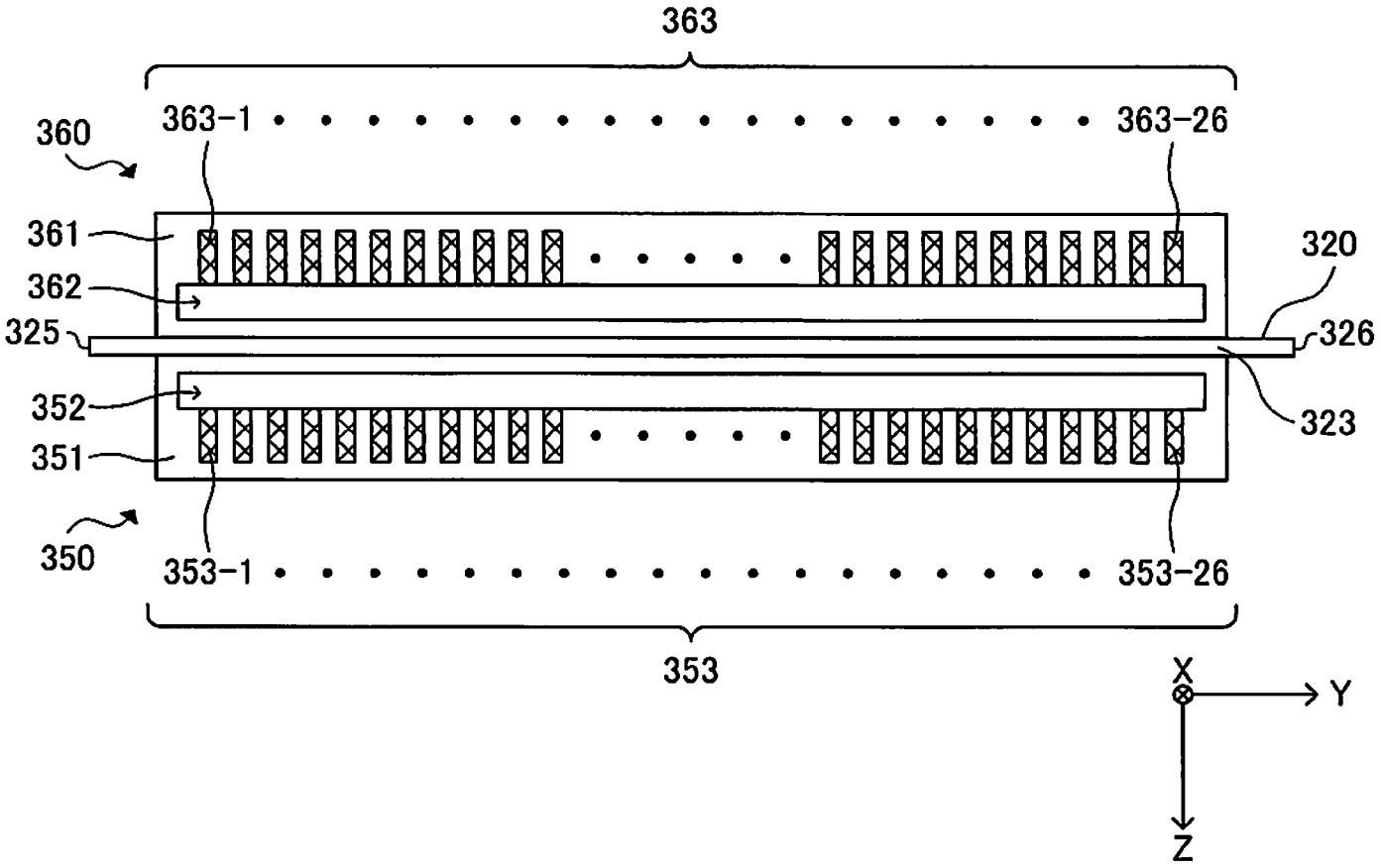
FIG. 23 is a diagram illustrating configurations of connectors in the second embodiment.

A configuration of the connectors 350 and 360 will be described with reference to FIG. 23. FIG. 23 is a diagram illustrating the configuration of the connectors 350 and 360 in the second embodiment. The connector 350 includes a housing 351, a cable attachment section 352 formed in the housing 351, and a plurality of terminals 353. The plurality of terminals 353 is aligned in parallel along the side 323. Specifically, 26 terminals 353 are provided along the side 323 to be aligned. Here, the 26 terminals 353 are referred to as terminals 353-1, 353-2, . . . , and 353-26 in order from the side 325 toward the side 326 in a direction along the side 323. The cable attachment section 352 is located on the substrate 320 side of the plurality of terminals 353 in the Z-direction. The cable 19*a* is attached to the cable attachment section 352. When the cable 19*a* is attached to the cable attachment section 352, terminals 196*a*-1 to 196*a*-26 in the cable 19*a* electrically come into contact with the terminals 353-1 to 353-26 in the connector 350, respectively. As illustrated in FIG. 18, in the connector 350, the plurality of terminals 353 may be located on the substrate 320 side of the cable attachment section 352 in the Z-direction.

The connector 360 includes a housing 361, a cable attachment section 362 formed in the housing 361, and a plurality of terminals 363. The plurality of terminals 363 is aligned in parallel along the side 323. Specifically, 26 terminals 363 are provided along the side 323 to be aligned. Here, the 26 terminals 363 are referred to as terminals 363-1, 363-2, . . . , and 363-26 in order from the side 325 toward the side 326 in a direction along the side 323. The cable attachment section 362 is located on the substrate 320 side of the plurality of terminals 363 in the Z-direction. The cable 19*b* is attached to the cable attachment section 362. When the cable 19*b* is attached to the cable attachment section 362, terminals 196*b*-1 to 196*b*-26 in the cable 19*b* electrically come into contact with the terminals 363-1 to 363-26 in the connector 360, respectively.

Next, details of a signal which are propagated in each of the cables 19*a* and 19*b* and is input to the print head 21 will be described with reference to FIGS. 24 and 25.

FIG. 24 is a diagram illustrating details of a signal propagated in the cable 19*a* in the second embodiment. As illustrated in FIG. 24, the cable 19*a* includes wirings for propagating driving signals COM1 to COM6, wirings for propagating reference voltage signals CGND1 to CGND6, wirings for propagating a temperature signal TH, a latch signal LAT, a clock signal SCK, a change signal CH, a print data signal SI1, and an abnormality signal XHOT, wirings for propagating diagnosis signals DIG-A to DIG-E, a wiring for propagating a voltage VHV, and a plurality of wirings for propagating a plurality of ground signals GND.

Specifically, the driving signals COM1 to COM6 and the reference voltage signals CGND1 to CGND6 are input from the terminals 195*a*-1 to 195*a*-12 to the cable 19*a* and are propagated in the wiring 197*a*-1 to 197*a*-12, respectively. Then, the driving signals COM1 to COM6 and the reference voltage signals CGND1 to CGND6 are input to the terminals 353-1 to 353-12 of the connector 350 via the terminals 196*a*-1 to 196*a*-12 and the contact sections 180*a*-1 to 180*a*-12, respectively.

The diagnosis signal DIG-A and the latch signal LAT are input from the terminal 195*a*-23 to the cable 19*a* and are propagated in the wiring 197*a*-23. Then, the diagnosis signal DIG-A and the latch signal LAT are input to the terminal 353-23 of the connector 350 via the terminal 196*a*-23 and the contact section 180*a*-23. That is, the wiring 197*a*-23 functions as a wiring for propagating the diagnosis signal DIG-A and a wiring for propagating the latch signal LAT. The terminal 353-23 functions as a terminal to which the diagnosis signal DIG-A is input and a terminal to which the latch signal LAT is input. The contact section 180*a*-23 is electrically in contact with the wiring for propagating the diagnosis signal DIG-A and is also electrically in contact with the wiring for propagating the latch signal LAT. The diagnosis signal DIG-A is an example of a second diagnosis signal in the second embodiment. The wiring 197*a*-23 for propagating the diagnosis signal DIG-A is an example of a second diagnosis signal propagation wiring in the second embodiment. The terminal 353-23 to which the diagnosis signal DIG-A is input is an example of a second terminal in the second embodiment. The contact section 180*a*-23 at which the wiring 197*a*-23 and the terminal 353-23 are electrically in contact with each other is an example of a second contact section in the second embodiment.

The diagnosis signal DIG-B and the clock signal SCK are input from the terminal 195*a*-21 to the cable 19*a* and are propagated in the wiring 197*a*-21. Then, the diagnosis signal DIG-B and the clock signal SCK are input to the terminal 353-21 of the connector 350 via the terminal 196*a*-21 and the contact section 180*a*-21. That is, the wiring 197*a*-21 functions as a wiring for propagating the diagnosis signal DIG-B and a wiring for propagating the clock signal SCK. The terminal 353-21 functions as a terminal to which the diagnosis signal DIG-B is input and a terminal to which the clock signal SCK is input. The contact section 180*a*-21 is electrically in contact with the wiring for propagating the diagnosis signal DIG-B and is also electrically in contact with the wiring for propagating the clock signal SCK. The diagnosis signal DIG-B is an example of a first diagnosis signal in the second embodiment. The wiring 197*a*-21 for propagating the diagnosis signal DIG-B is an example of a first diagnosis signal propagation wiring in the second embodiment. The terminal 353-21 to which the diagnosis signal DIG-B is input is an example of a first terminal in the second embodiment. The contact section 180*a*-21 at which the wiring 197*a*-21 and the terminal 353-21 are electrically in contact with each other is an example of a first contact section in the second embodiment.

The diagnosis signal DIG-C and the change signal CH are input from the terminal 195*a*-19 to the cable 19*a* and are propagated in the wiring 197*a*-19. The diagnosis signal DIG-C and the change signal CH are input to the terminal 353-19 of the connector 350 via the terminal 196*a*-19 and the contact section 180*a*-19. That is, the wiring 197*a*-19 functions as a wiring for propagating the diagnosis signal DIG-C and a wiring for propagating the change signal CH.

The terminal 353-19 functions as a terminal to which the diagnosis signal DIG-C is input and a terminal to which the change signal CH is input. The contact section 180*a*-19 is electrically in contact with the wiring for propagating the diagnosis signal DIG-C and is also electrically in contact with the wiring for propagating the change signal CH. The diagnosis signal DIG-C is an example of a third diagnosis signal in the second embodiment. The wiring 197*a*-19 for propagating the diagnosis signal DIG-C is an example of a third diagnosis signal propagation wiring in the second embodiment. The terminal 353-19 to which the diagnosis signal DIG-C is input is an example of a third terminal in the second embodiment. The contact section 180*a*-19 at which the wiring 197*a*-19 and the terminal 353-19 are electrically in contact with each other is an example of a third contact section in the second embodiment.

The diagnosis signal DIG-D and the print data signal SI1 are input from the terminal 195*a*-17 to the cable 19*a* and are propagated in the wiring 197*a*-17. Then, the diagnosis signal DIG-D and the print data signal SI1 are input to the terminal 353-17 of the connector 350 via the terminal 196*a*-17 and the contact section 180*a*-17. That is, the wiring 197*a*-17 functions as a wiring for propagating the diagnosis signal DIG-D and a wiring for propagating the print data signal SI1. The terminal 353-17 functions as a terminal to which the diagnosis signal DIG-D is input and a terminal to which the print data signal SI1 is input. The contact section 180*a*-17 is electrically in contact with the wiring for propagating the diagnosis signal DIG-D and is also electrically in contact with the wiring for propagating the print data signal SI1. The diagnosis signal DIG-D is an example of a fourth diagnosis signal in the second embodiment. The wiring 197*a*-17 for propagating the diagnosis signal DIG-D is an example of a fourth diagnosis signal propagation wiring in the second embodiment. The terminal 353-17 to which the diagnosis signal DIG-D is input is an example of a fourth terminal in the second embodiment. The contact section 180*a*-17 at which the wiring 197*a*-17 and the terminal 353-17 are electrically in contact with each other is an example of a fourth contact section in the second embodiment.

The diagnosis signal DIG-E and the abnormality signal XHOT are input to the terminal 353-15 of the connector 350, and then are input to the cable 19*a* via the contact section 180*a*-15 and the terminal 196*a*-15. The diagnosis signal DIG-E and the abnormality signal XHOT are propagated in the wiring 197*a*-15, and then are input from the terminal 195*a*-15 to the main substrate 11. That is, the wiring 197*a*-15 functions as a wiring for propagating the diagnosis signal DIG-E and a wiring for propagating the abnormality signal XHOT. The terminal 353-15 functions as a terminal to which the diagnosis signal DIG-E is input and a terminal to which the abnormality signal XHOT is input. The contact section 180*a*-15 is electrically in contact with the wiring for propagating the diagnosis signal DIG-E and is also electrically in contact with the wiring for propagating the abnormality signal XHOT. The diagnosis signal DIG-E is an example of a fifth diagnosis signal in the second embodiment. The wiring 197*a*-15 for propagating the diagnosis signal DIG-E is an example of a fifth diagnosis signal propagation wiring in the second embodiment. The terminal 353-15 to which the diagnosis signal DIG-E is input is an example of a fifth terminal in the second embodiment. The contact section 180*a*-15 at which the wiring 197*a*-15 and the terminal 353-15 are electrically in contact with each other is an example of a fifth contact section in the second embodiment.

The temperature signal TH is input to the terminal 353-25 of the connector 350, and then is input to the cable 19*a* via the terminal 196*a*-25 and the contact section 180*a*-25. The temperature signal TH is propagated in the wiring 197*a*-25, and then is input from the terminal 195*a*-25 to the main substrate 11.

The voltage VHV is input from the terminal 195*a*-13 to the cable 19*a* and is propagated in the wiring 197*a*-13. Then, the voltage VHV is input to the terminal 353-13 of the connector 350 via the terminal 196*a*-13 and the contact section 180*a*-13. The voltage VHV is an example of a third voltage signal in the second embodiment. The wiring 197*a*-13 for propagating the voltage VHV is an example of a third voltage signal propagation wiring in the second embodiment. The terminal 353-13 to which the voltage VHV is input is an example of an eighth terminal in the second embodiment. The contact section 180*a*-13 at which the wiring 197*a*-13 and the terminal 353-13 are electrically in contact with each other is an example of an eighth contact section in the second embodiment.

The ground signal GND is input from each of the terminals 195*a*-14, 195*a*-16, 195*a*-18, 195*a*-20, 195*a*-22, 195*a*-24, and 195*a*-26 to the cable 19*a* and is propagated in each of the wirings 197*a*-14, 197*a*-16, 197*a*-18, 197*a*-20, 197*a*-22, 197*a*-24, and 197*a*-26. Then, the ground signal GND is input to each of the terminals 353-14, 353-16, 353-18, 353-20, 353-22, 353-24, and 353-26 of the connector 350 via each of the terminals 196*a*-14, 196*a*-16, 196*a*-18, 196*a*-20, 196*a*-22, 196*a*-24, and 196*a*-26 and each of the contact sections 180*a*-14, 180*a*-16, 180*a*-18, 180*a*-20, 180*a*-22, 180*a*-24, and 180*a*-26.

Next, details of a signal propagated in the cable 19*b* will be described with reference to FIG. 25. FIG. 25 is a diagram illustrating details of a signal propagated in a cable 19*b* in the second embodiment. As illustrated in FIG. 25, the cable 19*b* includes wirings for propagating the driving signals COM1 to COM6, wirings for propagating the reference voltage signals CGND1 to CGND6, wirings for propagating print data signals SI2 to SI6, wirings for propagating voltages VDD1 and VDD2, and a plurality of wirings for propagating a plurality of ground signals GND.

Specifically, the driving signals COM1 to COM6 and the reference voltage signals CGND1 to CGND6 are input from the terminals 195*b*-1 to 195*b*-12 to the cable 19*b* and are propagated in the wiring 197*b*-1 to 197*b*-12, respectively. Then, the driving signals COM1 to COM6 and the reference voltage signals CGND1 to CGND6 are input to the terminals 363-1 to 363-12 of the connector 360 via the terminals 196*b*-1 to 196*b*-12 and the contact sections 180*b*-1 to 180*b*-12, respectively.

The print data signals SI2 to SI6 are input from the terminals 195*b*-24, 195*b*-22, 195*b*-20, 195*b*-18, and 195*b*-16 to the cable 19*b*, and are propagated in the wirings 197*b*-24, 197*b*-22, 197*b*-20, 197*b*-18, and 197*b*-16, respectively. Then, the print data signals S12 to S16 are input to the terminals 363-24, 363-22, 363-20, 363-18, and 363-16 of the connector 360 via the terminals 196*b*-24, 196*b*-22, 196*b*-20, 196*b*-18, and 196*b*-16 and the contact sections 180*b*-24, 180*b*-22, 180*b*-20, 180*b*-18, and 180*b*-16, respectively.

The voltage VDD1 is input from the terminal 195*b*-26 to the cable 19*b* and is propagated in the wiring 197*b*-26. Then, the voltage VDD1 is input to the terminal 363-26 of the connector 360 via the terminal 196*b*-26 and the contact section 180*b*-26. Here, the voltage VDD1 is an example of a first voltage signal in the second embodiment. The wiring 197*b*-26 for propagating the voltage VDD1 is an example of a first voltage signal propagation wiring in the second embodiment. The terminal 363-26 to which the voltage VDD1 is input is an example of a sixth terminal in the second embodiment. The contact section 180*b*-26 at which the wiring 197*b*-26 and the terminal 363-26 are electrically in contact with each other is an example of a sixth contact section in the second embodiment.

The voltage VDD2 is input from the terminal 195*b*-21 to the cable 19*b* and is propagated in the wiring 197*b*-21. Then, the voltage VDD2 is input to the terminal 363-21 of the connector 360 via the terminal 196*b*-21 and the contact section 180*b*-21. The voltage VDD2 is an example of a second voltage signal in the second embodiment. The wiring 197*b*-21 for propagating the voltage VDD2 is an example of a second voltage signal propagation wiring in the second embodiment. The terminal 363-21 to which the voltage VDD2 is input is an example of a seventh terminal in the second embodiment. The contact section 180*b*-21 at which the wiring 197*b*-21 and the terminal 363-21 are electrically in contact with each other is an example of a seventh contact section in the second embodiment.

The ground signal GND is input to the cable 19*a* from each of the terminals 195*b*-13, 195*b*-15, 195*b*-17, 195*b*-19, 195*b*-23, and 195*b*-25 and is propagated in each of the wirings 197*b*-13, 197*b*-15, 197*b*-17, 197*b*-19, 197*b*-23, and 197*b*-25. Then, the ground signal GND is input to each of the terminals 363-13, 363-15, 363-17, 363-19, 363-23, and 363-25 of the connector 360 via each of the terminals 196*b*-13, 196*b*-15, 196*b*-17, 196*b*-19, 196*b*-23, and 196*b*-25 and each of the contact sections 180*b*-13, 180*b*-15, 180*b*-17, 180*b*-19, 180*b*-23, and 180*b*-25.

In the liquid discharge apparatus 1 in the second embodiment, as illustrated in FIGS. 24 and 25, in the print head control circuit 15, the wiring 197*a*-21 in which the diagnosis signal DIG-B is propagated and the wiring 197*b*-21 in which the voltage VDD2 having a stable potential is propagated are located to overlap each other in a direction intersecting a direction in which the wiring 197*a*-21 and the wiring 197*a*-23 are aligned. In other words, in the print head control circuit 15, the wiring 197*a*-21 in which the diagnosis signal DIG-B is propagated and the wiring 197*b*-21 in which the voltage VDD2 having a stable potential is propagated are provided in the cable 19*a* and the cable 19*b* different from each other and are located to face each other.

In the print head 21, the terminal 353-21 to which the diagnosis signal DIG-B is input and the terminal 363-21 to which the voltage VDD2 having a stable potential is input are located to overlap each other in a direction intersecting a direction in which the terminal 353-21 and the terminal 353-23 are aligned. In other words, in the print head 21, the terminal 353-21 to which the diagnosis signal DIG-B is input and the terminal 363-21 to which the voltage VDD2 is input are provided in the connector 350 and the connector 360 different from each other and are located to face each other.

In the liquid discharge apparatus 1, the contact section 180*a*-21 to which the diagnosis signal DIG-B is input and the contact section 180*b*-21 to which the voltage VDD2 having a stable potential is input are located to overlap each other in a direction intersecting a direction in which the contact section 180*a*-21 and the contact section 180*a*-23 are aligned. In other words, in the liquid discharge apparatus 1, the contact section 180*a*-21 to which the diagnosis signal DIG-B is input and the contact section 180*b*-21 to which the voltage VDD2 is input are provided in the connector 350 and the connector 360 different from each other and are located to face each other.

As described above, the wiring 197*a*-21 in which the diagnosis signal DIG-B being one of the signals for diagnosing whether or not normal discharge of the ink from the print head 21 is possible and the wiring 197*b*-21 in which the voltage VDD2 having a stable potential is propagated are located to overlap each other in the direction intersecting the direction in which the wiring 197*a*-21 and the wiring 197*a*-23 are aligned. Thus, similar to the first embodiment, the concern that the waveform of the diagnosis signal DIG-B is distorted is reduced. Similarly, since the terminal 353-21 to which the diagnosis signal DIG-B is input and the terminal 363-21 to which the voltage VDD2 having a stable potential is input are located to overlap each other in the direction intersecting the direction in which the terminal 353-21 and the terminal 353-23 are aligned, the concern that the waveform of the diagnosis signal DIG-B is distorted is reduced, similar to the first embodiment. Similarly, since the contact section 180*a*-21 to which the diagnosis signal DIG-B is input and the contact section 180*b*-21 to which the voltage VDD2 having a stable potential is input are located to overlap each other in the direction intersecting the direction in which the contact section 180*a*-21 and the contact section 180*a*-23 are aligned, the concern that the waveform of the diagnosis signal DIG-B is distorted is reduced, similar to the first embodiment. Accordingly, it is possible to reduce a concern that the self-diagnosis function of the print head 21 does not normally operate.

Here, the phrase of being located to face each other may have the meaning that the substrate 320, a housing 351 of the connector 350, a housing 361 of the connector 360, or the like is interposed between the wiring 197*a*-*k* and the wiring 197*b*-*k*, between the terminal 353-*k* and the terminal 363-*k*, and between the contact section 180*a*-*k* and the contact section 180*b*-*k*, in addition to the meaning that a space is provided between the wiring 197*a*-*k* and the wiring 197*b*-*k*, between the terminal 353-*k* and the terminal 363-*k*, and between the contact section 180*a*-*k* and the contact section 180*b*-*k*. In other words, the phrase of being located to face each other means that another wiring 197 is not located between the wiring 197*a*-*k* and the wiring 197*b*-*k*, other terminals 353 and 363 are not located between the terminal 353-*k* and the terminal 363-*k*, and another contact section 180 is not located between the contact section 180*a*-*k* and the contact section 180*b*-*k*, when viewed from a specific direction.

That is, when the wiring 197*a*-21 in which the diagnosis signal DIG-B being one of the signals for diagnosing whether or not normal discharge of the ink from the print head 21 is possible is propagated and the wiring 197*b*-21 in which the voltage VDD2 having a stable potential is propagated are provided in the cables 19*a* and 19*b* different from each other, the wiring 197*a*-21 and the wiring 197*b*-21 are located in the vicinity of each other. In other words, the shortest distance between the wiring 197*a*-21 provided in the cable 19*a* and the wiring 197*b*-21 provided in the cable 19*b* is shorter than the shortest distance between the wiring 197*a*-21 provided in the cable 19*a* and the wiring provided in the cable 19*b* other than the wiring 197*b*-21.

When the terminal 353-21 to which the diagnosis signal DIG-B being one of the signals for diagnosing whether or not normal discharge of the ink from the print head 21 is possible is input and the terminal 363-21 to which the voltage VDD2 having a stable potential is input are provided in the connectors 350 and 360 different from each other, the terminal 353-21 and the terminal 363-21 are located in the vicinity of each other. In other words, the shortest distance between the terminal 353-21 provided in the connector 350 and the terminal 363-21 provided in the connector 360 is shorter than the shortest distance between the terminal 353-21 and the terminal 363 provided in the connector 360 other than the terminal 363-21.

Similarly, when the contact section 180*a*-21 to which the diagnosis signal DIG-B being one of the signals for diagnosing whether or not normal discharge of the ink from the print head 21 is possible is input is provided in the plurality of contact sections 180*a* at which the cable 19*a* and the connector 350 are electrically in contact with each other, and the contact section 180*b*-21 to which the voltage VDD2 having a stable potential is input are provided in the plurality of contact sections 180*b* which is different from the plurality of contact sections 180*a* and at which the cable 19*b* and the connector 360 are electrically in contact with each other, the contact section 180*a*-21 and the contact section 180*b*-21 are located in the vicinity of each other. In other words, the shortest distance between the contact section 180*a*-21 in the plurality of contact sections 180*a* at which the cable 19*a* and the connector 350 are electrically in contact with each other, and the contact section 180*b*-21 in the plurality of contact sections 180*b* at which the cable 19*b* and the connector 360 are electrically in contact with each other is shorter than the shortest distance between the contact section 180*a*-21 and the contact section 180*b* in the plurality of contact sections 180*b* other than the contact section 180*b*-21.

In the liquid discharge apparatus 1 in the second embodiment, the descriptions are made on the assumption that the wiring 197*a-k* of the cable 19*a* and the wiring 197*b-k* of the cable 19*b* are located to face each other, the terminal 353-*k* of the connector 350 and the terminal 363-*k* of the connector 360 are located to face each other, and the contact section 180*a-k* and the contact section 180*b-k* are located to face each other. However, the embodiment is not limited thereto.

As illustrated in FIGS. 24 and 25, the wiring 197*a*-21 in which the diagnosis signal DIG-B is propagated and the wiring 197*a*-22 in which the ground signal GND is propagated are preferably located to be adjacent to each other in the direction in which the wiring 197*a*-21 and the wiring 197*a*-23 are aligned. In other words, preferably, the wiring 197*a*-21 in which the diagnosis signal DIG-B is propagated and the wiring 197*a*-22 in which the ground signal GND is propagated are provided in the same cable 19*a* and are located to be adjacent to each other. The terminal 353-21 to which the diagnosis signal DIG-B is input and the terminal 353-22 to which the ground signal GND is input are preferably located to be adjacent to each other in the direction in which the terminal 353-21 and the terminal 353-23 are aligned. In other words, preferably, the terminal 353-21 to which the diagnosis signal DIG-B is input and the terminal 353-22 to which the ground signal GND is input are provided in the same connector 350 and are located to be adjacent to each other. The contact section 180*a*-21 to which the diagnosis signal DIG-B is input and the contact section 180*a*-22 to which the ground signal GND is input are preferably located to be adjacent to each other in the direction in which the contact section 180*a*-21 and the contact section 180*a*-23 are aligned. In other words, preferably, the contact section 180*a*-21 to which the diagnosis signal DIG-B is input and the contact section 180*a*-22 to which the ground signal GND is input are provided in the plurality of contact sections 180*a* at which the cable 19*a* and the connector 350 are electrically in contact with each other, and are located to be adjacent to each other.

Thus, the wiring 197*a*-22 in which the ground signal GND is propagated, the terminal 353-22 to which the ground signal GND is input, and the contact section 180*a*-22 to which the ground signal GND is input function as a shield that reduces interference of other signals with the voltage VDD2. Accordingly, it is possible to more reduce the concern that the waveform of the diagnosis signal DIG-B is distorted, and thus to more reduce the concern that the self-diagnosis function of the print head 21 does not normally operate. The wiring 197*a*-22 in which the ground signal GND is propagated is an example of a first ground signal propagation wiring in the second embodiment. The terminal 353-22 to which the ground signal GND is input is an example of a first ground terminal in the second embodiment. The contact section 180*a*-22 at which the wiring 197*a*-22 and the terminal 353-22 are electrically in contact with each other is an example of a first ground contact section in the second embodiment.

As illustrated in FIGS. 23 and 24, preferably, the wiring 197*b*-21 in which the voltage VDD2 is propagated and the wiring 197*a*-13 in which the voltage VHV is propagated are not located to be adjacent to each other in a direction perpendicular to the direction in which the wiring 197*a*-21 and the wiring 197*a*-23 are aligned. In other words, preferably, the wiring 197*b*-21 in which the voltage VDD2 is propagated and the wiring 197*a*-13 in which the voltage VHV is propagated are provided in the cable 19*a* and the cable 19*b* different from each other and are not located to face each other. Preferably, the terminal 363-21 to which the voltage VDD2 is input and the terminal 353-13 to which the voltage VHV is input are not located to be adjacent to each other in a direction perpendicular to the direction in which the terminal 353-21 and the terminal 353-23 are aligned. In other words, preferably, the terminal 363-21 to which the voltage VDD2 is input and the terminal 353-13 to which the voltage VHV is input are provided in the connector 350 and the connector 360 different from each other and are not located to face each other. Preferably, the contact section 180*b*-21 to which the voltage VDD2 is input and the contact section 180*a*-13 to which the voltage VHV is input are not located to be adjacent to each other in a direction perpendicular to the direction in which the contact section 180*a*-21 and the contact section 180*a*-23 are aligned. In other words, preferably, the contact section 180*b*-21 to which the voltage VDD2 is input and the contact section 180*a*-13 to which the voltage VHV is input are provided in the plurality of contact sections 180*a* at which the cable 19*a* and the connector 350 are electrically in contact with each other, and the plurality of contact sections 180*b* which is different from the plurality of contact sections 180*a* and at which the cable 19*b* different from the cable 19*a* and the connector 360 different from the connector 350 are electrically in contact with each other, and are not located to face each other.

Further, in this case, the wiring 197*a*-13 in which the voltage VHV is propagated and the wiring 197*b*-13 in which the ground signal GND is propagated are preferably located to be adjacent to each other in the direction intersecting the direction in which the wiring 197*a*-21 and the wiring 197*a*-23 are aligned. In other words, preferably, the wiring 197*a*-13 in which the voltage VHV is propagated and the wiring 197*b*-13 in which the ground signal GND is propagated are provided in the cable 19*a* and the cable 19*b* different from each other and are located to face each other. The terminal 353-13 to which the voltage VHV is input and the terminal 363-13 to which the ground signal GND is input are preferably located to be adjacent to each other in the direction intersecting the direction in which the terminal 353-21 and the terminal 353-23 are aligned. In other words, preferably, the terminal 353-13 to which the voltage VHV is input and the terminal 363-13 to which the ground signal GND is input are provided in the connector 350 and the connector 360 different from each other and are located to face each other. The contact section 180*a*-13 to which the voltage VHV is input and the contact section 180*b*-13 to which the ground signal GND is input are preferably located to be adjacent to each other in the direction intersecting the direction in which the contact section 180*a*-21 and the contact section 180*a*-23 are aligned. In other words, preferably, the contact section 180*a*-13 to which the voltage VHV is input and the contact section 180*b*-13 to which the ground signal GND is input are provided in the plurality of contact sections 180*a* at which the cable 19*a* and the connector 350 are electrically in contact with each other and the plurality of contact sections 180*b* which is different from the plurality of contact sections 180*a* and at which the cable 19*b* different from the cable 19*a* and the connector 360 different from the connector 350 are electrically in contact with each other, and are located to face each other.

The voltage VHV has a voltage value larger than the voltages VDD1 and VDD2. Therefore, when a noise component is superimposed on the voltage VHV, the noise component included in the voltage VHV may interfere with the signal propagated in the wiring facing the wiring in which the voltage VHV is propagated and the signal input to the terminal facing the terminal to which the voltage VHV is input. Therefore, when the wiring 197*b*-21 for propagating the voltage VDD2 having a stable potential is located to face the wiring 197*a*-13 in which the voltage VHV is propagated, the noise component included in the voltage VHV may interfere with the voltage VDD2. Thus, when the noise component interferes with the voltage VDD2, the waveform of the diagnosis signal DIG-B may be distorted.

As illustrated in FIGS. 24 and 25, in the print head control circuit 15, the print head 21, and the liquid discharge apparatus 1 in the second embodiment, the wiring 197*b*-21 in which the voltage VDD2 is propagated is not provided to face the wiring 197*a*-13 in which the voltage VHV is propagated, the terminal 363-21 to which the voltage VDD2 is input is not provided to face the terminal 353-13 to which the voltage VHV is input, and the contact section 180*b*-21 to which the voltage VDD2 is input is not provided to face the contact section 180*a*-13 to which the voltage VHV is input. With such a configuration, it is possible to reduce a concern that the voltage VHV interferes with the voltage VDD2 being a signal having a stable potential.

Further, the wiring 197*b*-13 in which the ground signal GND is propagated is provided to face the wiring 197-11 in which the voltage VHV is propagated, the terminal 363-13 to which the ground signal GND is input is provided to face the terminal 353-13 to which the voltage VHV is input, and the contact section 180*b*-13 to which the ground signal GND is input is provided to face the contact section 180*a*-13 to which the voltage VHV is input. With such a configuration, similar to the first embodiment, it is possible to reduce the concern that the voltage VHV interferes with other signals including the voltage VDD2. The wiring 197*b*-13 in which the ground signal GND is propagated is an example of a second ground signal propagation wiring in the second embodiment. The terminal 363-13 to which the ground signal GND is input via the wiring 197*b*-13 is an example of a second ground terminal in the second embodiment. The contact section 180*b*-13 at which the wiring 197*b*-13 and the terminal 363-13 are electrically in contact with each other is an example of a second ground signal contact section in the second embodiment.

Here, the connector 350 which is provided in the print head 21 and has the terminal 353-21, the terminal 353-23, the terminal 353-19, and the terminal 353-17 is an example of a first connector in the second embodiment.

3. Third Embodiment

Next, a liquid discharge apparatus 1, a print head control circuit 15, and a print head 21 according to a third embodiment will be described. When the liquid discharge apparatus 1, the print head control circuit 15, and the print head 21 in the third embodiment are described, components similar to those in the first embodiment are denoted by the same reference signs, and descriptions thereof will not be repeated or will be briefly made.

Figure 26:
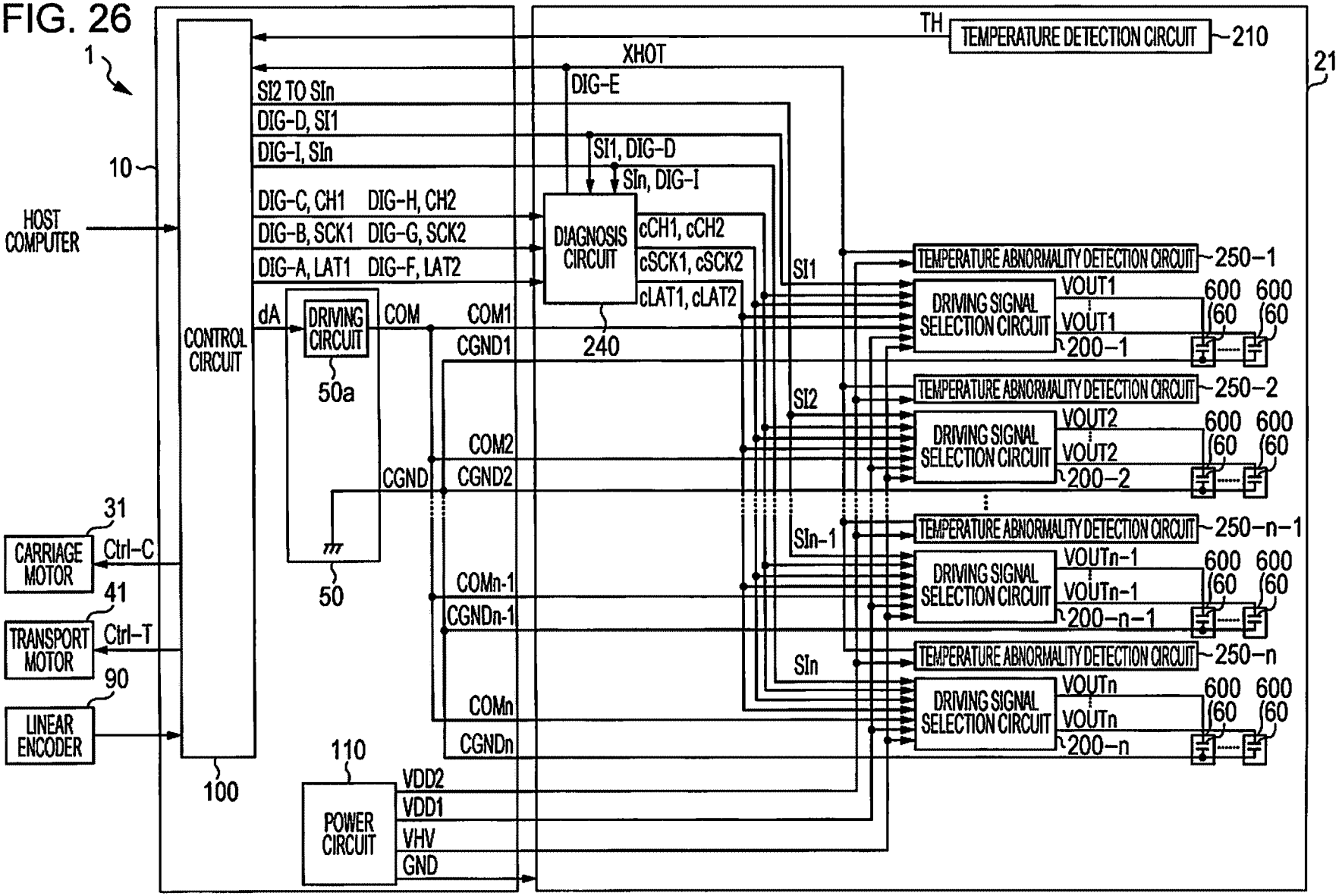
FIG. 26 is a block diagram illustrating an electrical configuration of a liquid discharge apparatus according to a third embodiment.

FIG. 26 is a block diagram illustrating an electrical configuration of the liquid discharge apparatus 1 in the third embodiment. As illustrated in FIG. 26, a control circuit 100 in the third embodiment is different from that in the first embodiment in that the control circuit 100 generates two latch signals LAT1 and LAT2 for defining a discharge timing of the print head 21, two change signals CH1 and CH2 for defining a waveform switching timing of the driving signal COM, and two clock signals SCK1 and SCK2 for defining a timing at which a print data signal SI is input, and outputs the generated signals to the print head 21. The control circuit 100 in the third embodiment is different from that in the first embodiment in that the control circuit 100 generates diagnosis signals DIG-A to DIG-D and DIG-F to DIG-I used when the print head 21 diagnoses whether or not normal discharge of a liquid is possible, and outputs the generated signals to the print head 21.

In the third embodiment, in the liquid discharge apparatus 1, the diagnosis signal DIG-A and the latch signal LAT1 are output to a diagnosis circuit 240 in the print head 21 via a common wiring. The diagnosis signal DIG-B and the clock signal SCK1 are output to the diagnosis circuit 240 via a common wiring. The diagnosis signal DIG-C and the change signal CH1 are output to the diagnosis circuit 240 via a common wiring. The diagnosis signal DIG-D and the print data signal SI1 are output to the diagnosis circuit 240 via a common wiring. The diagnosis signal DIG-F and the latch signal LAT2 are output to the diagnosis circuit 240 via a common wiring. The diagnosis signal DIG-G and the clock signal SCK2 are output to the diagnosis circuit 240 via a common wiring. The diagnosis signal DIG-H and the change signal CH2 are output to the diagnosis circuit 240 via a common wiring. The diagnosis signal DIG-I and the print data signal SIn are output to the diagnosis circuit 240 via a common wiring.

The diagnosis circuit 240 diagnoses whether or not normal discharge of the ink is possible, based on the diagnosis signals DIG-A to DIG-D and the diagnosis signals DIG-F to DIG-I. When the diagnosis circuit 240 diagnoses that the normal discharge of the ink is possible in the print head 21, based on the diagnosis signals DIG-A to DIG-D, the latch signal LAT1, the clock signal SCK1, and the change signal CH1 input along with the diagnosis signals DIG-A to DIG-C via the common wirings are output as a latch signal cLAT1, a clock signal cSCK1, and a change signal cCH1. When the diagnosis circuit 240 diagnoses that the normal discharge of the ink is possible in the print head 21, based on the diagnosis signals DIG-F to DIG-I, the latch signal LAT2, the clock signal SCK2, and the change signal CH2 input along with the diagnosis signals DIG-F to DIG-H via the common wirings are output as a latch signal cLAT2, a clock signal cSCK2, and a change signal cCH2.

Here, the print data signal SI1 input along with the diagnosis signal DIG-D via the common wiring among the signals input to the diagnosis circuit 240 is branched in the print head 21. One branched signal is input to the diagnosis circuit 240, and the other is input to the driving signal selection circuit 200-1. The print data signal SIn input along with the diagnosis signal DIG-I via the common wiring among the signals input to the diagnosis circuit 240 is branched in the print head 21. One branched signal is input to the diagnosis circuit 240, and the other is input to the driving signal selection circuit **200-*n***.

Figure 27:
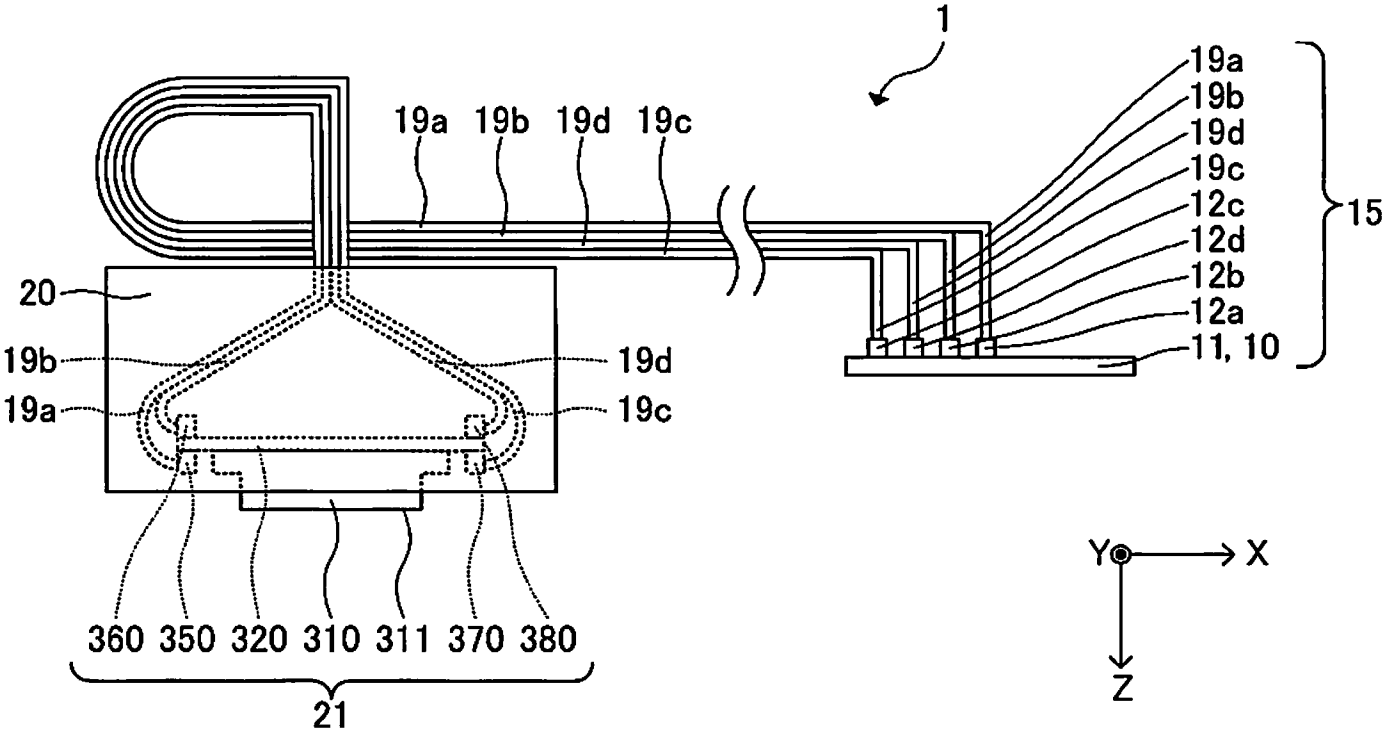
FIG. 27 is a schematic diagram illustrating an internal configuration of the liquid discharge apparatus in the third embodiment when viewed from the Y-direction.

FIG. 27 is a schematic diagram illustrating an internal configuration of the liquid discharge apparatus 1 in the third embodiment when viewed from the Y-direction. As illustrated in FIG. 27, the liquid discharge apparatus 1 in the third embodiment includes a main substrate 11, cables **19*a*, 19*b*, 19*c*, and 19*d*, and a print head 21. That is, the liquid discharge apparatus 1 in the third embodiment is different from that in the first embodiment in that the main substrate 11 and the print head 21 are electrically coupled to each other by the four cables 19*a*, 19*b*, 19*c*, and 19*d*, and various signals are propagated in the four cables 19*a*, 19*b*, 19*c*, and 19*d*. The liquid discharge apparatus 1 in the third embodiment is different from that in the first embodiment in that the main substrate 11 includes a connector 12*a* to which one end of the cable 19*a* is attached, a connector 12*b* to which one end of the cable 19*b* is attached, a connector 12*c* to which one end of the cable 19*c* is attached, and a connector 12*d* to which one end of the cable 19*d* is attached, and the print head 21 includes a connector 350 to which the other end of the cable 19*a* is attached, a connector 360 to which the other end of the cable 19*b* is attached, a connector 370 to which the other end of the cable 19*c* is attached, and a connector 380 to which the other end of the cable 19*d*** is attached.

Here, in the liquid discharge apparatus 1 in the third embodiment, a configuration in which a control mechanism 10 that outputs various signals for controlling an operation of the print head 21 and the cables **19*a*, 19*b*, 19*c*, and 19*d* for propagating the various signals for controlling the operation of the print head 21 are provided is an example of a print head control circuit 15 that controls the operation of the print head 21** having a function to perform self-diagnosis in the third embodiment.

The cables **19*a*, 19*b*, 19*c*, and 19*d* have a configuration similar to that of the cable 19 in the first embodiment except that the numbers of terminals 195 and 196 and wirings 197 are different. Therefore, detailed descriptions of the configuration of the cables 19*a*, 19*b*, 19*c*, and 19*d* will not be repeated. In the following descriptions, a terminal 195-*k* provided in the cables 19*a*, 19*b*, 19*c*, and 19*d* is referred to as terminals 195*a*-*k*, 195*b*-*k*, 195*c*-*k*, and 195*d*-*k*. A terminal 196-*k* is referred to as terminals 196*a*-*k*, 196*b*-*k*, 196*c*-*k*, and 196*d*-*k*. A wiring 197-*k* is referred to as wirings 197*a*-*k*, 197*b*-*k*, 197*c*-*k*, and 197*d*-*k*. A contact section 180-*k* is referred to as contact sections 180*a*-*k*, 180*b*-*k*, 180*c*-*k*, and 180*d*-*k*. The terminals 195*a*-*k*, 195*b*-*k*, 195*c*-*k*, and 195*b*-*k* are electrically coupled to the connectors 12*a*, 12*b*, 12*c*, and 12*d*, respectively. The terminals 196*a*-*k*, 196*b*-*k*, 196*c*-*k*, and 196*d*-*k* are electrically coupled to the connectors 350, 360, 370, and 380 via the contact sections 180*a*-*k*, 180*b*-*k*, 180*c*-*k*, and 180*d*-*k***, respectively.

In the third embodiment, descriptions will be made on the assumption that the print head 21 includes ten driving signal selection circuits 200-1 to 200-10. Thus, 10 print data signals SI1 to SI10 respectively corresponding to the ten driving signal selection circuits 200-1 to 200-10, 10 driving signals COM1 to COM10, and 10 reference voltage signals CGND1 to CGND10 are input to the print head 21 in the third embodiment.

Figure 28:
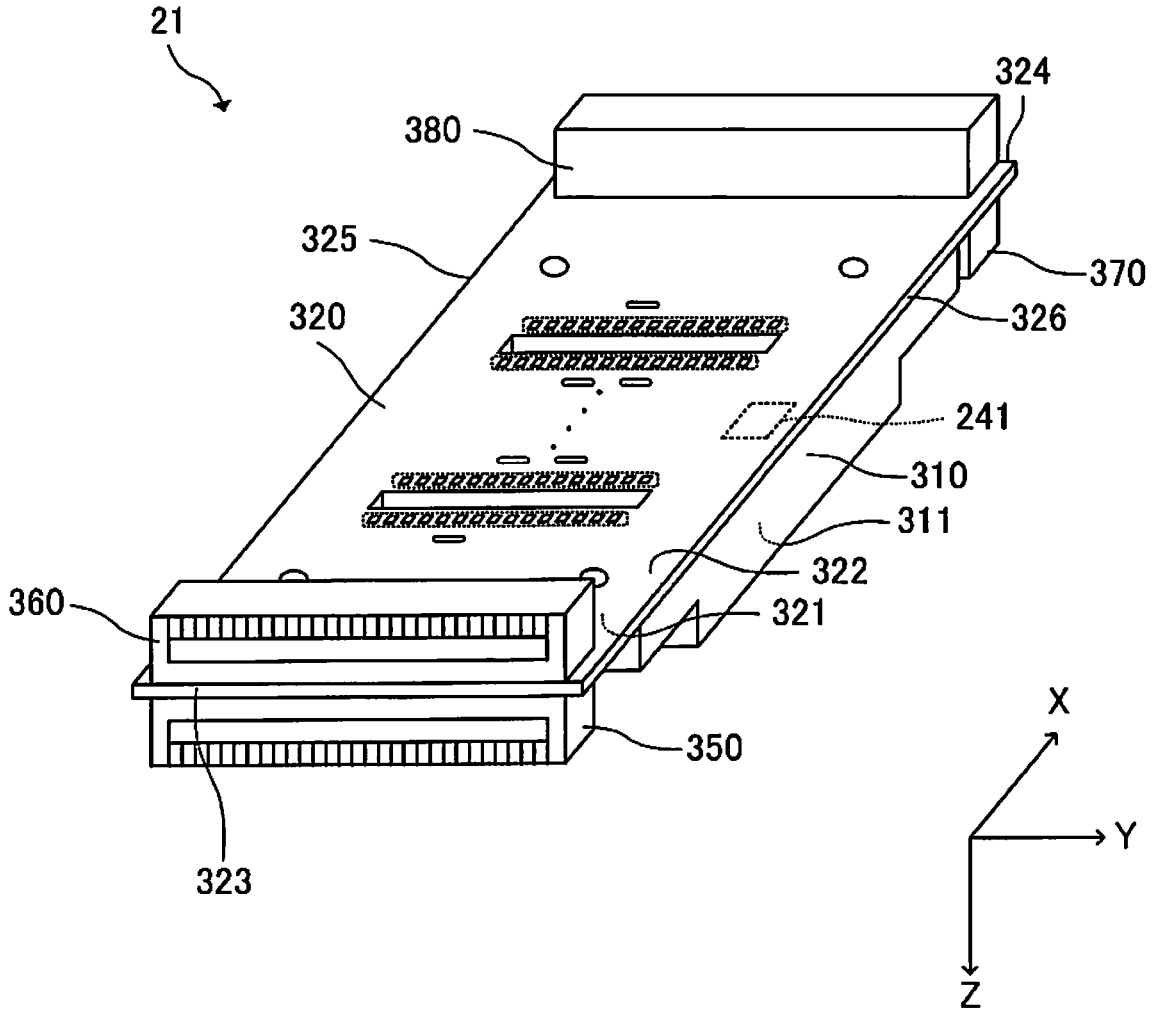
FIG. 28 is a perspective view illustrating a configuration of a print head in the third embodiment.

FIG. 28 is a perspective view illustrating a configuration of the print head 21 in the third embodiment. As illustrated in FIG. 28, the print head 21 includes a head 310 and a substrate 320. An ink discharge surface 311 on which the plurality of discharge sections 600 are formed is located on a lower surface of the head 310 in the Z-direction.

The substrate 320 has a surface 321 and a surface 322 facing the surface 321 and has a substantially rectangular shape formed by a side 323, a side 324 (facing the side 323 in the X-direction), a side 325, and a side 326 (facing the side 325 in the Y-direction). Similar to the first embodiment, an integrated circuit 241 constituting a diagnosis circuit 240 is provided on the side 326 side of the surface 321 of the substrate 320.

The connectors 350, 360, 370, and 380 are provided on the substrate 320. The connector 350 is provided along the side 323 on the surface 321 side of the substrate 320. The connector 360 is provided along the side 323 on the surface 322 side of the substrate 320. Here, the third embodiment is different from the second embodiment in that the number of a plurality of terminals included in each of the connector 350 and the connector 360 is 20. Other components of the connector 350 or the connector 360 are similar to those illustrated in FIG. 23. Therefore, detailed descriptions of the connector 350 and the connector 360 in the third embodiment will not be repeated. In the third embodiment, 20 terminals 353 provided in the connector 350 to be aligned are referred to as terminals 353-1, 353-2, . . . , and 353-20 in order from the side 325 toward the side 326 in a direction along the side 323. 20 terminals 363 provided in the connector 360 to be aligned are referred to as terminals 363-1, 363-2, . . . , and 363-20 in order from the side 325 toward the side 326 in a direction along the side 323.

The connector 370 is provided along the side 324 on the surface 321 side of the substrate 320. The connector 380 is provided along the side 324 on the surface 322 side of the substrate 320.

Figure 29:
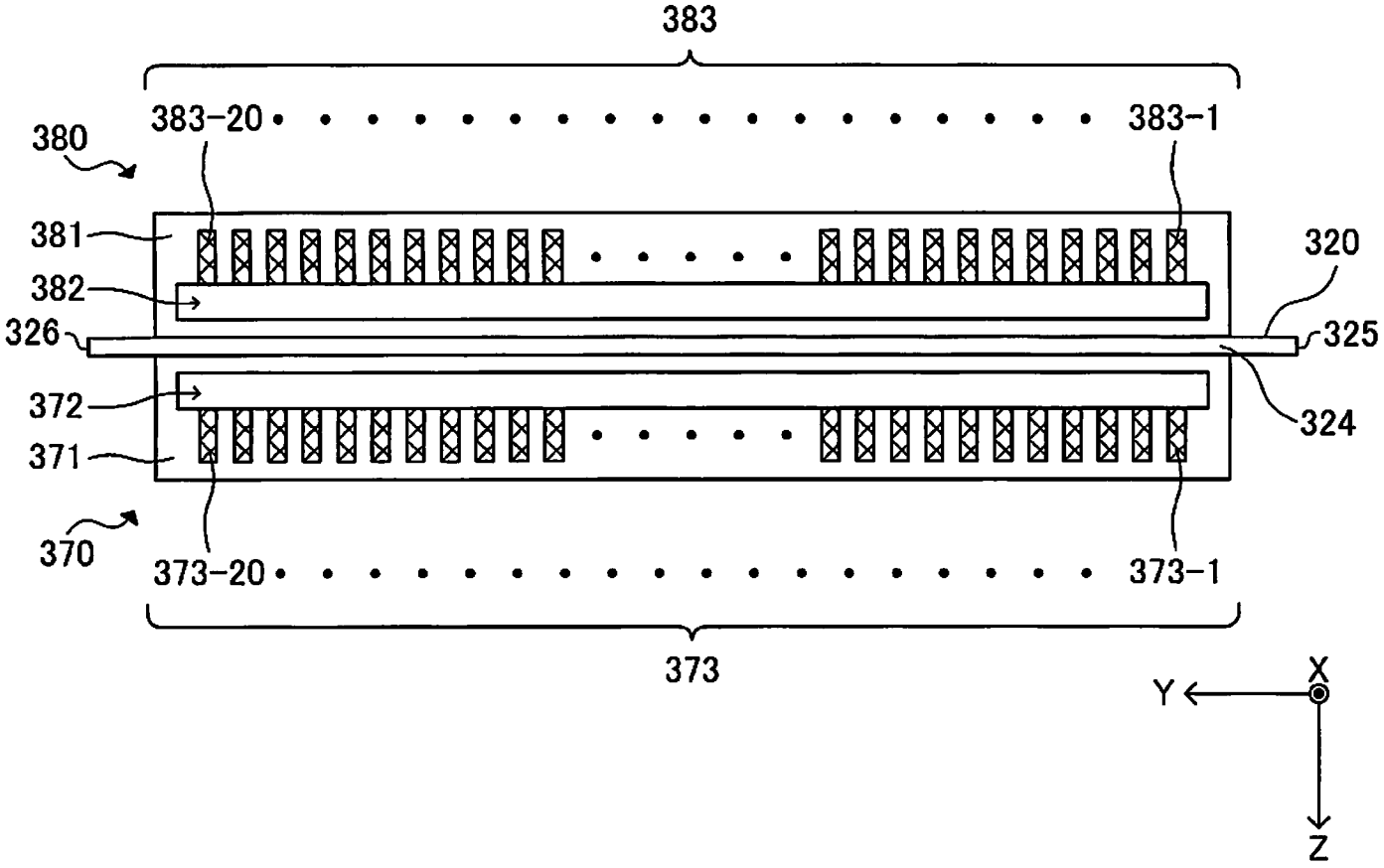
FIG. 29 is a diagram illustrating configurations of connectors in the third embodiment.

A configuration of the connectors 370 and 380 will be described with reference to FIG. 29. FIG. 29 is a diagram illustrating the configuration of the connectors 370 and 380 in the third embodiment. The connector 370 includes a housing 371, a cable attachment section 372 formed in the housing 371, and a plurality of terminals 373. The plurality of terminals 373 is provided to be aligned along the side 324. Specifically, 20 terminals 373 are provided to be aligned along the side 324. Here, the 20 terminals 373 are referred to as terminals 373-1, 373-2, . . . , and 373-20 in order from the side 325 toward the side 326 in a direction along the side 324. The cable attachment section 372 is located on the substrate 320 side of the plurality of terminals 373 in the Z-direction. The cable **19*c* is attached to the cable attachment section 372. When the cable 19*c* is attached to the cable attachment section 372, the terminals 196*c*-1 to 196*c*-20 in the cable 19*c* are electrically coupled to the terminals 373-1 to 373-20 in the connector 370, respectively. Similar to FIG. 18, in the connector 370, the plurality of terminals 373 may be located on the substrate 320 side of the cable attachment section 352** in the Z-direction.

The connector 380 includes a housing 381, a cable attachment section 382 formed in the housing 381, and a plurality of terminals 383. The plurality of terminals 383 is provided to be aligned along the side 324. Specifically, 20 terminals 383 are provided to be aligned along the side 324. Here, the 20 terminals 383 are referred to as terminals 383-1, 383-2, . . . , and 383-20 in order from the side 325 toward the side 326 in a direction along the side 324. The cable attachment section 382 is located on the substrate 320 side of the plurality of terminals 383 in the Z-direction. The cable 19*d* is attached to the cable attachment section 382. When the cable 19*d* is attached to the cable attachment section 382, the terminals 196*d*-1 to 196*d*-20 in the cable 19*d* are electrically coupled to the terminals 383-1 to 383-20 in the connector 380, respectively.

Next, details of a signal which are propagated in each of the cables 19*a*, 19*b*, 19*c*, and 19*d* and is input to the print head 21 will be described with reference to FIGS. 30 to 33.

FIG. 30 is a diagram illustrating details of a signal propagated in the cable 19*a* in the third embodiment. As illustrated in FIG. 30, the cable 19*a* includes wirings for propagating driving signals COM1 to COM5, wirings for propagating reference voltage signals CGND1 to CGND5, wirings for propagating a temperature signal TH, a latch signal LAT1, a clock signal SCK1, a change signal CH1, and a print data signal SI1, wirings for propagating diagnosis signals DIG-A to DIG-D, and a plurality of wirings for propagating a plurality of ground signals GND.

Specifically, the driving signals COM1 to COM5 and the reference voltage signals CGND1 to CGND5 are input from the terminals 195*a*-1 to 195*a*-10 to the cable 19*a* and are propagated in the wirings 197*a*-1 to 197*a*-10, respectively. Then, the driving signals COM1 to COM5 and the reference voltage signals CGND1 to CGND5 are input to the terminals 353-1 to 353-10 of the connector 350 via the terminals 196*a*-1 to 196*a*-10 and the contact sections 180*a*-1 to 180*a*-10, respectively.

The diagnosis signal DIG-A and the latch signal LAT1 are input from the terminal 195*a*-17 to the cable 19*a* and are propagated in the wiring 197*a*-17. Then, the diagnosis signal DIG-A and the latch signal LAT1 are input to the terminal 353-17 of the connector 350 via the terminal 196*a*-17 and the contact section 180*a*-17. That is, the wiring 197*a*-17 functions as a wiring for propagating the diagnosis signal DIG-A and a wiring for propagating the latch signal LAT1. The terminal 353-17 functions as a terminal to which the diagnosis signal DIG-A is input and a terminal to which the latch signal LAT1 is input. The contact section 180*a*-17 is electrically in contact with the wiring for propagating the diagnosis signal DIG-A and is also electrically in contact with the wiring for propagating the latch signal LAT1.

The diagnosis signal DIG-B and the clock signal SCK1 are input from the terminal 195*a*-15 to the cable 19*a* and are propagated in the wiring 197*a*-15. The diagnosis signal DIG-B and the clock signal SCK1 are input to the terminal 353-15 of the connector 350 via the terminal 196*a*-15 and the contact section 180*a*-15. That is, the wiring 197*a*-15 functions as a wiring for propagating the diagnosis signal DIG-B and a wiring for propagating the clock signal SCK1. The terminal 353-15 functions as a terminal to which the diagnosis signal DIG-B is input and a terminal to which the clock signal SCK1 is input. The contact section 180*a*-15 is electrically in contact with the wiring for propagating the diagnosis signal DIG-B and is also electrically in contact with the wiring for propagating the clock signal SCK1.

The diagnosis signal DIG-C and the change signal CH1 are input from the terminal 195*a*-13 to the cable 19*a* and are propagated in the wiring 197*a*-13. Then, the diagnosis signal DIG-C and the change signal CH1 are input to the terminal 353-13 of the connector 350 via the terminal 196*a*-13 and the contact section 180*a*-13. That is, the wiring 197*a*-13 functions as a wiring for propagating the diagnosis signal DIG-C and a wiring for propagating the change signal CH1. The terminal 353-13 functions as a terminal to which the diagnosis signal DIG-C is input and a terminal to which the change signal CH1 is input. The contact section 180*a*-13 is electrically in contact with the wiring for propagating the diagnosis signal DIG-C and is also electrically in contact with the wiring for propagating the change signal CH1.

The diagnosis signal DIG-D and the print data signal SI1 are input from the terminal 195*a*-11 to the cable 19*a* and are propagated in the wiring 197*a*-11. Then, the diagnosis signal DIG-D and the print data signal SI1 are input to the terminal 353-11 of the connector 350 via the terminal 196*a*-11 and the contact section 180*a*-11. That is, the wiring 197*a*-11 functions as a wiring for propagating the diagnosis signal DIG-D and a wiring for propagating the print data signal SI1. The terminal 353-11 functions as a terminal to which the diagnosis signal DIG-D is input and a terminal to which the print data signal SI1 is input. The contact section 180*a*-11 is electrically in contact with the wiring for propagating the diagnosis signal DIG-D and is also electrically in contact with the wiring for propagating the print data signal SI1.

The temperature signal TH is input to the terminal 353-19 of the connector 350 and then is input to the cable 19*a* via the contact section 180*a*-19 and the terminal 196*a*-19. The temperature signal TH is propagated in the wiring 197*a*-19 and then is input from the terminal 195*a*-19 to the main substrate 11.

The ground signal GND is input to the cable 19*a* from each of the terminals 195*a*-12, 195*a*-14, 195*a*-16, 195*a*-18, and 195*a*-20 and is propagated in each of the wirings 197*a*-12, 197*a*-14, 197*a*-16, 197*a*-18, and 197*a*-20. Then, the ground signal GND is input to each of the terminals 353-12, 353-14, 353-16, 353-18, and 353-20 of the connector 350 via each of the terminals 196*a*-12, 196*a*-14, 196*a*-16, 196*a*-18, and 196*a*-20 and each of the contact sections 180*a*-12, 180*a*-14, 180*a*-16, 180*a*-18, and 180*a*-20.

FIG. 31 is a diagram illustrating details of a signal propagated in the cable 19*b* in the third embodiment. As illustrated in FIG. 31, the cable 19*b* includes wirings for propagating the driving signals COM1 to COM5, wirings for propagating the reference voltage signals CGND1 to CGND5, wirings for propagating print data signals SI2 to SI5, a wiring for propagating a voltage VDD1, and a plurality of wirings for propagating a plurality of ground signals GND.

Specifically, the driving signals COM1 to COM5 and the reference voltage signals CGND1 to CGND5 are input from the terminals 195*b*-1 to 195*b*-10 to the cable 19*b* and are propagated in the wiring 197*b*-1 to 197*b*-10, respectively. Then, the driving signals COM1 to COM5 and the reference voltage signals CGND1 to CGND5 are input to the terminals 363-1 to 363-10 of the connector 360 via the terminals 196*b*-1 to 196*b*-10 and the contact sections 180*b*-1 to 180*b*-10, respectively.

The print data signals S12 to S15 are input to the cable 19*b* from the terminals 195*b*-18, 195*b*-16, 195*b*-14, and 195*b*-12 and are propagated in the wirings 197*b*-18, 197*b*-16, 197*b*-14, and 197*b*-12, respectively. Then, the print data signals S12 to S15 are input to the terminals 363-18, 363-16, 363-14, and 363-12 of the connector 360 via the terminals 196*b*-18, 196*b*-16, 196*b*-14, and 196*b*-12 and the contact sections 180*b*-18, 180*b*-16, 180*b*-14, and 180*b*-12, respectively.

The voltage VDD1 is input from the terminal 195*b*-20 to the cable 19*b* and is propagated in the wiring 197*b*-20. Then, the voltage VDD1 is input to the terminal 363-20 of the connector 360 via the terminal 196*b*-20 and the contact section 180*b*-20. Here, the voltage VDD1 is an example of a first voltage signal in the third embodiment. The wiring 197*b*-20 for propagating the voltage VDD1 is an example of a first voltage signal propagation wiring in the third embodiment. The terminal 363-20 to which the voltage VDD1 is input is an example of a sixth terminal in the third embodiment. The contact section 180*b*-20 at which the wiring 197*b*-20 and the terminal 363-20 are electrically in contact with each other is an example of a sixth contact section in the third embodiment.

The ground signal GND is input to the cable 19*b* from each of the terminals 195*b*-11, 195*b*-13, 195*b*-15, 195*b*-17, and 195*b*-19 and is propagated in each of the wirings 197*b*-11, 197*b*-13, 197*b*-15, 197*b*-17, and 197*b*-19. Then, the ground signal GND is input to each of the terminals 363-11, 363-13, 363-15, 363-17, and 363-19 of the connector 360 via each of the terminals 196*b*-11, 196*b*-13, 196*b*-15, 196*b*-17, and 196*b*-19 and each of the contact sections 180*b*-11, 180*b*-13, 180*b*-15, 180*b*-17, and 180*b*-19.

FIG. 32 is a diagram illustrating details of a signal propagated in the cable 19*c* in the third embodiment. As illustrated in FIG. 32, the cable 19*c* includes wirings for propagating driving signals COM6 to COM10, wirings for propagating reference voltage signals CGND6 to CGND10, wirings for propagating an abnormality signal XHOT, a latch signal LAT2, a clock signal SCK2, a change signal CH2, and a print data signal SI10, wirings for propagating diagnosis signals DIG-E to DIG-I, and a plurality of wirings for propagating a plurality of ground signals GND.

Specifically, the driving signals COM6 to COM10 and the reference voltage signals CGND6 to CGND10 are input from the terminals 195*c*-1 to 195*c*-10 and the contact sections 180*c*-1 to 180*c*-10 to the cable 19*c* and are propagated in the wiring 197*c*-1 to 197*c*-10, respectively. Then, the driving signals COM6 to COM10 and the reference voltage signals CGND6 to CGND10 are input to the terminals 373-1 to 373-10 of the connector 370 via the terminals 196*c*-1 to 196*c*-10, respectively.

The diagnosis signal DIG-E and the abnormality signal XHOT are input to the terminal 373-12 of the connector 370 and then is input to the cable 19*c* via the contact section 180*c*-12 and the terminal 196*c*-12. The diagnosis signal DIG-E is propagated in the wiring 197*c*-12 and then is input from the terminal 195*c*-12 to the main substrate 11. That is, the wiring 197*c*-12 functions as a wiring for propagating the diagnosis signal DIG-E and a wiring for propagating the abnormality signal XHOT. The terminal 373-12 functions as a terminal to which the diagnosis signal DIG-E is input and a terminal to which the abnormality signal XHOT is input. The contact section 180*c*-12 is electrically in contact with the wiring for propagating the diagnosis signal DIG-E and is also electrically in contact with the wiring for propagating the abnormality signal XHOT. The diagnosis signal DIG-E is an example of a fifth diagnosis signal in the third embodiment. The wiring 197*c*-12 for propagating the diagnosis signal DIG-E is an example of a fifth diagnosis signal propagation wiring in the third embodiment. The terminal 373-12 to which the diagnosis signal DIG-E is input is an example of a fifth terminal in the third embodiment. The contact section 180*c*-12 at which the wiring 197*c*-12 and the terminal 373-12 are electrically in contact with each other is an example of a fifth contact section in the third embodiment.

The diagnosis signal DIG-F and the latch signal LAT2 are input from the terminal 195*c*-14 to the cable 19*c* and are propagated in the wiring 197*c*-14. Then, the diagnosis signal DIG-F and the latch signal LAT2 are input to the terminal 373-14 of the connector 370 via the terminal 196*c*-14 and the contact section 180*c*-14. That is, the wiring 197*c*-14 functions as a wiring for propagating the diagnosis signal DIG-F and a wiring for propagating the latch signal LAT2. The terminal 373-14 functions as a terminal to which the diagnosis signal DIG-F is input and a terminal to which the latch signal LAT2 is input. The contact section 180*c*-14 is electrically in contact with the wiring for propagating the diagnosis signal DIG-F and is also electrically in contact with the wiring for propagating the latch signal LAT2. The diagnosis signal DIG-F is an example of a second diagnosis signal in the third embodiment. The wiring 197*c*-14 for propagating the diagnosis signal DIG-F is an example of a second diagnosis signal propagation wiring in the third embodiment. The terminal 373-14 to which the diagnosis signal DIG-F is input is an example of a second terminal in the third embodiment. The contact section 180*c*-14 at which the wiring 197*c*-14 and the terminal 373-14 are electrically in contact with each other is an example of a second contact section in the third embodiment.

The diagnosis signal DIG-G and the clock signal SCK2 are input from the terminal 195*c*-16 to the cable 19*c* and are propagated in the wiring 197*c*-16. Then, the diagnosis signal DIG-G and the clock signal SCK2 are input to the terminal 373-16 of the connector 370 via the terminal 196*c*-16 and the contact section 180*c*-16. That is, the wiring 197*c*-16 functions as a wiring for propagating the diagnosis signal DIG-G and a wiring for propagating the clock signal SCK2. The terminal 373-16 functions as a terminal to which the diagnosis signal DIG-G is input and a terminal to which the clock signal SCK2 is input. The contact section 180*c*-16 is electrically in contact with the wiring for propagating the diagnosis signal DIG-G and is also electrically in contact with the wiring for propagating the clock signal SCK2. The diagnosis signal DIG-G is an example of a first diagnosis signal in the third embodiment. The wiring 197*c*-16 for propagating the diagnosis signal DIG-G is an example of a first diagnosis signal propagation wiring in the third embodiment. The terminal 373-16 to which the diagnosis signal DIG-G is input is an example of a first terminal in the third embodiment. The contact section 180*c*-16 at which the wiring 197*c*-16 and the terminal 373-16 are electrically in contact with each other is an example of a first contact section in the third embodiment.

The diagnosis signal DIG-H and the change signal CH2 are input from the terminal 195*c*-18 to the cable 19*c* and are propagated in the wiring 197*c*-18. Then, the diagnosis signal DIG-H and the change signal CH2 are input to the terminal 373-18 of the connector 370 via the terminal 196*c*-18 and the contact section 180*c*-18. That is, the wiring 197*c*-18 functions as a wiring for propagating the diagnosis signal DIG-H and a wiring for propagating the change signal CH2. The terminal 373-18 functions as a terminal to which the diagnosis signal DIG-H is input and a terminal to which the change signal CH2 is input. The contact section 180*c*-18 is electrically in contact with the wiring for propagating the diagnosis signal DIG-H and is also electrically in contact with the wiring for propagating the change signal CH2. The diagnosis signal DIG-H is an example of a third diagnosis signal in the third embodiment. The wiring 197*c*-18 for propagating the diagnosis signal DIG-H is an example of a third diagnosis signal propagation wiring in the third embodiment. The terminal 373-18 to which the diagnosis signal DIG-H is input is an example of a third terminal in the third embodiment. The contact section 180*c*-18 at which the wiring 197*c*-18 and the terminal 373-18 are electrically in contact with each other is an example of a third contact section in the third embodiment.

The diagnosis signal DIG-I and the print data signal SI10 are input from the terminal 195*c*-20 to the cable 19*c* and are propagated in the wiring 197*c*-20. Then, the diagnosis signal DIG-I and the print data signal SI10 are input to the terminal 373-20 of the connector 370 via the terminal 196*c*-20 and the contact section 180*c*-20. That is, the wiring 197*c*-20 functions as a wiring for propagating the diagnosis signal DIG-I and a wiring for propagating the print data signal SI10. The terminal 373-20 functions as a terminal to which the diagnosis signal DIG-I is input and a terminal to which the print data signal SI10 is input. The contact section 180*c*-20 is electrically in contact with the wiring for propagating the diagnosis signal DIG-I and is also electrically in contact with the wiring for propagating the print data signal SI10. The diagnosis signal DIG-I is an example of a fourth diagnosis signal in the third embodiment. The wiring 197*c*-20 for propagating the diagnosis signal DIG-I is an example of a fourth diagnosis signal propagation wiring in the third embodiment. The terminal 373-20 to which the diagnosis signal DIG-I is input is an example of a fourth terminal in the third embodiment. The contact section 180*c*-20 at which the wiring 197*c*-20 and the terminal 373-20 are electrically in contact with each other is an example of a fourth contact section in the third embodiment.

The ground signal GND is input to the cable 19*c* from each of the terminals 195*c*-11, 195*c*-13, 195*c*-15, 195*c*-17, and 195*c*-19 and is propagated in each of the wirings 197*c*-11, 197*c*-13, 197*c*-15, 197*c*-17, and 197*c*-19. Then, the ground signal GND is input to each of the terminals 373-11, 373-13, 373-15, 373-17, and 373-19 of the connector 370 via each of the terminals 196*c*-11, 196*c*-13, 196*c*-15, 196*c*-17, and 196*c*-19 and each of the contact sections 180*c*-11, 180*c*-13, 180*c*-15, 180*c*-17, and 180*c*-19. Here, at least one of the wiring 197*c*-15 and the wiring 197*c*-17 which are adjacent to the wiring 197*c*-16 in which the diagnosis signal DIG-G is propagated, and are used for propagating the ground signal GND is an example of a first ground signal propagation wiring in the third embodiment. At least one of the terminal 373-15 and the terminal 373-17 to which the ground signal GND propagated in the wiring 197*c*-15 and the wiring 197*c*-17 is input is an example of a first ground terminal in the third embodiment. At least one of the contact section 180*c*-15 and the contact section 180*c*-17, at which at least one of the wiring 197*c*-15 and the wiring 197*c*-17 and at least one of the terminal 373-15 and the terminal 373-17 are electrically in contact with each other is an example of a first ground contact section in the third embodiment.

FIG. 33 is a diagram illustrating details of a signal propagated in the cable 19*d* in the third embodiment. As illustrated in FIG. 32, the cable 19*d* includes wirings for propagating the driving signals COM6 to COM10, wirings for propagating the reference voltage signals CGND6 to CGND10, wirings for propagating print data signals SI6 to SI9, wirings for propagating voltages VHV and VDD2, and a plurality of wirings for propagating a plurality of ground signals GND.

Specifically, the driving signals COM6 to COM10 and the reference voltage signals CGND6 to CGND10 are input from the terminals 195*d*-1 to 195*d*-10 to the cable 19*d* and are propagated in the wiring 197*d*-1 to 197*d*-10, respectively. Then, the driving signals COM6 to COM10 and the reference voltage signals CGND6 to CGND10 are input to the terminals 383-1 to 383-10 of the connector 380 via the terminals 196*d*-1 to 196*d*-10 and the contact sections 180*d*-1 to 180*d*-10, respectively.

The print data signals SI6 to SI9 are input to the cable 19*d* from the terminals 195*d*-13, 195*d*-15, 195*d*-17, and 195*d*-19 and are propagated in the wirings 197*d*-13, 197*d*-15, 197*d*-17, and 197*d*-19, respectively. The print data signals SI6 to SI9 are input to the terminals 383-13, 383-15, 383-17, and 383-19 of the connector 380 via the terminals 196*d*-13, 196*d*-15, 196*d*-17, and 196*d*-19 and the contact sections 180*d*-13, 180*d*-15, 180*d*-17, and 180*d*-19, respectively.

The voltage VHV is input from the terminal 195*d*-11 to the cable 19*d* and is propagated in the wiring 197*d*-11. Then, the voltage VHV is input to the terminal 383-11 of the connector 380 via the terminal 196*d*-11 and the contact section 180*d*-11. The voltage VHV is an example of a third voltage signal in the third embodiment. The wiring 197*d*-11 for propagating the voltage VHV is an example of a third voltage signal propagation wiring in the third embodiment. The terminal 383-11 to which the voltage VHV is input is an example of an eighth terminal in the third embodiment. The contact section 180*d*-11 at which the wiring 197*d*-11 and the terminal 383-11 are electrically in contact with each other is an example of an eighth contact section in the third embodiment.

The voltage VDD2 is input from the terminal 195*d*-16 to the cable 19*d* and is propagated in the wiring 197*d*-16. Then, the voltage VDD2 is input to the terminal 383-16 of the connector 380 via the terminal 196*d*-16 and the contact section 180*d*-16. The voltage VDD2 is an example of a second voltage signal in the third embodiment. The wiring 197*d*-16 for propagating the voltage VDD2 is an example of a second voltage signal propagation wiring in the third embodiment. The terminal 383-16 to which the voltage VDD2 is input is an example of a seventh terminal in the third embodiment. The contact section 180*d*-16 at which the wiring 197*d*-16 and the terminal 383-16 are electrically in contact with each other is an example of a seventh contact section in the third embodiment.

The ground signal GND is input to the cable 19*d* from each of the terminals 195*d*-12, 195*d*-14, 195*d*-18, and 195*d*-20 and is propagated in each of the wirings 197*d*-12, 197*d*-14, 197*d*-18, and 197*d*-20. Then, the ground signal GND is input to each of the terminals 383-12, 383-14, 383-18, and 383-20 of the connector 380 via each of the terminals 196*d*-12, 196*d*-14, 196*d*-18, and 196*d*-20 and each of the contact sections 180*d*-12, 180*d*-14, 180*d*-18, and 180*d*-20. Here, the wiring 197*d*-10 which is adjacent to the wiring 197*d*-11 in which the voltage VHV is propagated, and in which the ground signal GND is propagated is an example of a second ground signal propagation wiring in the third embodiment. The terminal 383-11 to which the ground signal GND propagated in the wiring 197*d*-11 is input is an example of a second ground terminal in the third embodiment. The contact section 180*d*-11 at which the wiring 197*d*-11 and the terminal 383-11 are electrically in contact with each other is an example of a second ground signal contact section in the third embodiment.

As described above, in the liquid discharge apparatus 1, the print head 21, and the print head control circuit 15 in the third embodiment, the wiring 197*c*-16 in which the diagnosis signal DIG-G is propagated and the wiring 197*d*-16 in which the voltage VDD2 is propagated are provided in the cable 19*c* and the cable 19*d* different from each other and are located to face each other. The terminal 373-16 to which the diagnosis signal DIG-G is input and the terminal 383-16 to which the voltage VDD2 is input are provided in the connector 370 and the connector 380 different from each other and are located to face each other. Thus, effects similar to those in the first embodiment are also exhibited in the liquid discharge apparatus 1, the print head 21, and the print head control circuit 15 in the third embodiment.

Hitherto, the embodiments and the modification examples are described. However, the present disclosure is not limited to the above embodiments, and various forms can be made in a range without departing from the gist thereof. For example, combinations of the above embodiments can be appropriately made.

The present disclosure includes configurations which are substantially the same as the configurations described in the above embodiments (for example, configurations having the same functions, methods, and results or configurations having the same purposes and effects). The present disclosure includes configurations in which non-essential components of the configurations described in the embodiments are replaced. The present disclosure includes configurations having the same advantageous effects as those of the configurations described in the embodiments or includes configurations capable of achieving the same object. The present disclosure includes configurations in which a known technique is added to the configurations described in the embodiments.

What is claimed is:

1. A print head control circuit that controls an operation of a print head including a driving element that drives based on a driving signal, so as to discharge a liquid from a nozzle, a driving signal selection circuit that controls a supply of the driving signal to the driving element, a first terminal, a second terminal, a third terminal, a fourth terminal, a fifth terminal, a sixth terminal, a seventh terminal, and a diagnosis circuit that diagnoses whether or not normal discharge of the liquid is possible, based on a first diagnosis signal input to the first terminal, a second diagnosis signal input to the second terminal, a third diagnosis signal input to the third terminal, and a fourth diagnosis signal input to the fourth terminal, the print head control circuit comprising:

a first diagnosis signal propagation wiring for propagating the first diagnosis signal;

a second diagnosis signal propagation wiring for propagating the second diagnosis signal;

a third diagnosis signal propagation wiring for propagating the third diagnosis signal;

a fourth diagnosis signal propagation wiring for propagating the fourth diagnosis signal;

a fifth diagnosis signal propagation wiring for propagating a fifth diagnosis signal which is input to the fifth terminal and indicates a diagnosis result of the diagnosis circuit;

a first voltage signal propagation wiring for propagating a first voltage signal which is input to the sixth terminal and is supplied to the driving signal selection circuit;

a second voltage signal propagation wiring for propagating a second voltage signal input to the seventh terminal;

a diagnosis signal output circuit that outputs the first diagnosis signal, the second diagnosis signal, the third diagnosis signal, and the fourth diagnosis signal; and a driving signal output circuit that outputs the driving signal, wherein when the fifth diagnosis signal propagation wiring and the second voltage signal propagation wiring are electrically coupled to the print head, the fifth diagnosis signal propagation wiring and the second voltage signal propagation wiring are electrically coupled to each other via the fifth terminal and the seventh terminal, the first diagnosis signal propagation wiring and the second diagnosis signal propagation wiring are located to be aligned, and the first diagnosis signal propagation wiring and the second voltage signal propagation wiring are located to be adjacent to each other in a direction in which the first diagnosis signal propagation wiring and the second diagnosis signal propagation wiring are aligned.

2. The print head control circuit according to claim 1, wherein the fifth diagnosis signal propagation wiring is also used as a wiring for propagating a signal indicating whether or not temperature abnormality occurs in the print head.

3. The print head control circuit according to claim 1, further comprising:

a first ground signal propagation wiring for propagating a ground signal, wherein the first diagnosis signal propagation wiring and the first ground signal propagation wiring are located to be adjacent to each other in the direction in which the first diagnosis signal propagation wiring and the second diagnosis signal propagation wiring are aligned.

4. The print head control circuit according to claim 1, further comprising:

a third voltage signal propagation wiring for propagating a third voltage signal having a voltage value larger than a voltage value of the first voltage signal, wherein the second voltage signal propagation wiring and the third voltage signal propagation wiring are not located to be adjacent to each other in the direction in which the first diagnosis signal propagation wiring and the second diagnosis signal propagation wiring are aligned.

5. The print head control circuit according to claim 4, further comprising:

a second ground signal propagation wiring for propagating the ground signal, wherein the third voltage signal propagation wiring and the second ground signal propagation wiring are located to be adjacent to each other in the direction in which the first diagnosis signal propagation wiring and the second diagnosis signal propagation wiring are aligned.

6. The print head control circuit according to claim 4, further comprising:

a second ground signal propagation wiring for propagating the ground signal, wherein the third voltage signal propagation wiring and the second ground signal propagation wiring are located to overlap each other in a direction intersecting the direction in which the first diagnosis signal propagation wiring and the second diagnosis signal propagation wiring are aligned.

7. The print head control circuit according to claim 1, further comprising:

a third voltage signal propagation wiring for propagating a third voltage signal having a voltage value larger than a voltage value of the first voltage signal, wherein the second voltage signal propagation wiring and the third voltage signal propagation wiring are not located to overlap each other in a direction perpendicular to the direction in which the first diagnosis signal propagation wiring and the second diagnosis signal propagation wiring are aligned.

8. The print head control circuit according to claim 1, wherein the print head includes a first connector including the first terminal, the second terminal, the third terminal, the fourth terminal, and the fifth terminal, and a substrate, the first connector and the diagnosis circuit are provided on the same surface of the substrate, the first diagnosis signal propagation wiring, the second diagnosis signal propagation wiring, the third diagnosis signal propagation wiring, the fourth diagnosis signal propagation wiring, and the fifth diagnosis signal propagation wiring are provided in the same cable, and the cable is electrically coupled to the first connector.

9. The print head control circuit according to claim 1, wherein the first diagnosis signal propagation wiring is also used as a wiring for propagating a clock signal.

10. The print head control circuit according to claim 1, wherein the second diagnosis signal propagation wiring is also used as a wiring for propagating a signal for defining a discharge timing of the liquid.

11. The print head control circuit according to claim 1, wherein the third diagnosis signal propagation wiring is also used as a wiring for propagating a signal for defining a waveform switching timing of the driving signal.

12. The print head control circuit according to claim 1, wherein the fourth diagnosis signal propagation wiring is also used as a wiring for propagating a signal for defining selection of a waveform of the driving signal.

13. A print head comprising:

a driving element that drives based on a driving signal, so as to discharge a liquid from a nozzle;

a driving signal selection circuit that controls a supply of the driving signal to the driving element;

a diagnosis circuit that diagnoses whether or not normal discharge of the liquid is possible, based on a first diagnosis signal, a second diagnosis signal, a third diagnosis signal, and a fourth diagnosis signal;

a first terminal to which the first diagnosis signal is input;

a second terminal to which the second diagnosis signal is input;

a third terminal to which the third diagnosis signal is input;

a fourth terminal to which the fourth diagnosis signal is input;

a fifth terminal to which a fifth diagnosis signal indicating a diagnosis result of the diagnosis circuit is input;

a sixth terminal to which a first voltage signal to be supplied to the driving signal selection circuit is input; and a seventh terminal to which a second voltage signal is input, wherein the fifth terminal and the seventh terminal are electrically coupled to each other, the first terminal and the second terminal are located to be aligned, and the first terminal and the seventh terminal are located to be adjacent to each other in a direction in which the first terminal and the second terminal are aligned.

14. The print head according to claim 13, further comprising:

a temperature abnormality detection circuit that diagnoses whether or not temperature abnormality occurs, wherein the fifth terminal is also used as a terminal to which a signal indicating whether or not temperature abnormality occurs is input.

15. The print head according to claim 13, further comprising:

a first ground terminal to which a ground signal is input, wherein the first terminal and the first ground terminal are located to be adjacent to each other in the direction in which the first terminal and the second terminal are aligned.

16. The print head according to claim 13, further comprising:

an eighth terminal to which a third voltage signal having a voltage value larger than a voltage value of the first voltage signal is input, wherein the seventh terminal and the eighth terminal are not located to be adjacent to each other in the direction in which the first terminal and the second terminal are aligned.

17. The print head according to claim 16, further comprising:

a second ground terminal to which the ground signal is input, wherein the eighth terminal and the second ground terminal are located to be adjacent to each other in the direction in which the first terminal and the second terminal are aligned.

18. The print head according to claim 16, further comprising:

a second ground terminal to which the ground signal is input, wherein the eighth terminal and the second ground terminal are located to overlap each other in a direction intersecting the direction in which the first terminal and the second terminal are aligned.

19. The print head according to claim 13, further comprising:

an eighth terminal to which a third voltage signal having a voltage value larger than a voltage value of the first voltage signal is input, wherein the seventh terminal and the eighth terminal are not located to overlap each other in a direction perpendicular to the direction in which the first terminal and the second terminal are aligned.

20. The print head according to claim 13, further comprising:

a first connector including the first terminal, the second terminal, the third terminal, the fourth terminal, and the fifth terminal; and a substrate, wherein the first connector and the diagnosis circuit are provided on the same surface of the substrate.

21. The print head according to claim 13, wherein the first terminal is also used as a terminal to which a clock signal is input.

22. The print head according to claim 13, wherein the second terminal is also used as a terminal to which a signal for defining a discharge timing of the liquid is input.

23. The print head according to claim 13, wherein the third terminal is also used as a terminal to which a signal for defining a waveform switching timing of the driving signal is input.

24. The print head according to claim 13, wherein the fourth terminal is also used as a terminal to which a signal for defining selection of a waveform of the driving signal is input.

25. A liquid discharge apparatus comprising:

a print head; and a print head control circuit that controls an operation of the print head, wherein the print head includes a driving element that drives based on a driving signal, so as to discharge a liquid from a nozzle, a driving signal selection circuit that controls a supply of the driving signal to the driving element, a diagnosis circuit that diagnoses whether or not normal discharge of the liquid is possible, based on a first diagnosis signal, a second diagnosis signal, a third diagnosis signal, and a fourth diagnosis signal, a first terminal to which the first diagnosis signal is input, a second terminal to which the second diagnosis signal is input, a third terminal to which the third diagnosis signal is input, a fourth terminal to which the fourth diagnosis signal is input, a fifth terminal to which a fifth diagnosis signal indicating a diagnosis result of the diagnosis circuit is input, a sixth terminal to which a first voltage signal to be supplied to the driving signal selection circuit is input, and a seventh terminal to which a second voltage signal is input, the print head control circuit includes a first diagnosis signal propagation wiring for propagating the first diagnosis signal, a second diagnosis signal propagation wiring for propagating the second diagnosis signal, a third diagnosis signal propagation wiring for propagating the third diagnosis signal, a fourth diagnosis signal propagation wiring for propagating the fourth diagnosis signal, a fifth diagnosis signal propagation wiring for propagating the fifth diagnosis signal, a first voltage signal propagation wiring for propagating the first voltage signal, a second voltage signal propagation wiring for propagating the second voltage signal, a diagnosis signal output circuit that outputs the first diagnosis signal, the second diagnosis signal, the third diagnosis signal, and the fourth diagnosis signal, and a driving signal output circuit that outputs the driving signal, the first diagnosis signal propagation wiring is electrically in contact with the first terminal at a first contact section, the second diagnosis signal propagation wiring is electrically in contact with the second terminal at a second contact section, the third diagnosis signal propagation wiring is electrically in contact with the third terminal at a third contact section, the fourth diagnosis signal propagation wiring is electrically in contact with the fourth terminal at a fourth contact section, the fifth diagnosis signal propagation wiring is electrically in contact with the fifth terminal at a fifth contact section, the first voltage signal propagation wiring is electrically in contact with the sixth terminal at a sixth contact section, the second voltage signal propagation wiring is electrically in contact with the seventh terminal at a seventh contact section, the fifth diagnosis signal propagation wiring and the second voltage signal propagation wiring are electrically coupled to each other via the fifth terminal, the fifth contact section, the seventh contact section, and the seventh terminal, the first contact section and the second contact section are located to be aligned, and the first contact section and the seventh contact section are located to be adjacent to each other in a direction in which the first contact section and the second contact section are aligned.

26. The liquid discharge apparatus according to claim 25, wherein the print head further includes a temperature abnormality detection circuit that diagnoses whether or not temperature abnormality occurs, and the fifth diagnosis signal propagation wiring is also used as a wiring for propagating a signal indicating whether or not the temperature abnormality occurs.

27. The liquid discharge apparatus according to claim 25, wherein the print head further includes a first ground terminal to which a ground signal is input, the print head control circuit further includes a first ground signal propagation wiring for propagating the ground signal, the first ground signal propagation wiring is electrically in contact with the first ground terminal at a first ground contact section, and the first contact section and the first ground contact section are located to be adjacent to each other in the direction in which the first contact section and the second contact section are aligned.

28. The liquid discharge apparatus according to claim 25, wherein the print head further includes an eighth terminal to which a third voltage signal having a voltage value larger than a voltage value of the first voltage signal is input, the print head control circuit further includes a third voltage signal propagation wiring for propagating the third voltage signal, the third voltage signal propagation wiring is electrically in contact with the eighth terminal at an eighth contact section, and the seventh contact section and the eighth contact section are not located to be adjacent to each other in the direction in which the first contact section and the second contact section are aligned.

29. The liquid discharge apparatus according to claim 28, wherein the print head further includes a second ground terminal to which the ground signal is input, the print head control circuit further includes a second ground signal propagation wiring for propagating the ground signal, the second ground signal propagation wiring is electrically in contact with the second ground terminal at a second ground contact section, and the eighth contact section and the second ground contact section are located to be adjacent to each other in the direction in which the first contact section and the second contact section are aligned.

30. The liquid discharge apparatus according to claim 28, wherein the print head further includes a second ground terminal to which the ground signal is input, the print head control circuit further includes a second ground signal propagation wiring for propagating the ground signal, the second ground signal propagation wiring is electrically in contact with the second ground terminal at a second ground contact section, and the eighth contact section and the second ground contact section are located to overlap each other in a direction intersecting the direction in which the first contact section and the second contact section are aligned.

31. The liquid discharge apparatus according to claim 25, wherein the print head further includes an eighth terminal to which a third voltage signal having a voltage value larger than a voltage value of the first voltage signal is input, the print head control circuit further includes a third voltage signal propagation wiring for propagating the third voltage signal, the third voltage signal propagation wiring is electrically in contact with the eighth terminal at an eighth contact section, and the seventh contact section and the eighth contact section are not located to overlap each other in a direction perpendicular to the direction in which the first contact section and the second contact section are aligned.

32. The liquid discharge apparatus according to claim 25, wherein the print head further includes a first connector including the first terminal, the second terminal, the third terminal, the fourth terminal, and the fifth terminal and a substrate, the first connector and the diagnosis circuit are provided on the same surface of the substrate, the first diagnosis signal propagation wiring, the second diagnosis signal propagation wiring, the third diagnosis signal propagation wiring, the fourth diagnosis signal propagation wiring, and the fifth diagnosis signal propagation wiring are provided in the same cable, and the cable is electrically coupled to the first connector.

33. The liquid discharge apparatus according to claim 25, wherein the first diagnosis signal propagation wiring is also used as a wiring for propagating a clock signal.

34. The liquid discharge apparatus according to claim 25, wherein the second diagnosis signal propagation wiring is also used as a wiring for propagating a signal for defining a discharge timing of the liquid.

35. The liquid discharge apparatus according to claim 25, wherein the third diagnosis signal propagation wiring is also used as a wiring for propagating a signal for defining a waveform switching timing of the driving signal.

36. The liquid discharge apparatus according to claim 25, wherein the fourth diagnosis signal propagation wiring is also used as a wiring for propagating a signal for defining selection of a waveform of the driving signal.

* * * * *